US009626840B2

(12) United States Patent
Williamson et al.

(10) Patent No.: US 9,626,840 B2
(45) Date of Patent: Apr. 18, 2017

(54) ELECTRONIC GAMING DEVICE WITH SMART WILD FUNCTIONALITY

(71) Applicant: Cadillac Jack, Inc., Duluth, GA (US)

(72) Inventors: Jennifer Lynn Williamson, Norcross, GA (US); Steven W. Davis, Suwanee, GA (US)

(73) Assignee: Cadillac Jack, Inc., Duluth, GA (US)

( * ) Notice: Subject to any disclaimer, the term of this patent is extended or adjusted under 35 U.S.C. 154(b) by 241 days.

(21) Appl. No.: 13/914,105

(22) Filed: Jun. 10, 2013

(65) Prior Publication Data

US 2014/0364193 A1 Dec. 11, 2014

(51) Int. Cl.
*G07F 17/34* (2006.01)
*G07F 17/32* (2006.01)

(52) U.S. Cl.
CPC ..... *G07F 17/34* (2013.01); *G07F 17/326* (2013.01)

(58) Field of Classification Search
CPC ..... G07F 17/3258; G07F 17/3262; G07F 17/3267; G07F 17/34; G07F 17/326
USPC ..... 463/16–20
See application file for complete search history.

(56) References Cited

U.S. PATENT DOCUMENTS

| | | | | |
|---|---|---|---|---|
| 6,270,412 | B1 * | 8/2001 | Crawford et al. | 463/20 |
| 2007/0060332 | A1 * | 3/2007 | Anderson | G07F 17/32 463/29 |
| 2008/0081687 | A1 * | 4/2008 | Blumel | G07F 17/34 463/20 |
| 2009/0075722 | A1 * | 3/2009 | Louie | G07F 17/32 463/20 |
| 2010/0120525 | A1 * | 5/2010 | Baerlocher et al. | 463/29 |

* cited by examiner

*Primary Examiner* — Jasson Yoo
(74) *Attorney, Agent, or Firm* — Weide & Miller, Ltd.

(57) ABSTRACT

Examples disclosed herein relate to an electronic gaming device including a memory, a processor, and a plurality of reels. The electronic gaming device may include a plurality of reels. The plurality of reels may include one or more areas. The memory may include one or more smart wild feature structures. The processor may generate one or more symbols to be located in the one or more areas. The processor may move a first smart wild to a first replacement location based on the first replacement location having a top award amount.

14 Claims, 45 Drawing Sheets

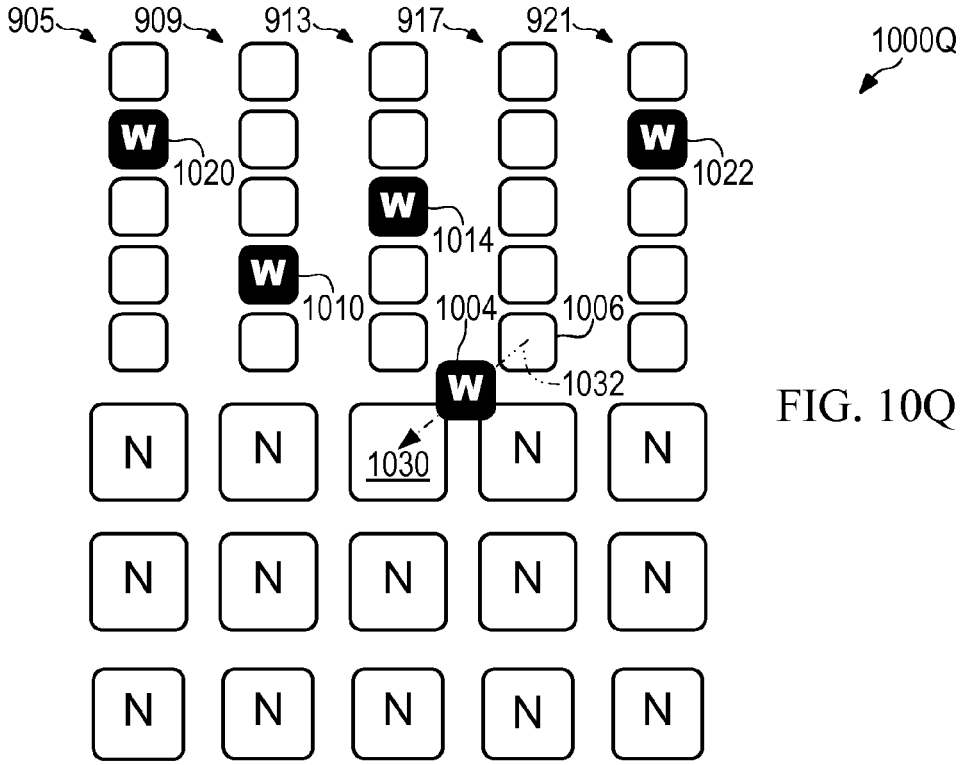
905
909
913
917
921
1000Q
W
1020
W
1022
W
1014
W
1010
1004
1006
W
1032
N
1030
N
N
N

ELECTRONIC GAMING DEVICE WITH SMART WILD FUNCTIONALITY

FIELD

The subject matter disclosed herein relates to an electronic gaming device. More specifically, the disclosure relates to providing one or more smart wild functionalities on a gaming device.

INFORMATION

The gaming industry has numerous casinos located both worldwide and in the United States. A client of a casino or other gaming entity can gamble via various games of chance. For example, craps, roulette, baccarat, blackjack, and electronic games (e.g., a slot machine) where a person may gamble on an outcome.

Paylines of an electronic gaming device (e.g., a slot machine) are utilized to determine when predetermined winning symbol combinations are aligned in a predetermined pattern to form a winning combination. A winning event occurs when the player successfully matches the predetermined winning symbols in one of the predetermined patterns.

A player's entertainment while playing one or more games may be enhanced by utilizing one or more smart wild functionalities on the gaming device. By increasing the player's entertainment level, the player's enjoyment of the game may be enhanced, which may increase a player's game playing period.

BRIEF DESCRIPTION OF THE FIGURES

Non-limiting and non-exhaustive examples will be described with reference to the following figures, wherein like reference numerals refer to like parts throughout the various figures.

FIG. 10Q is another illustration of game play on a gaming device, according to one embodiment.

FIG. 10R is another illustration of game play on a gaming device, according to one embodiment.

DETAILED DESCRIPTION

Figure 1:
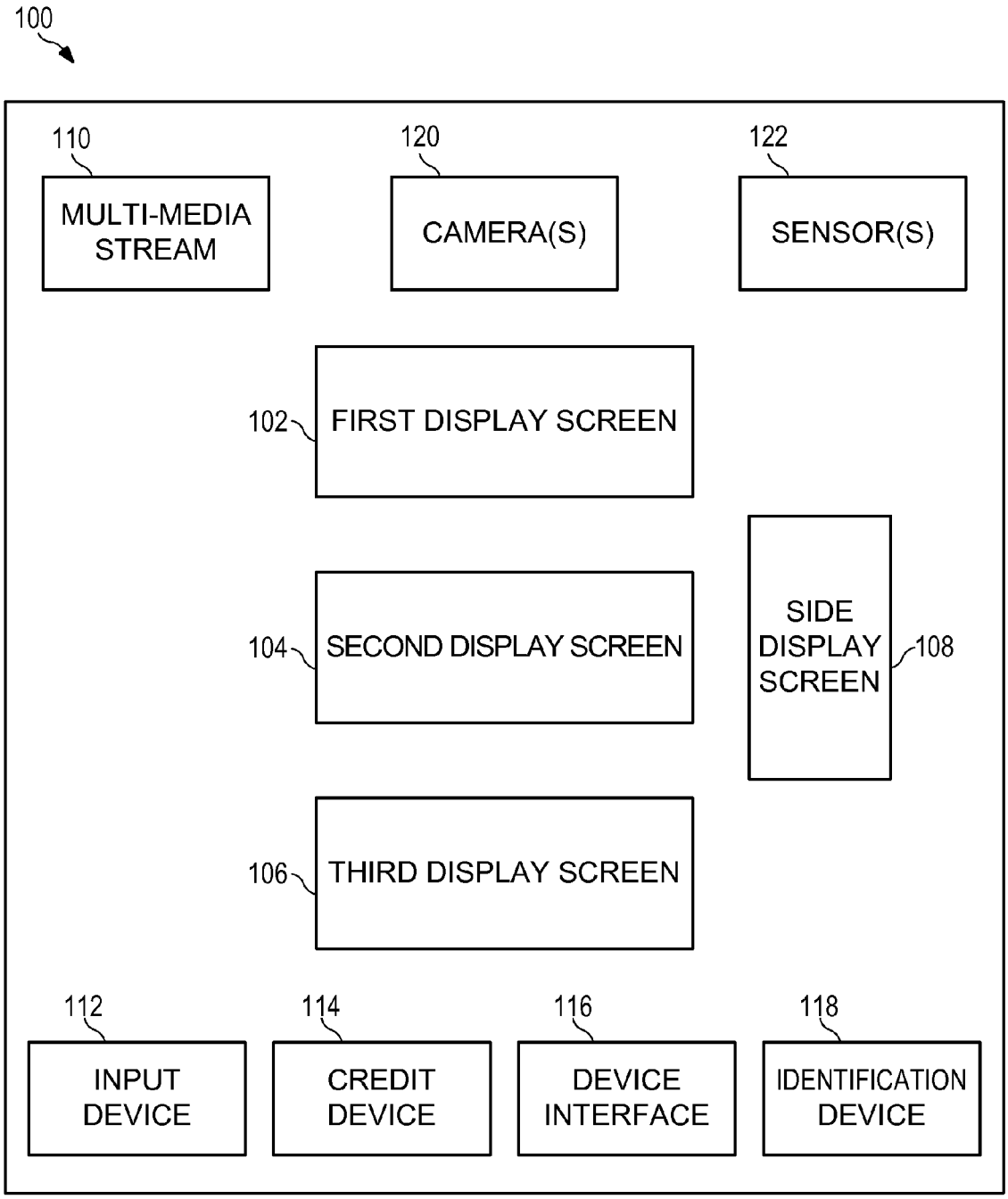
FIG. 1 is an illustration of the electronic gaming device, according to one embodiment.

FIG. 1 is an illustration of an electronic gaming device 100. Electronic gaming device 100 may include a multi-media stream 110, a first display screen 102, a second display screen 104, a third display screen 106, a side display screen 108, an input device 112, a credit device 114, a device interface 116, and an identification device 118. Electronic gaming device 100 may display one, two, a few, or a plurality of multi-media streams 110, which may be obtained from one or more gaming tables, one or more electronic gaming devices, a central server, a video server, a music server, an advertising server, another data source, and/or any combination thereof.

Multi-media streams may be obtained for an entertainment event, a wagering event, a promotional event, a promotional offering, an advertisement, a sporting event, any other event, and/or any combination thereof. For example, the entertainment event may be a concert, a show, a television program, a movie, an Internet event, and/or any combination thereof. In another example, the wagering event may be a poker tournament, a horse race, a car race, and/or any combination thereof. The advertisement may be an advertisement for a casino, a restaurant, a shop, any other entity, and/or any combination thereof. The sporting event may be a football game, a baseball game, a hockey game, a basketball game, any other sporting event, and/or any combination thereof. These multi-media streams may be utilized in combination with the gaming table video streams.

Input device 112 may be mechanical buttons, electronic buttons, mechanical switches, electronic switches, optical switches, a slot pull handle, a keyboard, a keypad, a touch screen, a gesture screen, a joystick, a pointing device (e.g., a mouse), a virtual (on-screen) keyboard, a virtual (on-screen) keypad, biometric sensor, or any combination thereof. Input device 112 may be utilized to select one or more smart wild gaming options, to make a wager, to control any object, to select one or more pattern gaming options, to obtain data relating to historical payouts, to select a row and/or column to move, to select a row area to move, to select a column area to move, to select a symbol (or image) to move, to modify electronic gaming device 100 (e.g., change sound level, configuration, font, language, etc.), to select a movie or song, to select live multi-media streams, to request services (e.g., drinks, slot attendant, manager, etc.), to select two-dimensional ("2D") game play, to select three-dimensional ("3D") game play, to select both two-dimensional and three-dimensional game play, to change the orientation of games in a three-dimensional space, to move a symbol (e.g., wild, multiplier, etc.), and/or any combination thereof. These selections may occur via any other input device (e.g., a touch screen, voice commands, etc.). Input device 112 may be any control panel.

Credit device 114 may be utilized to collect monies and distribute monies (e.g., cash, vouchers, etc.). Credit device 114 may interface with a mobile device to electronically transmit money and/or credits. Credit device 114 may interface with a player's card to exchange player points.

Device interface 116 may be utilized to interface electronic gaming device 100 to a bonus game device, a local area progressive controller, a wide area progressive controller, a progressive sign controller, a peripheral display device, signage, a promotional device, network components, a local network, a wide area network, remote access equipment, a slot monitoring system, a slot player tracking system, the Internet, a server, and/or any combination thereof.

Device interface 116 may be utilized to connect a player to electronic gaming device 100 through a mobile device, card, keypad, identification device 118, and/or any combination thereof. Device interface 116 may include a docking station by which a mobile device is plugged into electronic gaming machine 100. Device interface 116 may include an over the air connection by which a mobile device is connected to electronic gaming machine 100 (e.g., Bluetooth, Near Field technology, and/or Wi-Fi technology). Device interface 116 may include a connection to identification device 118.

Identification device 118 may be utilized to determine an identity of a player. Based on information obtained by identification device 118, electronic gaming device 100 may be reconfigured. For example, the language, sound level, music, placement of multi-media streams, one or more game functionalities (e.g., game type 1, game type 2, game type 3, etc.) may be presented, a smart wild gaming option may be presented, a repeat payline gaming option may be presented, a pattern gaming option may be presented, historical gaming data may be presented, a row rearrangement option may be presented, a column rearrangement option may be presented, a row area rearrangement option may be presented, a column area rearrangement option may be presented, a two-dimensional gaming option may be presented, a three-dimensional gaming option may be presented, and/or the placement of gaming options may be modified based on player preference data. For example, the player may only want to play games that include smart wild gaming options only. Therefore, only games which include smart wild gaming options would be presented to the player. In another example, the player may only want to play games that include historical information relating to game play. Therefore, only games which include historical gaming data would be presented to the player. These examples may be combined.

Identification device 118 may utilize biometrics (e.g., thumb print, retinal scan, or other biometric). Identification device 118 may include a card entry slot into input device 112. Identification device 118 may include a keypad with an assigned pin number for verification. Identification device 118 may include multiple layers of identification for added security. For example, a player could be required to enter a player tracking card, and/or a pin number, and/or a thumb print, and/or any combination thereof. Based on information obtained by identification device 118, electronic gaming device 100 may be reconfigured. For example, the language, sound level, music, placement of video streams, placement of images, and the placement of gaming options utilized may be modified based on a player's preference data. For example, a player may have selected baseball under the sporting event preferences; electronic gaming device 100 will then automatically display the current baseball game onto side display screen 108 and/or an alternate display screen as set in the player's options.

First display screen 102 may be a liquid crystal display ("LCD"), a cathode ray tube display ("CRT"), organic light-emitting diode display ("OLED"), plasma display panel ("PDP"), electroluminescent display ("ELD"), a light-emitting diode display ("LED"), or any other display technology. First display screen 102 may be used for displaying primary games or secondary (bonus) games, to display one or more warnings relating to one or more audio devices, one or more display devices, one or more electrical wires, one or more springs, one or more motors, one or more adjustable devices, and/or one or more sensors, advertising, player attractions, electronic gaming device 100 configuration parameters and settings, game history, accounting meters, events, alarms, and/or any combination thereof. Second display screen 104, third display screen 106, side display screen 108, and any other screens may utilize the same technology as first display screen 102 and/or any combination of technologies.

First display screen 102 may also be virtually combined with second display screen 104. Likewise second display screen 104 may also be virtually combined with third display screen 106. First display screen 102 may be virtually combined with both second display screen 104 and third display screen 106. Any combination thereof may be formed.

For example, a single large image could be partially displayed on second display screen 104 and partially displayed on third display screen 106, so that when both display screens are put together they complete one image. Electronic gaming device 100 may stream or play prerecorded multimedia data, which may be displayed on any display combination.

One or more cameras 120 and/or one or more sensors 122 may be utilized as one or more depth image sensing devices, which may be located in various locations, including but not limited to, above the base display, above second display, in one or more locations on gaming cabinet front, on a side of the gaming cabinet other than gaming cabinet front, and/or any other location.

In one embodiment, electronic gaming device 100 may not include separate one or more input devices, but instead may only utilize one or more depth image sensing devices. In another embodiment, a player may utilize one or more input devices and/or may utilize gestures that electronic gaming device 100, via one or more depth image sensing devices, recognizes in order to make inputs for a play of a game. A player may interact with electronic gaming device 100 via one or more depth image sensing devices for a plurality of various player inputs.

In one embodiment, one or more depth image sensing devices may include at least two similar devices. For example, each of the at least two similar devices may independently sense depth and/or image of a scene. In another example, such similar depth image sensing devices may then communicate information to one or more processors, which may utilize the information from each of the similar depth image sensing devices to determine the relative depth of an image from a captured scene.

In another embodiment, one or more depth image sensing devices may include at least two different devices. For example, and discussed in more detail below, one of the at least two different devices may be an active device and/or one of the at least two different devices may be a passive device. In one example, such an active device may generate a wave of measurable energy (e.g., light, radio, etc.). In another example, such a passive device may be able to detect reflected waves generated by such an active device. In another example, such an active device and such a passive device may each communicate data related to their respective activity to a processor, and such processor may translate such data in order to determine the depth and/or image of a scene occurring near electronic gaming device 100.

Electronic gaming device 100 may include at least one display device. Electronic gaming device 100 may include a base display and/or a second display. In one embodiment, base display may be the primary display for a first game. In another embodiment, second display may be the primary display for a second and/or bonus game. For example, base display may display: a reel-type video slot game; and upon a bonus game triggering condition; second display may display a bonus game; and upon a smart wild game feature triggering event; first and/or second display may display a smart wild game feature.

In one embodiment, base display and second display may display separate portions of a common image. For example, second display may display a top portion of a wheel spinning while base display may display the bottom portion of the same wheel spinning.

Electronic gaming device 100 may also include one or more speakers. In one embodiment, one or more speakers may work in a synchronized manner to provide a surround sound effect. For example, as an object is displayed moving across base display from left to right, one or more speakers may produce sound in such a manner as to create an audible sense of similar left to right movement. In another embodiment, one or more speakers may work asynchronously. In a further embodiment, a first speaker may produce sounds associated with a first symbol appearing in a play of a game, and a second speaker may produce sounds associated with a second symbol appearing in a play of the game.

Figure 2:
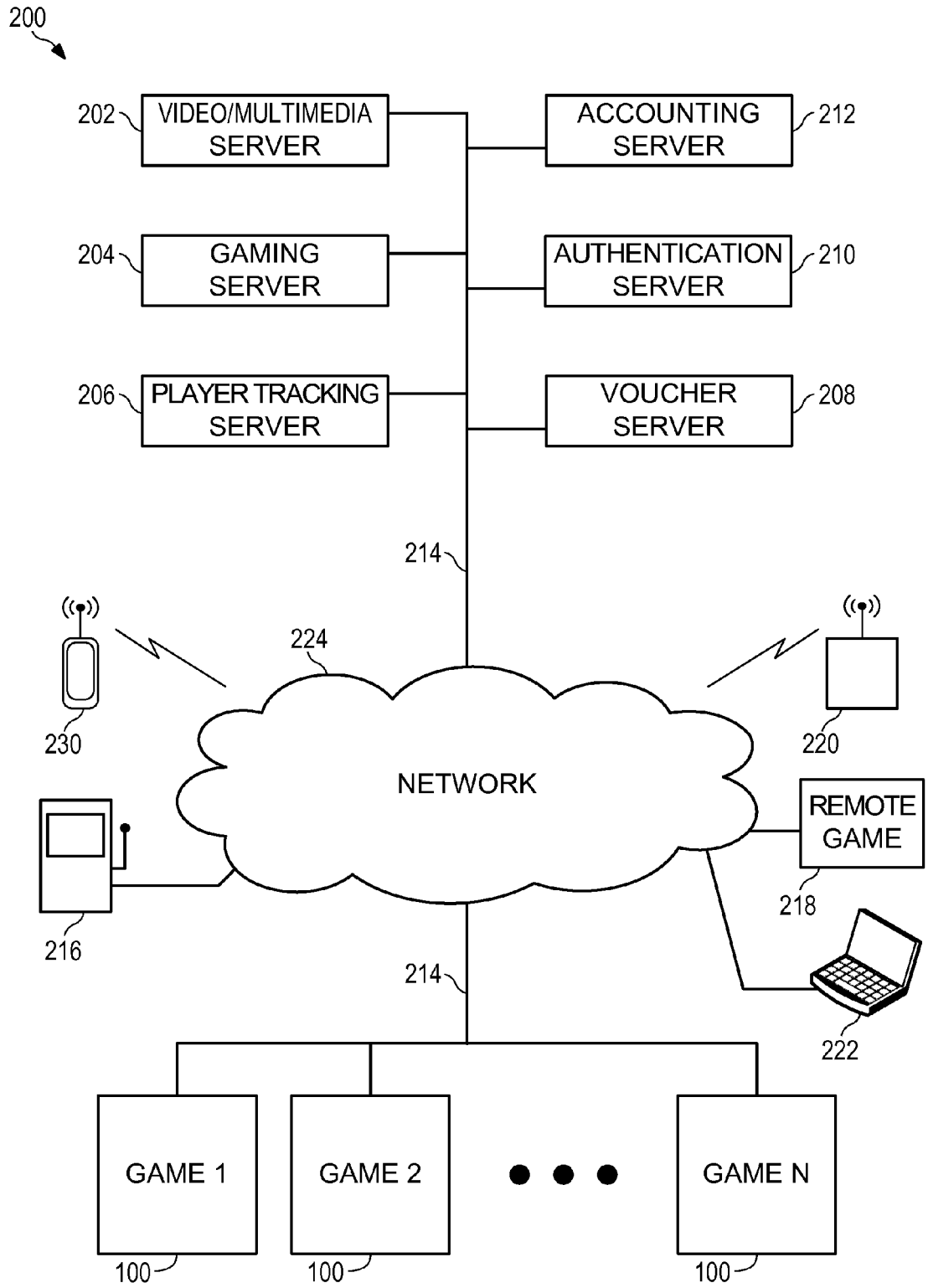
FIG. 2 is an illustration of an electronic gaming system, according to one embodiment.

In FIG. 2, an electronic gaming system 200 is shown. Electronic gaming system 200 may include a video/multimedia server 202, a gaming server 204, a player tracking server 206, a voucher server 208, an authentication server 210, and an accounting server 212.

Electronic gaming system 200 may include video/multimedia server 202, which may be coupled to network 224 via a network link 214. Network 224 may be the Internet, a private network, and/or a network cloud. One or more video streams may be received at video/multimedia server 202 from other electronic gaming devices 100. Video/multimedia server 202 may transmit one or more of these video streams to a mobile phone 230, electronic gaming device 100, a remote electronic gaming device at a different location in the same property 216, a remote electronic gaming device at a different location 218, a laptop 222, and/or any other remote electronic device 220. Video/multimedia server 202 may transmit these video streams via network link 214 and/or network 224.

For example, a remote gaming device at the same location may be utilized at a casino with multiple casino floors, a casino that allows wagering activities to take place from the hotel room, a casino that may allow wagering activities to take place from the pool area, etc. In another example, the remote devices may be at another location via a progressive link to another casino, and/or a link within a casino corporation that owns numerous casinos (e.g., MGM, Caesars, etc.).

Gaming server 204 may generate gaming outcomes. Gaming server 204 may provide electronic gaming device 100 with game play content. Gaming server 204 may provide electronic gaming device 100 with game play math and/or outcomes. Gaming server 204 may provide one or more of: a smart wild game feature functionality; a smart wild game feature evaluation functionality; a payout functionality; a base and/or bonus game play functionality; a base and/or bonus game play evaluation functionality, other game functionality, and/or any other virtual game functionality.

Player tracking server 206 may track a player's betting activity, a player's preferences (e.g., language, font, sound level, drinks, etc.). Based on data obtained by player tracking server 206, a player may be eligible for gaming rewards (e.g., free play), promotions, and/or other awards (e.g., complimentary food, drinks, lodging, concerts, etc.).

Voucher server 208 may generate a voucher, which may include data relating to gaming. Further, the voucher may include payline structure option selections. In addition, the voucher may include game play data (or similar game play data), repeat payline data, pattern data, historical payout data, column data, row data, and/or symbols that were modified.

Authentication server 210 may determine the validity of vouchers, player's identity, and/or an outcome for a gaming event.

Accounting server 212 may compile, track, and/or monitor cash flows, voucher transactions, winning vouchers, losing vouchers, and/or other transaction data. Transaction data may include the number of wagers, the size of these wagers, the date and time for these wagers, the identity of the players making these wagers, and/or the frequency of the wagers. Accounting server 212 may generate tax information relating to these wagers. Accounting server 212 may generate profit/loss reports for players' tracked outcomes.

Network connection 214 may be used for communication between dedicated servers, thin clients, thick clients, back-office accounting systems, etc.

Laptop computer 222 and/or any other electronic devices (e.g., mobile phone 230, electronic gaming device 100, etc.) may be used for downloading new gaming device applications or gaming device related firmware through remote access.

Laptop computer 222 and/or any other electronic device (e.g., mobile phone 230, electronic gaming device 100, etc.) may be used for uploading accounting information (e.g., cashable credits, non-cashable credits, coin in, coin out, bill in, voucher in, voucher out, etc.).

Network 224 may be a local area network, a casino premises network, a wide area network, a virtual private network, an enterprise private network, the Internet, or any combination thereof. Hardware components, such as network interface cards, repeaters and hubs, bridges, switches, routers, firewalls, or any combination thereof may also be part of network 224.

A statistics server may be used to maintain data relating to historical game play for one or more electronic gaming devices 100. This historical data may include winning amounts, winning data (e.g., person, sex, age, time on machine, amount of spins before winning event occurred, etc.), fastest winning event reoccurrence, longest winning event reoccurrence, average frequencies of winning events, average winning amounts, highest winning amount, lowest winning amount, locations for winning events, winning event dates, winning machines, winning game themes, and/or any other data relating to game play.

Figure 3:
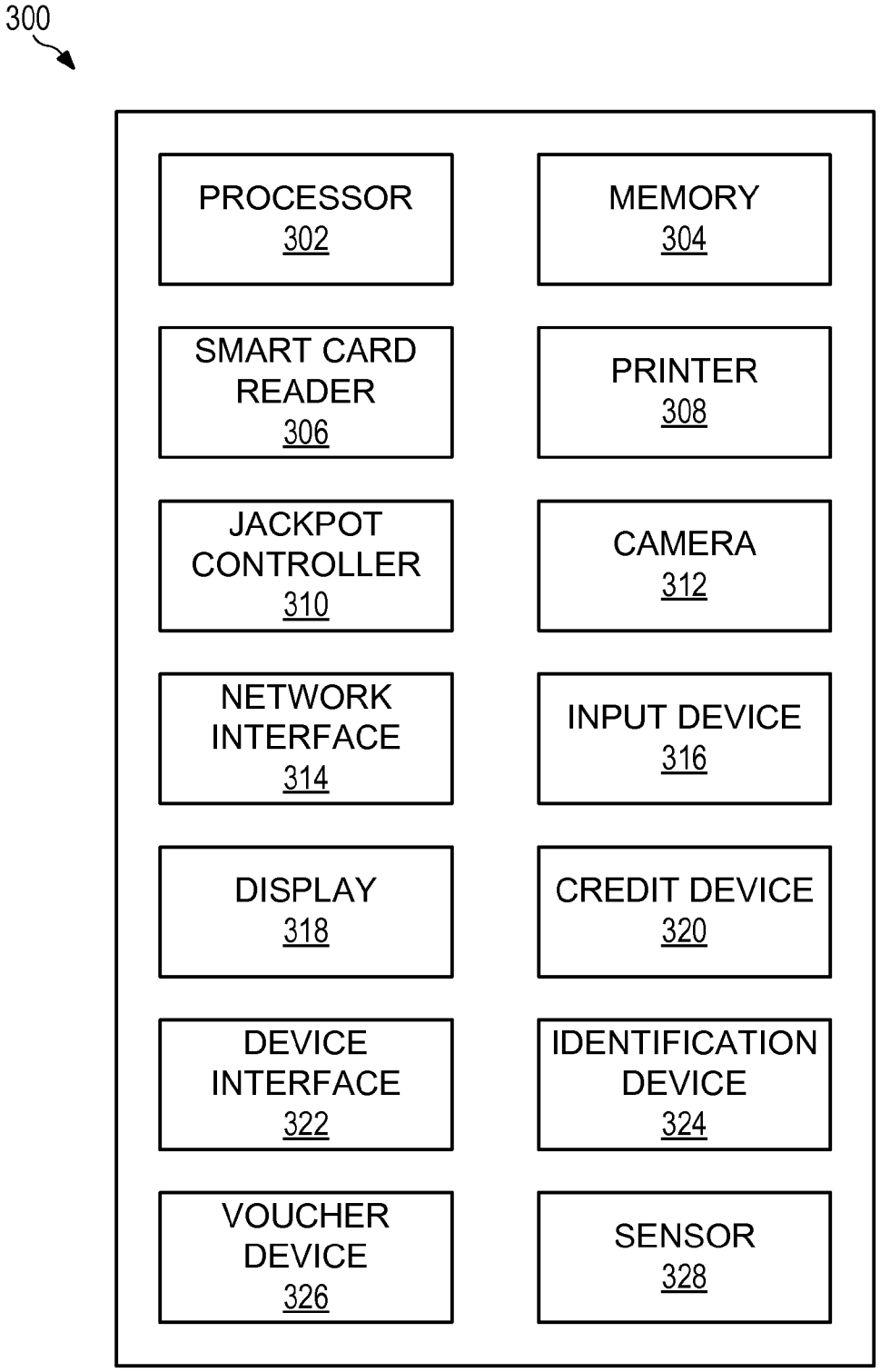
FIG. 3 is a block diagram of the electronic gaming device, according to one embodiment.

FIG. 3 shows a block diagram 300 of electronic gaming device 100. Electronic gaming device 100 may include a processor 302, a memory 304, a smart card reader 306, a printer 308, a jackpot controller 310, a camera 312, a network interface 314, an input device 316, a display 318, a credit device 320, a device interface 322, an identification device 324, and a voucher device 326.

Processor 302 may execute program instructions of memory 304 and use memory 304 for data storage. Processor 302 may also include a numeric co-processor, or a graphics processing unit (or units) for accelerated video encoding and decoding, and/or any combination thereof.

Processor 302 may include communication interfaces for communicating with electronic gaming device 100, electronic gaming system 200, and user interfaces to enable communication with all gaming elements. For example, processor 302 may interface with memory 304 to access a player's mobile device through device interface 322 to display contents onto display 318. Processor 302 may generate a voucher based on a wager confirmation, which may be received by an input device, a server, a mobile device, and/or any combination thereof. A voucher device may generate, print, transmit, or receive a voucher. Memory 304 may include communication interfaces for communicating with electronic gaming device 100, electronic gaming system 200, and user interfaces to enable communication with all gaming elements. For example, the information stored on memory 304 may be printed out onto a voucher by printer 308. Videos or pictures captured by camera 312 may be saved and stored on memory 304. Memory 304 may include a confirmation module, which may authenticate a value of a voucher and/or the validity of the voucher. Processor 302 may determine the value of the voucher based on generated voucher data and data in the confirmation module. Electronic gaming device 100 may include a player preference input device. The player preference input device may modify a game configuration. The modification may be based on data from the identification device.

Memory 304 may be non-volatile semiconductor memory, such as read-only memory ("ROM"), erasable programmable read-only memory ("EPROM"), electrically erasable programmable read-only memory ("EEPROM"), flash memory ("NVRAM"), Nano-RAM (e.g., carbon nanotube random access memory), and/or any combination thereof.

Memory 304 may also be volatile semiconductor memory such as, dynamic random access memory ("DRAM"), static random access memory ("SRAM"), and/or any combination thereof.

Memory 304 may also be a data storage device, such as a hard disk drive, an optical disk drive such as, CD, DVD, Blu-ray, a solid state drive, a memory stick, a CompactFlash card, a USB flash drive, a Multi-media Card, an xD-Picture Card, and/or any combination thereof.

Memory 304 may be used to store read-only program instructions for execution by processor 302, for the read-write storage for global variables and static variables, read-write storage for uninitialized data, read-write storage for dynamically allocated memory, for the read-write storage of the data structure known as "the stack," and/or any combination thereof.

Memory 304 may be used to store the read-only paytable information for which symbol combinations on a given payline that result in a win (e.g., payout) which are established for games of chance, such as slot games and video poker.

Memory 304 may be used to store accounting information (e.g., cashable electronic promotion in, non-cashable electronic promotion out, coin in, coin out, bill in, voucher in, voucher out, electronic funds transfer in, etc.).

Memory 304 may be used to record error conditions on an electronic gaming device 100, such as door open, coin jam, ticket print failure, ticket (e.g., paper) jam, program error, reel tilt, etc., and/or any combination thereof.

Memory 304 may also be used to record the complete history for the most recent game played, plus some number of prior games as may be determined by the regulating authority.

Smart card reader 306 may allow electronic gaming device 100 to access and read information provided by the player or technician, which may be used for setting the player preferences and/or providing maintenance information. For example, smart card reader 306 may provide an interface between a smart card (inserted by the player) and identification device 324 to verify the identity of a player.

Printer 308 may be used for printing slot machine payout receipts, slot machine wagering vouchers, non-gaming coupons, slot machine coupons (e.g., a wagering instrument with a fixed waging value that can only be used for non-cashable credits), drink tokens, comps, and/or any combination thereof.

Electronic gaming device 100 may include a jackpot controller 310, which may allow electronic gaming device 100 to interface with other electronic gaming devices either directly or through electronic gaming system 200 to accumulate a shared jackpot.

Camera 312 may allow electronic gaming device 100 to take images of a player or a player's surroundings. For example, when a player sits down at the machine his or her picture may be taken to include his or her image into the game play. A picture of a player may be an actual image as taken by camera 312. A picture of a player may be a computerized caricature of the image taken by camera 312. The image obtained by camera 312 may be used in connection with identification device 324 using facial recognition. Camera 312 may allow electronic gaming device 100 to record video. The video may be stored on memory 304 or stored remotely via electronic gaming system 200. Videos obtained by camera 312 may then be used as part of game play, or may be used for security purposes. For example, a camera located on electronic gaming device 100 may capture videos of a potential illegal activity (e.g., tampering with the machine, crime in the vicinity, underage players, etc.).

Network interface 314 may allow electronic gaming device 100 to communicate with video/multimedia server 202, gaming server 204, player tracking server 206, voucher server 208, authentication server 210, and/or accounting server 212.

Input device 316 may be mechanical buttons, electronic buttons, a touch screen, and/or any combination thereof. Input device 316 may be utilized to make a wager, to select one or more game elements, to select one or more gaming options, to make an offer to buy or sell a voucher, to determine a voucher's worth, to cash in a voucher, to modify electronic gaming device 100 (e.g., change sound level, configuration, font, language, etc.), to modify one of one or more audio devices, one or more display devices, one or more electrical wires, one or more springs, one or more motors, one or more adjustable devices, and/or one or more sensors, to select a movie or music, to select live video streams (e.g., sporting event 1, sporting event 2, sporting event 3), to request services (e.g., drinks, manager, etc.), and/or any combination thereof.

Display 318 may show video streams from one or more content sources. Display 318 may encompass first display screen 102, second display screen 104, third display screen 106, side display screen 108, and/or another screen used for displaying video content.

Credit device 320 may be utilized to collect monies and distribute monies (e.g., cash, vouchers, etc.). Credit device 320 may interface with processor 302 to allow game play to take place. Processor 302 may determine any payouts, display configurations, animation, and/or any other functions associated with game play. Credit device 320 may interface with display 318 to display the amount of available credits for the player to use for wagering purposes. Credit device 320 may interface via device interface 322 with a mobile device to electronically transmit money and/or credits. Credit device 320 may interface with a player's pre-established account, which may be stored on electronic gaming system 200, to electronically transmit money and/or credit. For example, a player may have a credit card or other mag-stripe card on file with the location for which money and/or credits can be directly applied when the player is done. Credit device 320 may interface with a player's card to exchange player points.

Electronic gaming device 100 may include a device interface 322 that a user may employ with his or her mobile device (e.g., smart phone) to receive information from and/or transmit information to electronic gaming device 100 (e.g., watch a movie, listen to music, obtain verbal betting options, verify identification, transmit credits, etc.).

Identification device 324 may be utilized to allow electronic gaming device 100 to determine an identity of a player. Based on information obtained by identification device 324, electronic gaming device 100 may be reconfigured. For example, the language, sound level, music, placement of video streams, placement of images, placement of gaming options, and/or the tables utilized may be modified based on player preference data.

For example, a player may have selected a specific baseball team (e.g., Atlanta Braves) under the sporting event preferences, the electronic gaming device 100 will then automatically (or via player input) display the current baseball game (e.g., Atlanta Braves vs. Philadelphia Phillies) onto side display screen 108 and/or an alternate display screen as set in the player's options.

A voucher device 326 may generate, print, transmit, or receive a voucher. The voucher may represent a wagering option, a wagering structure, a wagering timeline, a value of wager, a payout potential, a payout, and/or any other wagering data. A voucher may represent an award, which may be used at other locations inside of the gaming establishment. For example, the voucher may be a coupon for the local buffet or a concert ticket.

Figure 4:
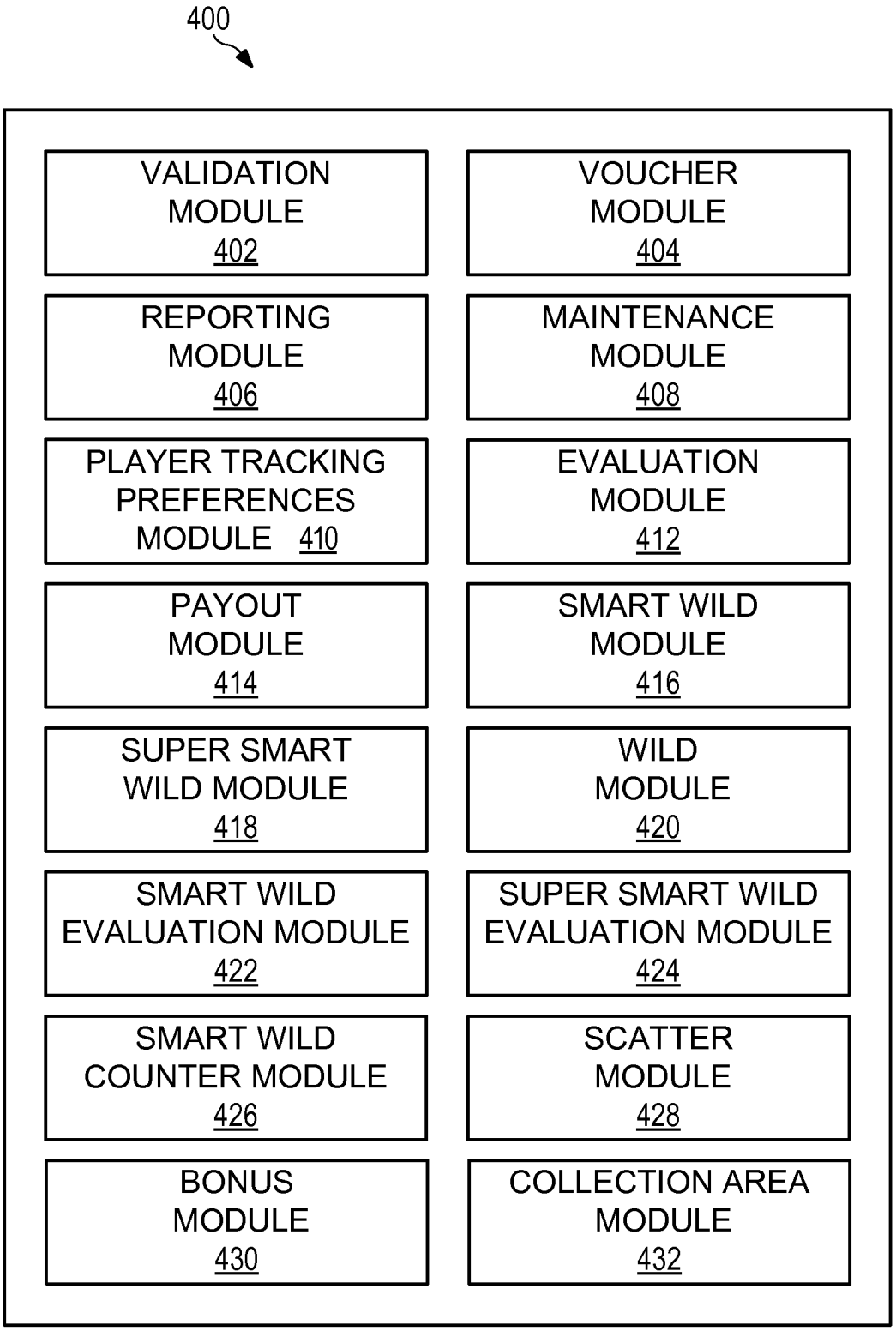
FIG. 4 is another block diagram of the electronic gaming device, according to one embodiment.

FIG. 4 shows a block diagram of memory 304, which includes various modules. Memory 304 may include a validation module 402, a voucher module 404, a reporting module 406, a maintenance module 408, a player tracking preferences module 410, an animation module, a game evaluation module 412, a payout module 414, a sensor module, a scene module, a sensor and scene evaluation module, a sensor and scene output module, a reference models module, an audio module, an audio device adjustment module, a display device adjustment module, a smart wild module 416, a super smart wild module 418, a wild module 420, a smart wild evaluation module 422, a super smart wild evaluation module 424, a smart wild counter module 426, a scatter module 428, a bonus module 430, and a collection area module 432.

Validation module 402 may utilize data received from voucher device 326 to confirm the validity of the voucher.

Voucher module 404 may store data relating to generated vouchers, redeemed vouchers, bought vouchers, and/or sold vouchers.

Reporting module 406 may generate reports related to a performance of electronic gaming device 100, electronic gaming system 200, video streams, gaming objects, credit device 114, and/or identification device 118.

Maintenance module 408 may track any maintenance that is implemented on electronic gaming device 100 and/or electronic gaming system 200. Maintenance module 408 may schedule preventative maintenance and/or request a service call based on a device error.

Player tracking preferences module 410 may compile and track data associated with a player's preferences.

Animation module may generate, compile, transmit, and/or store one or more animations and/or presentations based on one or more scene data, one or more scenes, one or more reference models, one or more game play data, one or more player profiles, and/or any combination thereof.

Game evaluation module 412 may evaluate one or more outcomes for one or more events relating to game play.

Payout module 414 may determine one or more payouts which may relate to one or more inputs received from the player, electronic gaming device 100, and/or electronic gaming system 200.

Sensor module may generate, compile, transmit, and/or store any data relating to one or more scene data, one or more scene, and/or any other sensor data. This data may include one or more gestures (e.g., body movement made by one or more players).

Scene module may generate, compile, transmit, and/or store on one or more scene data, one or more scenes, one or more reference models, one or more game play data, one or more player profiles, and/or any combination thereof.

Sensor and scene evaluation module may evaluate any data stored on, transmitted to, and/or transmitted from sensor module and scene module. Sensor and scene evaluation module may obtain data including one or more gestures (e.g., body movement made by one or more players) from sensor module and compare this data to one or more body reference models, body part reference models, device reference models, gaming device reference models, floor plan reference models, and/or any other reference models from reference models module to determine one or more actions.

Sensor and scene output module may evaluate the combined output of sensor module and scene module.

Reference models module may generate, compile, transmit, and/or store one or more body reference models, body part reference models, device reference models, gaming device reference models, floor plan reference models, and/or any other reference models which can be utilized by any of the other modules.

Audio module may generate, compile, transmit, and/or store one or more audio structures, sound wave configurations, and/or any other audio data.

Audio device adjustment module may adjust one or more audio devices. These devices may be adjusted physically (e.g., moved) and/or by changing one or more device characteristics.

Display device adjustment module may adjust one or more display devices. These devices may be adjusted physically (e.g., moved) and/or by changing one or more device characteristics.

Smart wild module 416 may generate a smart wild game, evaluate the results of the smart wild game, trigger smart wild game presentations, generate smart wild game payouts, and/or display any data relating to the smart wild game. Further, smart wild module 416 may determine one or more outcomes of one or more interactions (e.g., collisions of one or more symbols).

Super smart wild module 418 may generate a super smart wild game, evaluate the results of the super smart wild game, trigger super smart wild game presentations, generate super smart wild game payouts, and/or display any data relating to the super smart wild game. Further, super smart wild module 418 may determine one or more outcomes of one or more interactions (e.g., collisions of one or more symbols).

Wild module 420 may generate a wild game, evaluate the results of the wild game, trigger wild game presentations, generate wild game payouts, and/or display any data relating to the wild game. Further, wild module 420 may determine one or more outcomes of one or more interactions (e.g., collisions of one or more symbols).

Smart wild evaluation module 422 may evaluate one or more outcomes for one or more events relating to smart wild game play. Further, smart wild evaluation module 422 may determine one or more outcomes of one or more interactions (e.g., collisions of one or more symbols).

Super smart wild evaluation module 424 may evaluate one or more outcomes for one or more events relating to super smart wild game play. Further, super smart wild evaluation module 424 may determine one or more outcomes of one or more interactions (e.g., collisions of one or more symbols).

Smart wild counter module 426 may generate, transmit, compile, and/or store one or more data points relating to the collection of one or more collectable symbols (e.g., wild, smart wild, super smart wilds, etc.). Further, wild evaluation module 426 may determine one or more outcomes of one or more interactions (e.g., collisions of one or more symbols).

Scatter module 428 may generate a scatter game, evaluate the results of the scatter game, trigger scatter game presentations, generate scatter game payouts, and/or display any data relating to the scatter game.

Bonus module 430 may generate a bonus game, evaluate the results of the bonus game, trigger bonus game presentations, generate bonus game payouts, and/or display any data relating to the bonus game.

Collection area module 432 may work with smart wild counter module 426 to transfer one or more collected symbols to one or more collection locations and/or one or more active areas (e.g., symbol areas on one or more reels).

Installation verification module may verify the installation parameters on one or more of audio devices, one or more display devices, one or more electrical wires, one or more springs, one or more motors, one or more adjustable devices, and/or one or more sensors to one or more reference data points. Installation verification module may generate a warning when the data points are outside of a specific parameter range. One or more warnings may be transmitted to an external device, a server, a mobile device, and/or a warning display on electronic gaming device 100 based on the verification data.

Locking module may control the locking mechanism for one or more audio devices, one or more display devices, one or more electrical wires, one or more springs, one or more motors, one or more adjustable devices, and/or one or more sensors. Locking module may control any locking mechanism for electronic gaming device 100. Locking module may generate a warning when a locking data point is outside of a specific parameter. These warnings may be transmitted to an external device, a server, a mobile device, and/or a warning display on electronic gaming device 100.

It should be noted that one or more modules may be combined into one module. Further, there may be one evaluation module where the determined payout does not depend on whether there were any wild symbols, scatter symbols, platform based game play, and/or any other specific symbols. Further, any module, device, and/or logic function in electronic gaming device 100 may be present in electronic gaming system 200. In addition, any module, device, and/or logic function in electronic gaming system 200 may be present in electronic gaming device 100.

Figure 5A:
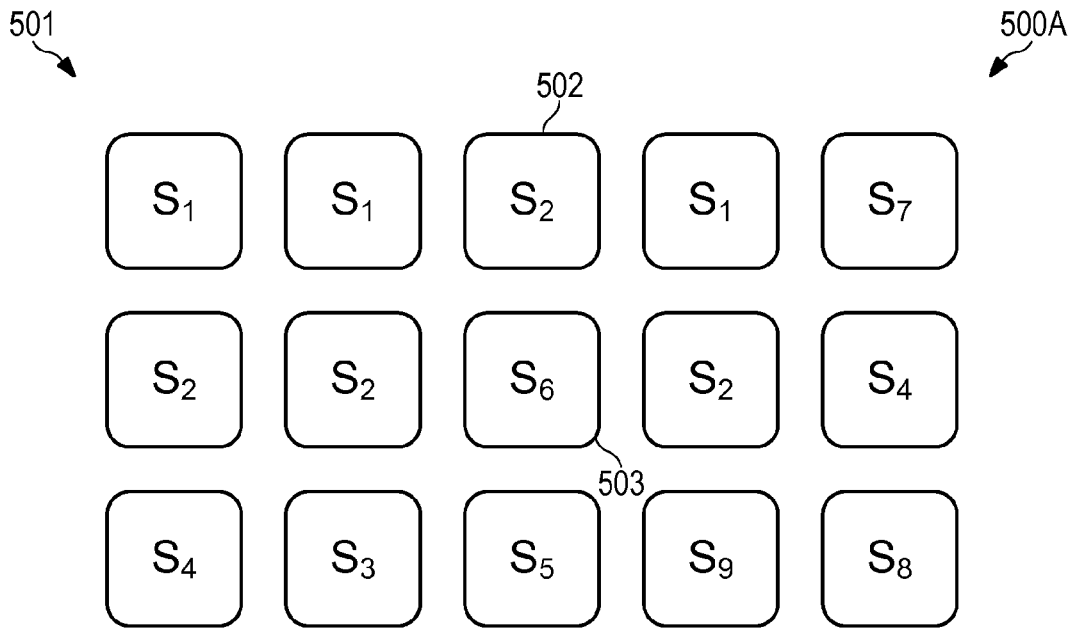
FIG. 5A is an illustration of game play on a gaming device, according to one embodiment.

In FIG. 5A, an illustration of game play on a gaming device is shown, according to one embodiment. A first display image 500A shows a plurality of reels 501 with various symbols (e.g., S1, S2, S3, S9) located on a plurality of symbol areas. In this example, no winning combination has been achieved because the gaming device requires four of the same symbols on a payline. In this case, only three symbols (e.g., S1) were present in the first row and three symbols (e.g., S2) were present in the second row. If a first blocker symbol 502 had been a wild and/or a S1, then a winning combination would have been achieved. If a second blocker symbol 503 had been a wild and/or a S2, then a winning combination would have been achieved. In these examples, a winning combination with the S1 symbols would be move valuable then a winning combination with the S2 symbols. In other words, the S1 symbols are more valuable than the S2 symbols.

Figure 5B:
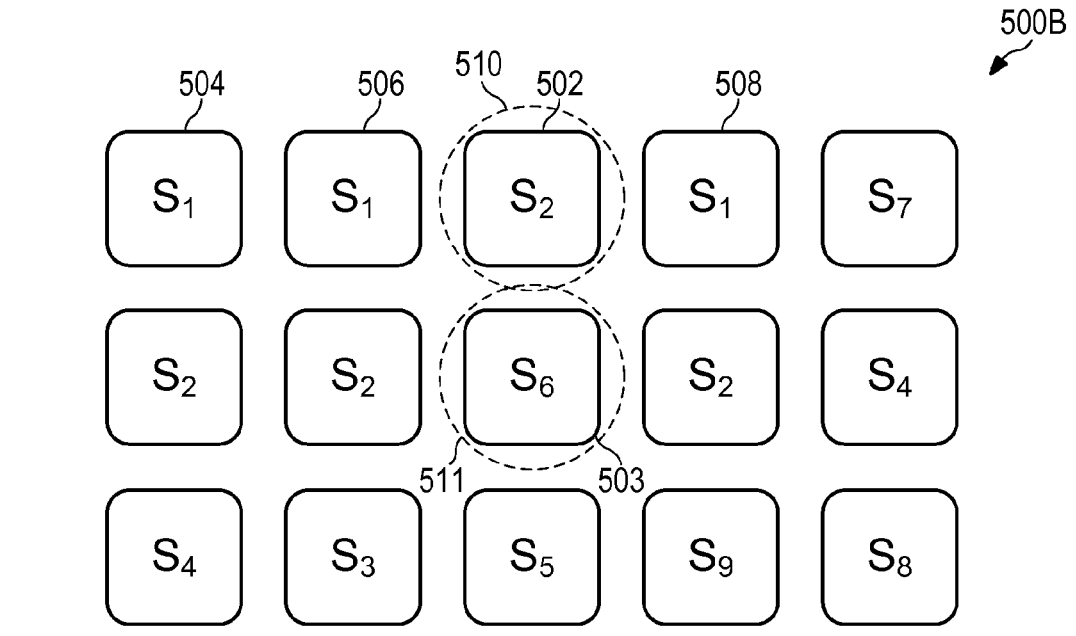
FIG. 5B is another illustration of game play on a gaming device, according to one embodiment.
Figure 5C:
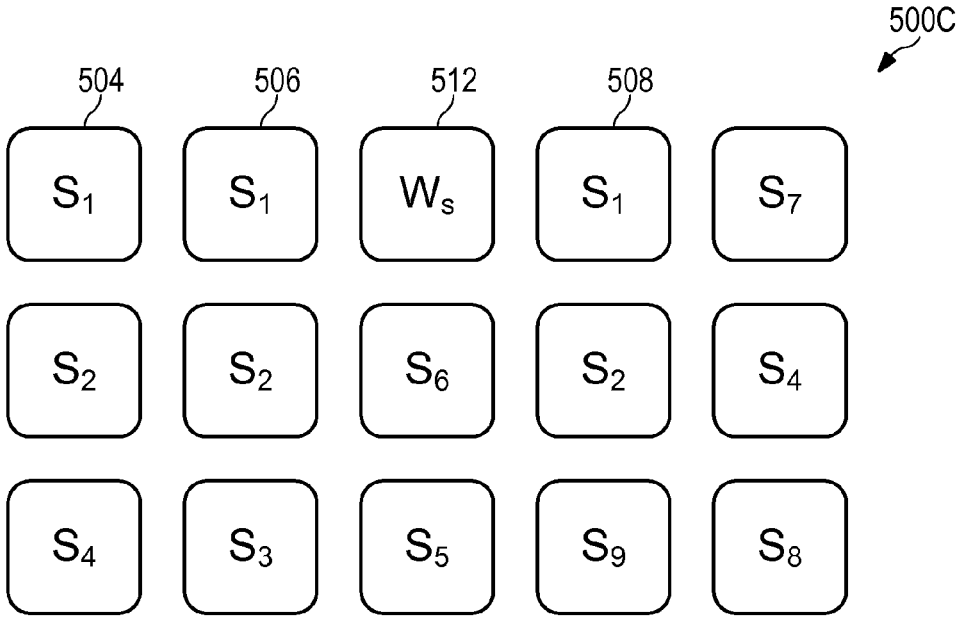
FIG. 5C is another illustration of game play on a gaming device, according to one embodiment.

In one example, first blocker symbol 502 may be replaced with a smart wild 510 or second blocker symbol 503 may be replaced with a smart wild 511 (see FIG. 5B). In this example, a smart wild symbol 512 may be placed at first blocker symbol 502 to achieve a first winning combination (e.g., four S1 symbols) in the first row because the four S1 symbols activate a higher payout than a second winning combination (e.g., four S2 symbols) in the second row. Smart wild symbol 512 via one or more processors was selected to be placed in the optimal position (e.g., the position to achieve the first winning combination versus the second winning combination) where one or more payouts are the highest (see FIG. 5C).

Figure 6A:
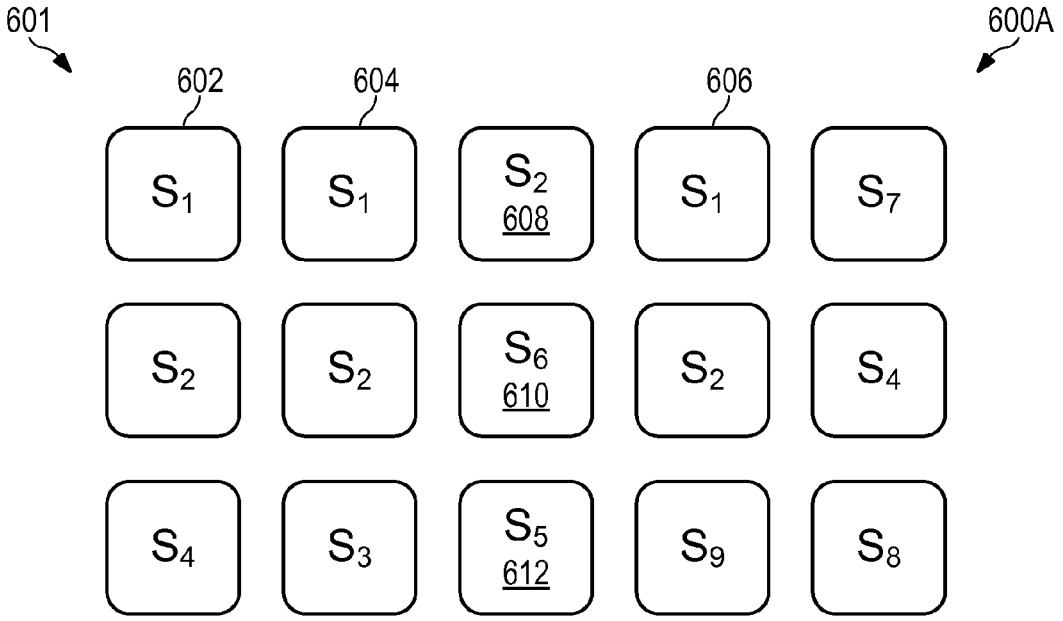
FIG. 6A is another illustration of game play on a gaming device, according to one embodiment.

In FIG. 6A, another illustration of game play on a gaming device 600A is shown, according to one embodiment. A first image 601 includes a plurality of reels with various symbols (e.g., S1, S2, S3, S9) located on a plurality of symbol areas. In this example, no winning combination has been achieved because the gaming device requires four of the same symbols on a payline. In this case, only three symbols (e.g., S1) were present in the first row and three symbols (e.g., S2) were present in the second row. If a first blocker symbol 502 had been a wild and/or a S1, then a winning combination would have been achieved. If a second blocker symbol 503 had been a wild and/or a S2, then a winning combination would have been achieved (see FIGS. 5A-5C). In these examples, a winning combination with the S1 symbols would be move valuable then a winning combination with the S2 symbols. In other words, the S1 symbols are more valuable than the S2 symbols.

Figure 6B:
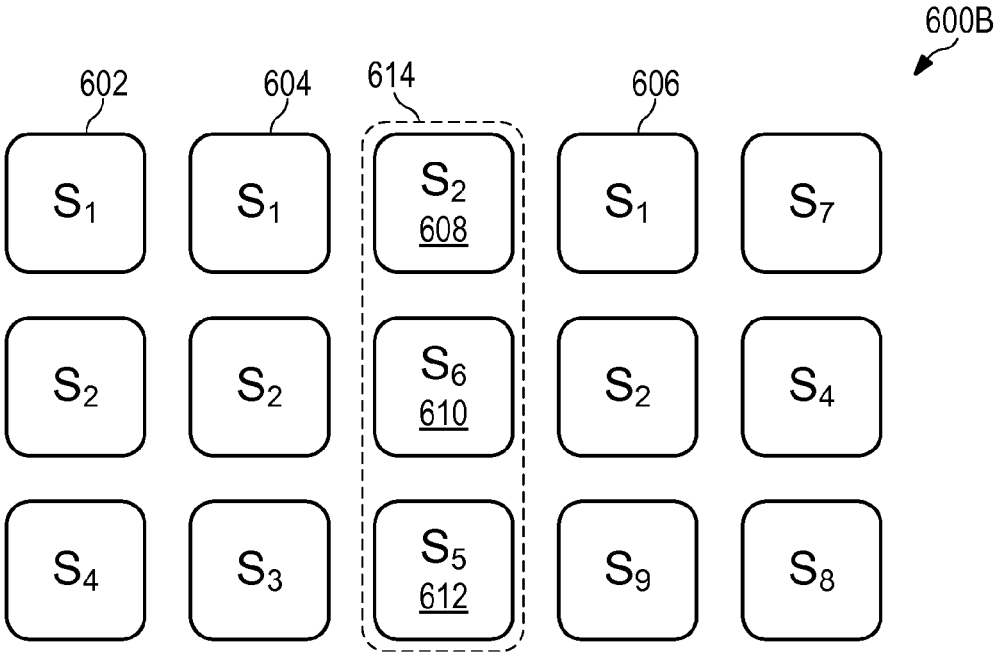
FIG. 6B is another illustration of game play on a gaming device, according to one embodiment.

In one example shown in FIG. 6B, a hot zone 614 may be formed which includes a first symbol area 608, a second symbol area 610, and a third symbol area 612. Hot zone 614 may be any size (e.g., 1 symbol area to Nth symbol areas) and may form any shape (e.g., a horizontal line, a vertical line, a diagonal line, a cross, a T, an S, a C, an L, a V, any other letter, a circle, a rectangle, any irregular shape, and/or any other shape). In various example, hot zone 614 may be all wild symbols (and/or any number of wild symbols), all smart wild symbols (any/or any number of smart wild symbols), any other symbols, and/or any combination thereof.

Figure 6C:
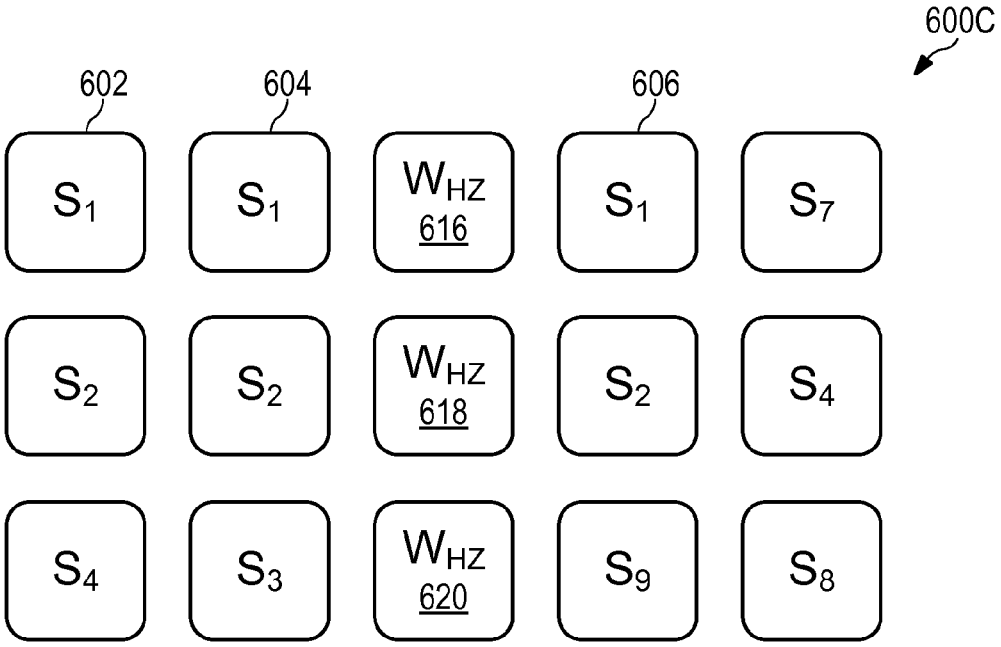
FIG. 6C is another illustration of game play on a gaming device, according to one embodiment.

In FIG. 6C, another illustration of game play on a gaming device 600C is shown, according to one embodiment. In this example, hot zone 614 has transformed first symbol area 608, second symbol area 610, and third symbol area 612 into a first hot zone wild 616, a second hot zone wild 618, and a third hot zone wild 620. In this example, two winning combinations were achieved (a first winning combination (e.g., four S1 symbols) in the first row and a second winning combination (e.g., four S2 symbols) in the second row). In this example, first hot zone wild 616 was utilized to generate the first winning combination (e.g., four S1 symbols) and second hot zone wild 618 was utilized to generate the second winning combination (e.g., four S2 symbols). In this example, third hot zone wild 620 did not generate any winning combinations.

Figure 7A:
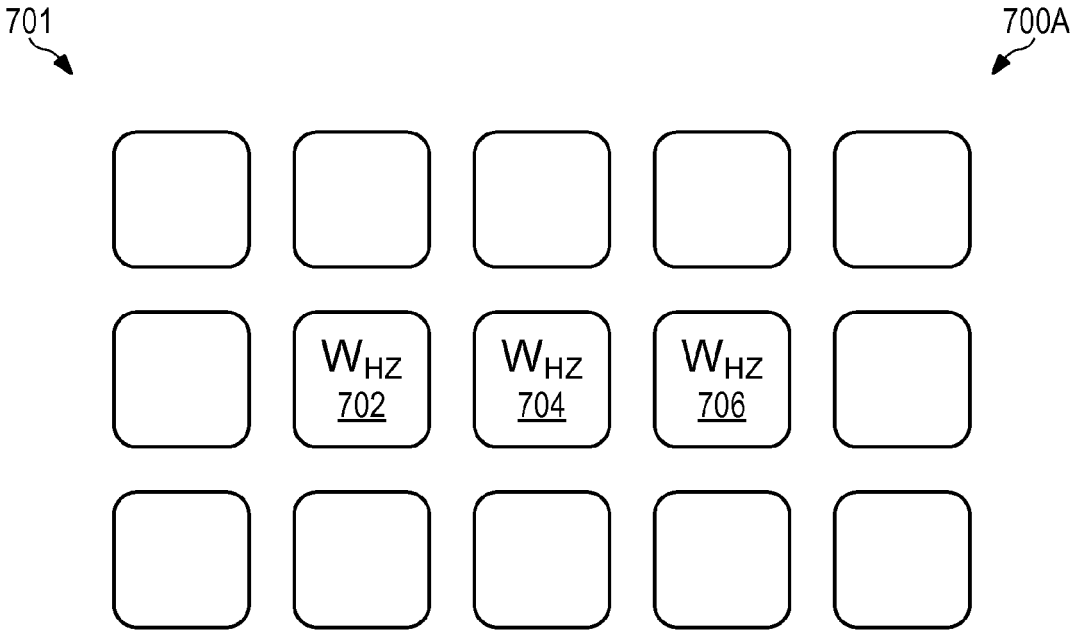
FIG. 7A is another illustration of game play on a gaming device, according to one embodiment.
Figure 7B:
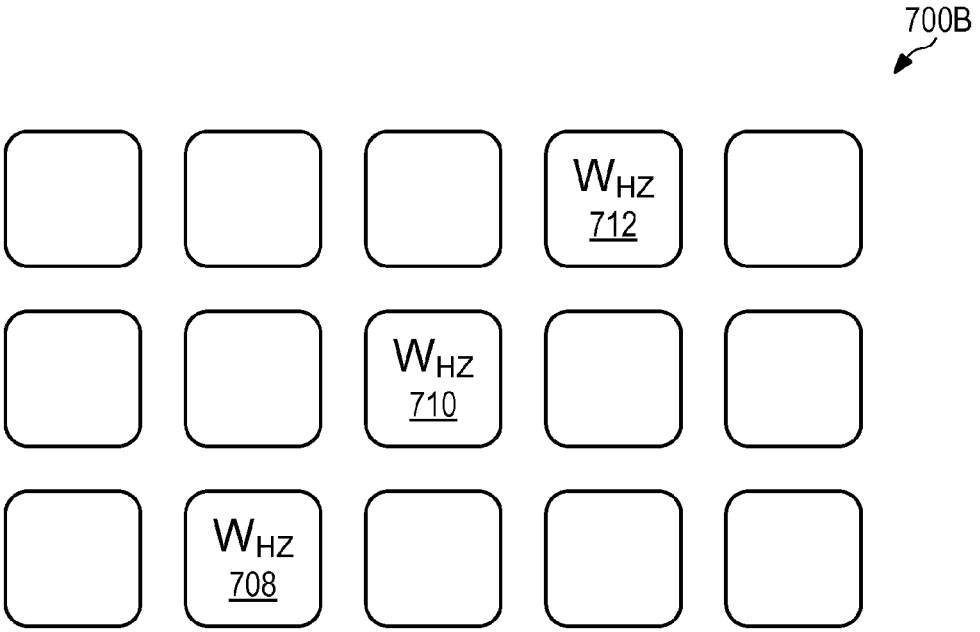
FIG. 7B is another illustration of game play on a gaming device, according to one embodiment.

As stated above, hot zone 614 may be any size (e.g., 1 symbol area to Nth symbol areas) and may form any shape (e.g., a horizontal line, a vertical line, a diagonal line, a cross, a T, an S, a C, an L, a V, any other letter, a circle, a rectangle, any irregular shape, and/or any other shape). For example as shown via a horizontal image 700A in FIG. 7A, hot zone 614 may be a horizontal line including three spatial units (e.g., three symbol areas—reference numbers 702, 704, and 706). In another example as shown via a diagonal image 700B in FIG. 7B, hot zone 614 may be a diagonal line including three spatial units (e.g., three symbol areas—reference numbers 708, 710, and 712).

Figure 7C:
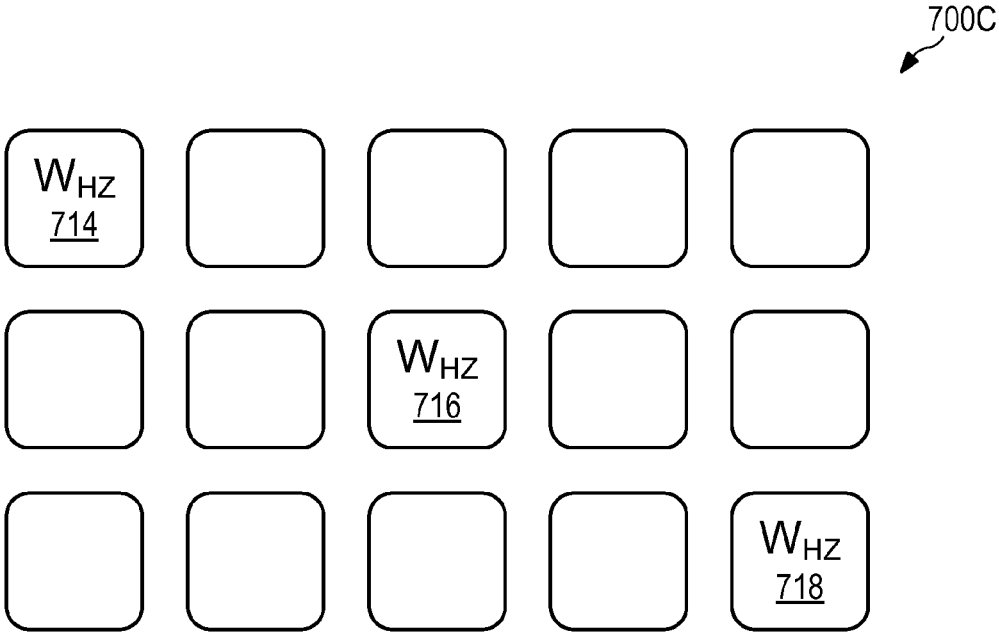
FIG. 7C is another illustration of game play on a gaming device, according to one embodiment.

In FIG. 7C, another illustration of game play on a gaming device 700C is shown, according to one embodiment. In this example, hot zone 614 forms a non-contiguous spatial configuration (e.g., three non-contiguous symbol areas—reference numbers 714, 716, and 718). Hot zone 614 may form a non-contiguous area. In this example, a first non-contiguous hot zone wild 714, a second non-contiguous hot zone wild 716, and a third non-contiguous hot zone wild form hot zone 614. It should be noted that any number (e.g., 1 to N) of non-contiguous hot zone wilds may be utilized.

Figure 7D:
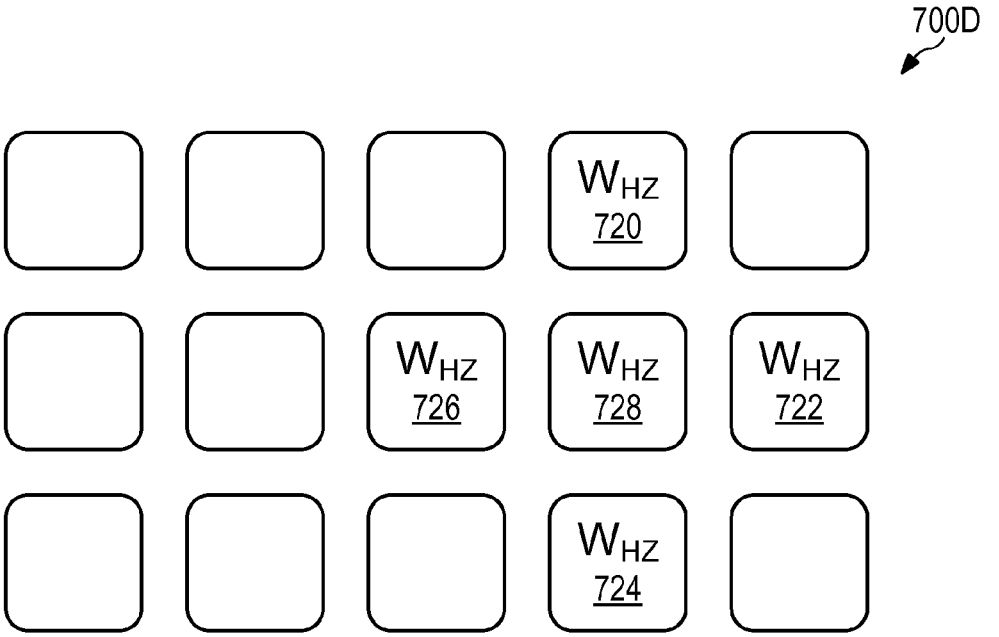
FIG. 7D is another illustration of game play on a gaming device, according to one embodiment.
Figure 7E:
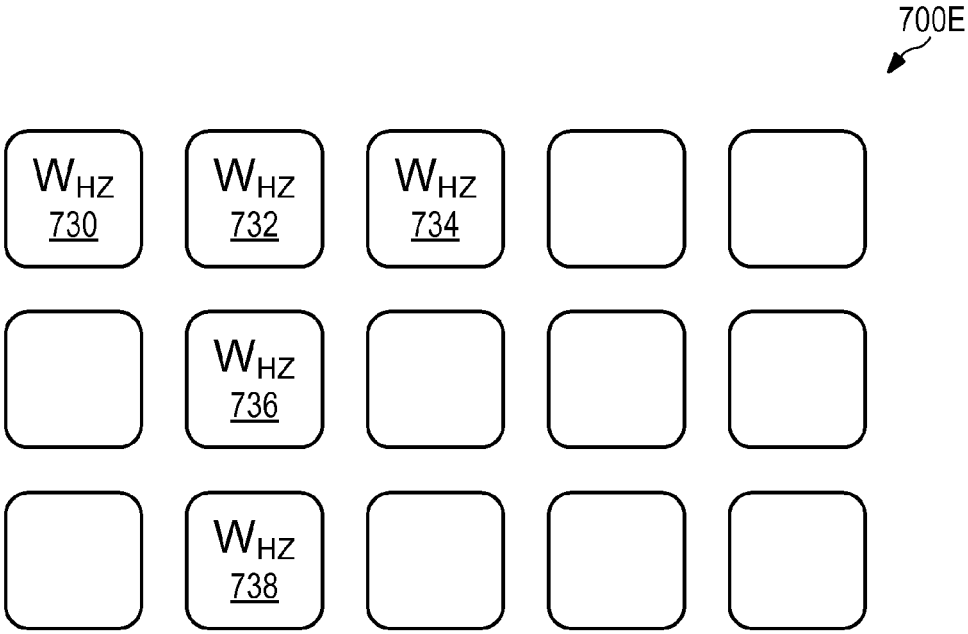
FIG. 7E is another illustration of game play on a gaming device, according to one embodiment.
Figure 7F:
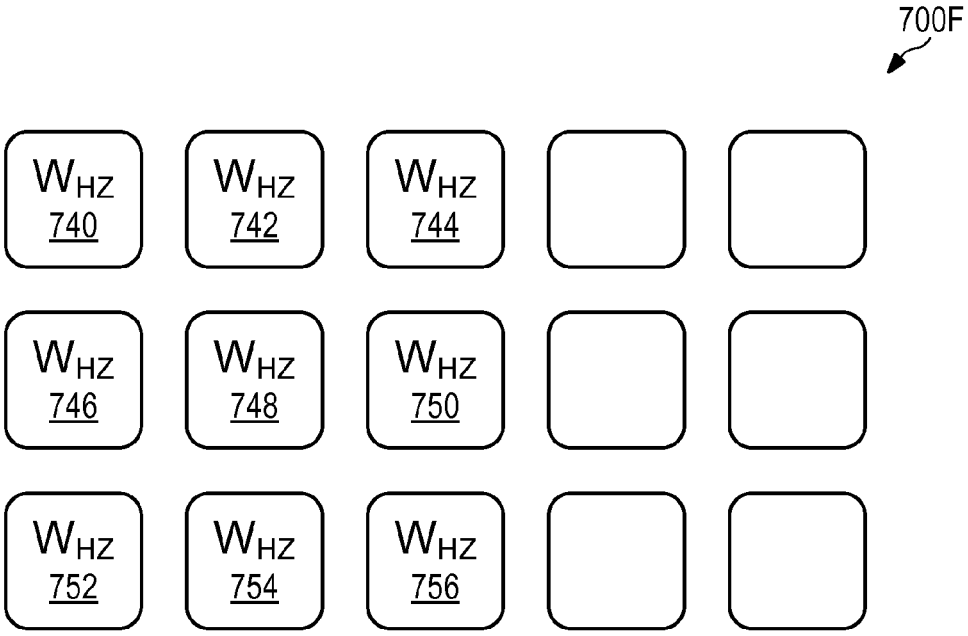
FIG. 7F is another illustration of game play on a gaming device, according to one embodiment.

In another example shown via a cross image 700D in FIG. 7D, hot zone 614 may be a cross image including five spatial units (e.g., five symbol areas—reference numbers 720, 722, 724, 726, and 728). In another example shown via a T image 700E in FIG. 7E, hot zone 614 may be a T image including five spatial units (e.g., five symbol areas—reference numbers 730, 732, 734, 736, and 738).

In another example shown via a block image 700F in FIG. F, hot zone 614 may be a block image (and/or multiple rows and/or multiple columns) including nine spatial units (e.g., nine symbol areas—reference numbers 740, 742, 744, 746, 748, 750, 752, 754, and 756). It should be noted that any number (e.g., 1 to N) hot zone wilds may be utilized for the block configuration and/or any other configuration.

Figure 8A:
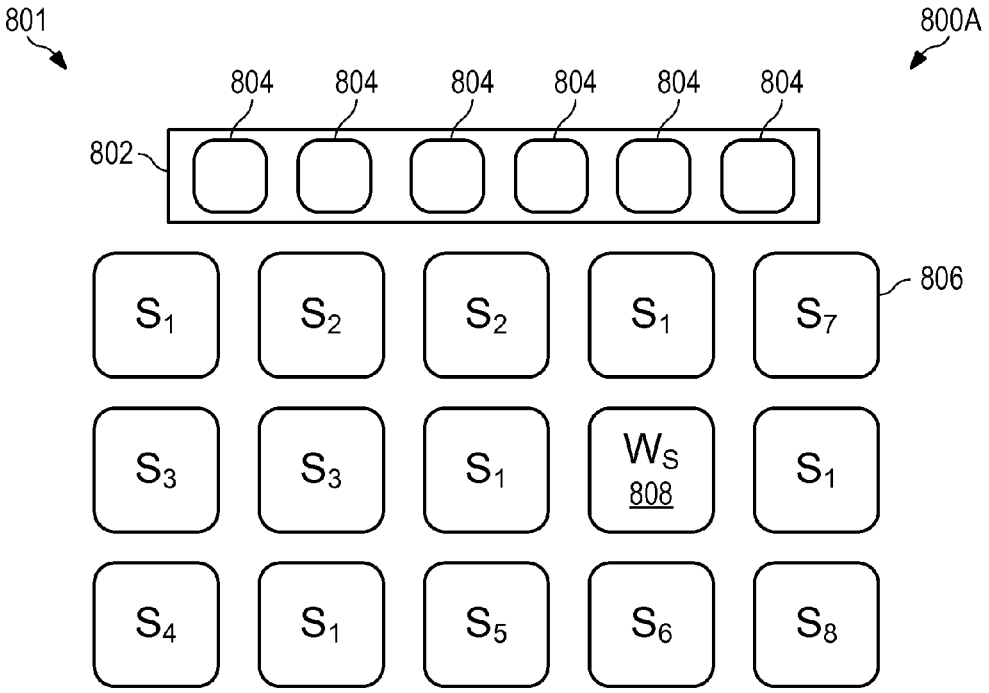
FIG. 8A is another illustration of game play on a gaming device, according to one embodiment.

In FIG. 8A, another illustration of game play on a gaming device 800A is shown, according to one embodiment. A first display image 801 may include a first collection area 802, a plurality of symbol areas 806, and a plurality of symbols (e.g., S1, S2, S3, Wild Symbol, Smart Wild (e.g., Ws), S4, SN). Collection area 802 may include a plurality of collection area locations 804. Plurality of collection area locations 804 may be any number from 1 to N. First display image 801 shows that a first smart wild 808 has been generated and displayed in one of the plurality of symbol areas 806 (e.g., the location is row two at column four).

Figure 8B:
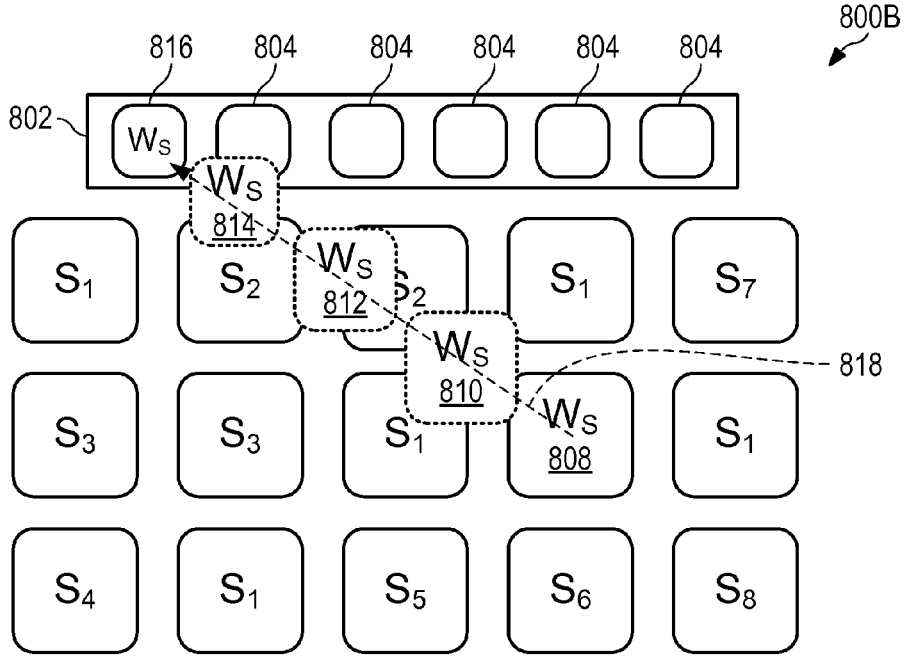
FIG. 8B is another illustration of game play on a gaming device, according to one embodiment.

In one example, based on first smart wild 808 being generated on one of the plurality of symbol areas 806, first smart wild 808 is transferred to a first collection location 816 within collection area 802. In one embodiment, first smart wild's 808 movement is shown via animation to move along a first movement path 818. First movement path 818 may include one or more images (e.g., a first movement image for first smart wild 810, a second movement image for first smart wild 812, a third movement image for first smart wild 814, and/or a Nth movement image for first smart wild) (see FIG. 8B).

Figure 8C:
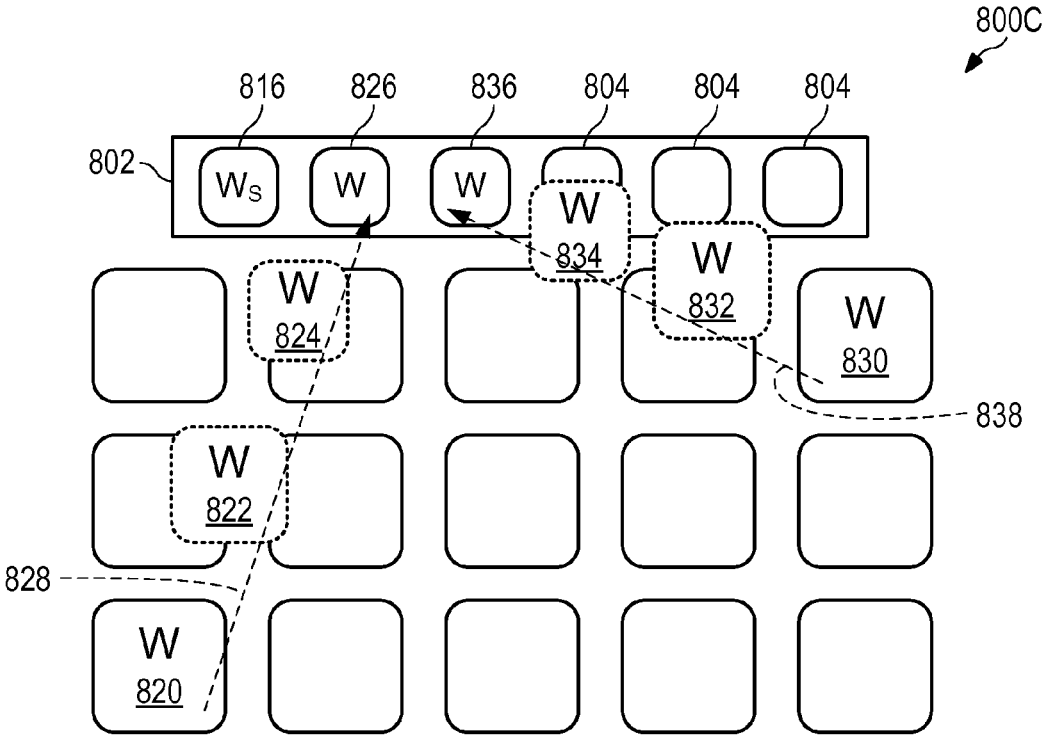
FIG. 8C is another illustration of game play on a gaming device, according to one embodiment.

In FIG. 8C, another illustration of game play on a gaming device 800C is shown, according to one embodiment. In this example, a first wild 820 and a second wild 830 are generated and displayed on two of the plurality of symbols areas 806 (e.g., row3/col1 and row1/col5 respectively). First wild 820 is transferred to a second collection location 826 within collection area 802. In one embodiment, first wild 820 movement is shown via animation to move along a second movement path 828. Second movement path 828 may include one or more images (e.g., a first movement image for first wild 822, a second movement image for first wild 812, a third movement image for first wild, and/or a Nth movement image for first wild). Second wild 830 is transferred to a third collection location 836 within collection area 802. In one embodiment, second wild 830 movement is shown via animation to move along a third movement path 838. Third movement path 838 may include one or more images (e.g., a first movement image for second wild 832, a second movement image for second wild 834, a third movement image for second wild, and/or a Nth movement image for second wild).

Figure 8D:
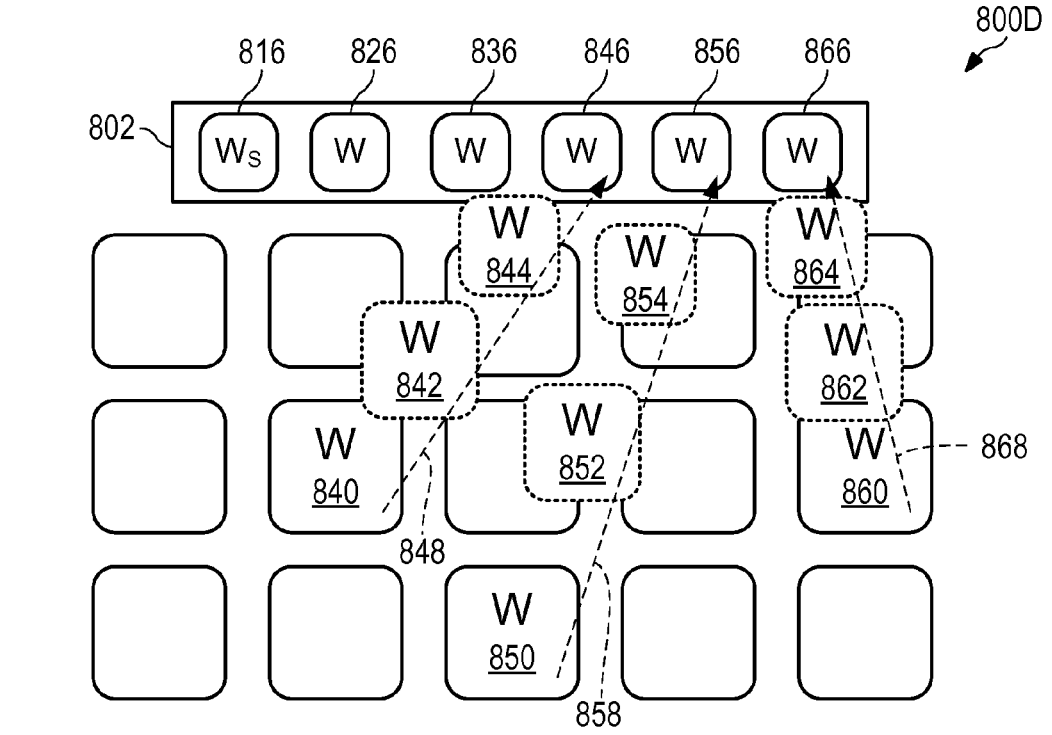
FIG. 8D is another illustration of game play on a gaming device, according to one embodiment.

In FIG. 8D, another illustration of game play on a gaming device 800D is shown, according to one embodiment. In this example, a third wild 840, a fourth wild 850, and a fifth wild 860 are generated and displayed on three of the plurality of symbols areas 806 (e.g., row2/col2, row3/col3, and row2/col5, respectively). Third wild 840 is transferred to a fourth collection location 846 within collection area 802. In one embodiment, third wild 840 movement is shown via animation to move along a fourth movement path 848. Fourth movement path 848 may include one or more images (e.g., a first movement image for third wild 842, a second movement image for third wild 844, a third movement image for third wild, and/or a Nth movement image for third wild). Fourth wild 850 is transferred to a fifth collection location 856 within collection area 802. In one embodiment, fourth wild 850 movement is shown via animation to move along a fifth movement path 858. Fifth movement path 858 may include one or more images (e.g., a first movement image for fourth wild 852, a second movement image for fourth wild 854, a third movement image for fourth wild, and/or a Nth movement image for fourth wild). Fifth wild 860 is transferred to a sixth collection location 866 within collection area 802. In one embodiment, fifth wild 860 movement is shown via animation to move along a sixth movement path 868. Sixth movement path 868 may include one or more images (e.g., a first movement image for fifth wild 862, a second movement image for fifth wild 864, a third movement image for fifth wild, and/or a Nth movement image for fifth wild). It should be noted that the order in which the symbols were transferred up may be modified within this disclosure. Further, any of the smart wilds and/or wilds may be interchanged in any embodiment and/or example while remaining within this disclosure.

Once the collection area 802 has reached one or more triggering events (e.g., the collection area 802 being fully, the collection area 802 having one, two, three, four, Nth smart wilds, the collection area 802 having one, two, three, four, Nth wilds, the collection area 802 being partially full (e.g., 25%, 50%, 60%, etc.), the collection area 802 having one, two, three, four, Nth other symbols (e.g., scatters, stars, aces, etc.), randomly determined trigger, and/or any other game criteria), then the gaming system and/or method may transfer one or more symbols in collection area 802 to one or more of plurality of symbol areas 806.

Figure 8E:
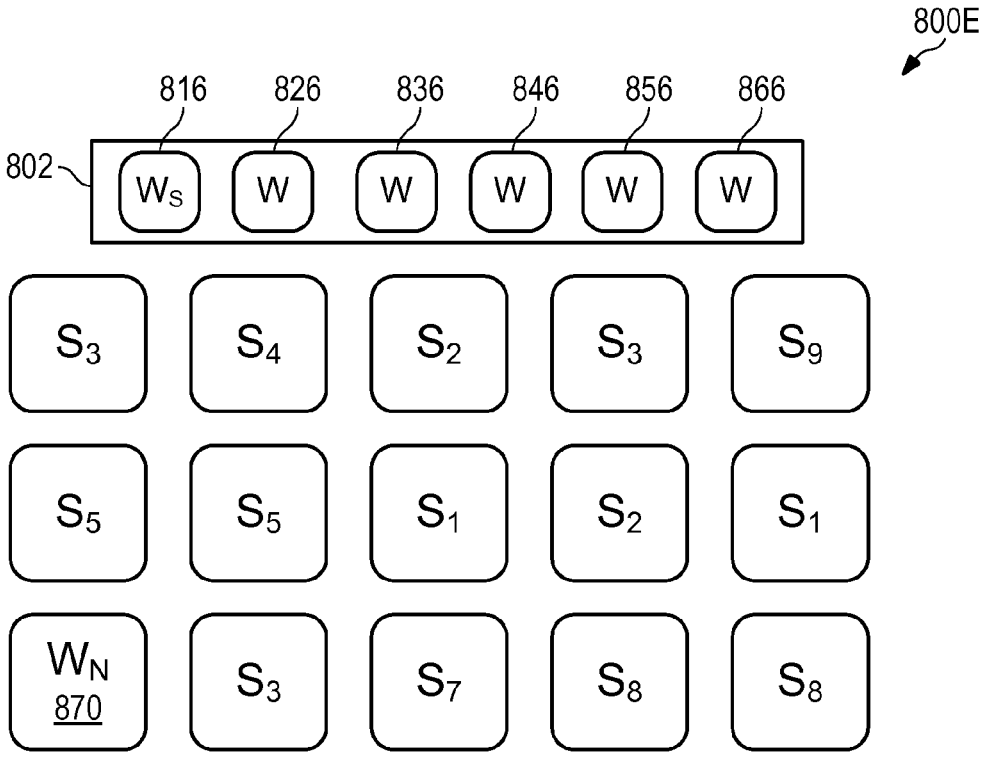
FIG. 8E is another illustration of game play on a gaming device, according to one embodiment.

In FIG. 8E, collection area 802 is fully and various symbols were generated and displayed on one or more of plurality of symbol areas 806. In this example, a normal wild 870 was also generated and displayed. In this example, normal wild 870 means a wild that was not moved to or from collection area 802.

Figure 8F:
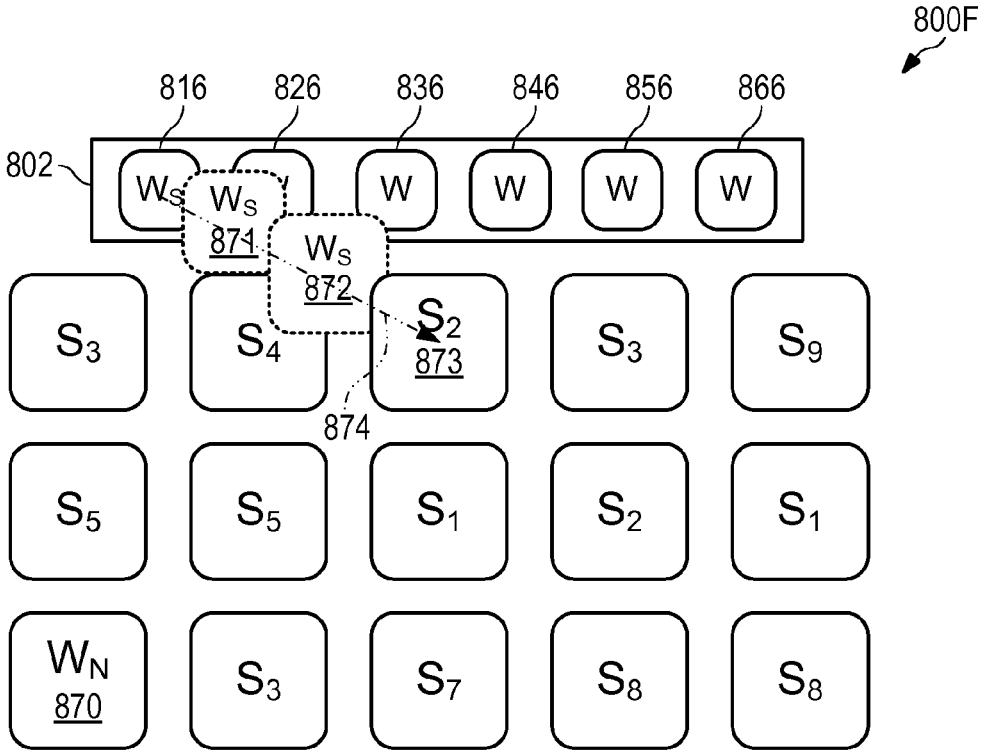
FIG. 8F is another illustration of game play on a gaming device, according to one embodiment.
Figure 8G:
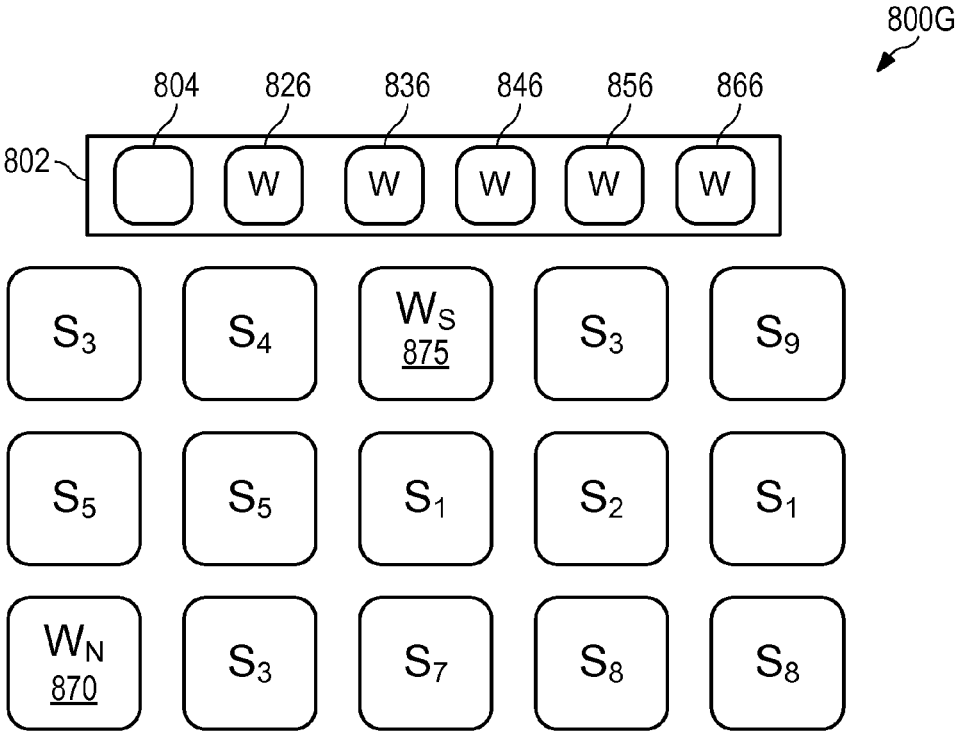
FIG. 8G is another illustration of game play on a gaming device, according to one embodiment.

In one example, once a triggering event occurred first smart wild 808 may be transferred from first collection location 816 to any location within plurality of symbol areas 806 In FIG. 8F, first smart wild 808 may move to a first replacement location 873, which is shown as a first transferred smart wild 875 in FIG. 8G.

Figure 8H:
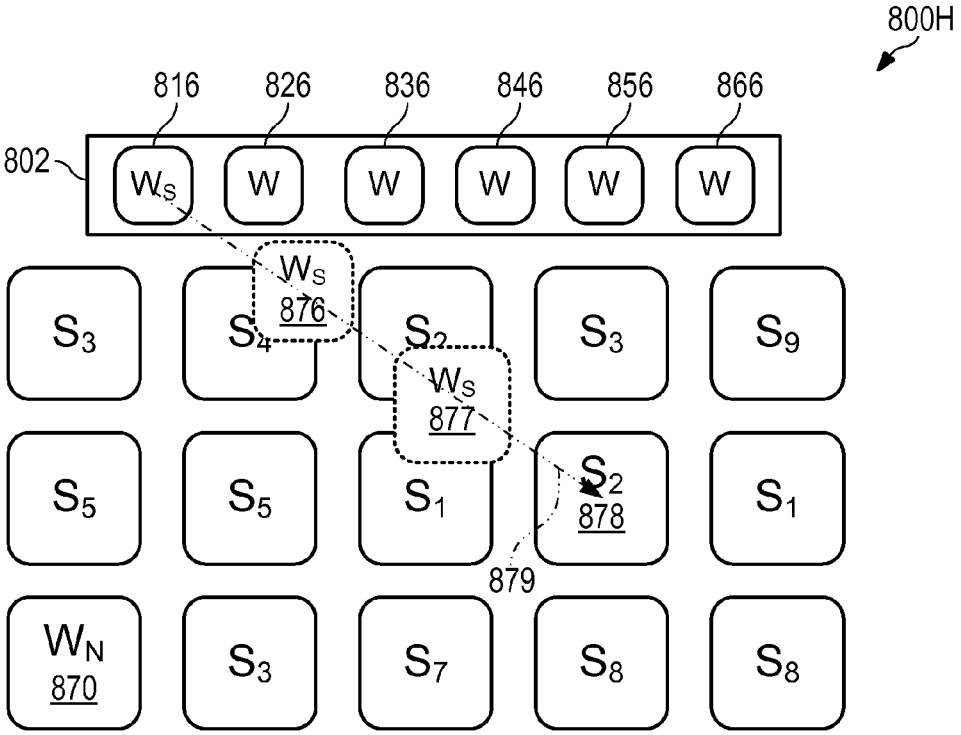
FIG. 8H is another illustration of game play on a gaming device, according to one embodiment.

In FIG. 8H, first smart wild 808 may move to a second replacement location 878, which is shown as a second transferred smart wild 878 in FIG. 8H. Since the S1 symbol is more valuable than either the S3 and/or S4 symbols, first smart wild 808 optimal position is at second replacement location 878. Further, this determination may have also included the data that if first smart wild 808 moves to second replacement location 878 there will be three like symbols (e.g., three S1 s) in a row. Whereas, if first smart wild 808 moved to first replacement location 873, there would only be two sets of two like symbols in a row (e.g., two S4s and two S3s).

Figure 8J:
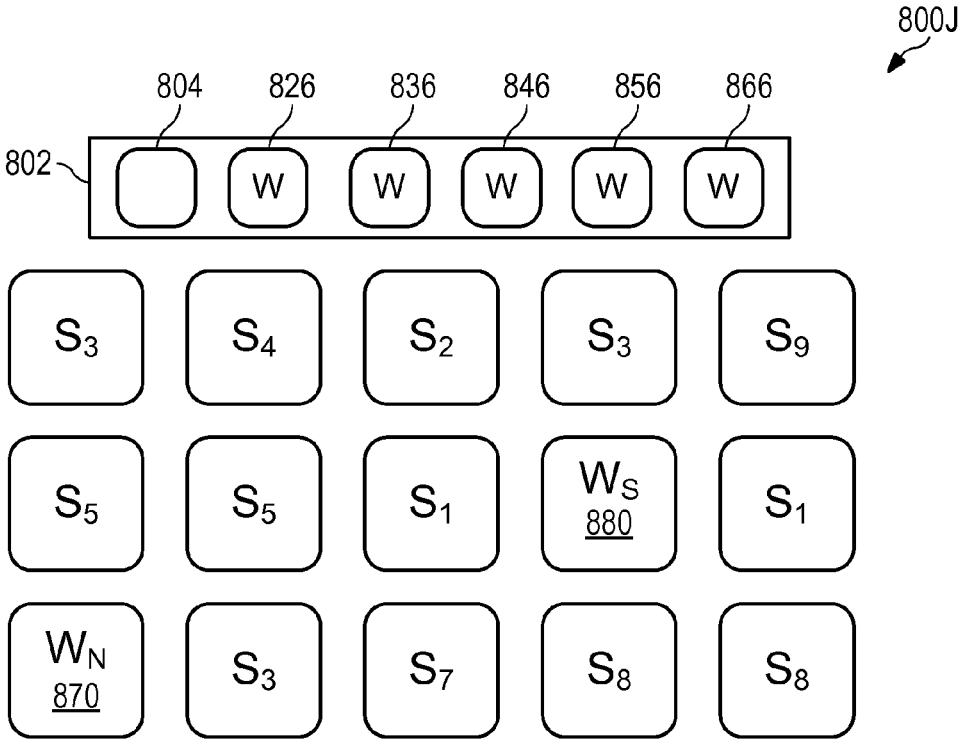
FIG. 8J is another illustration of game play on a gaming device, according to one embodiment.
Figure 8K:
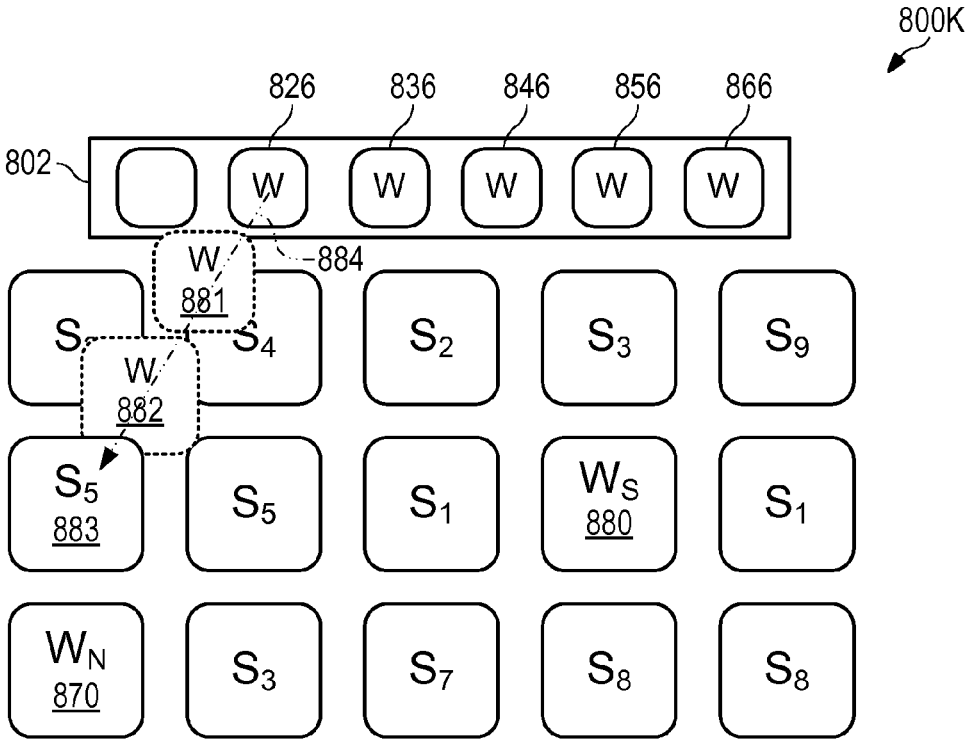
FIG. 8K is another illustration of game play on a gaming device, according to one embodiment.
Figure 8L:
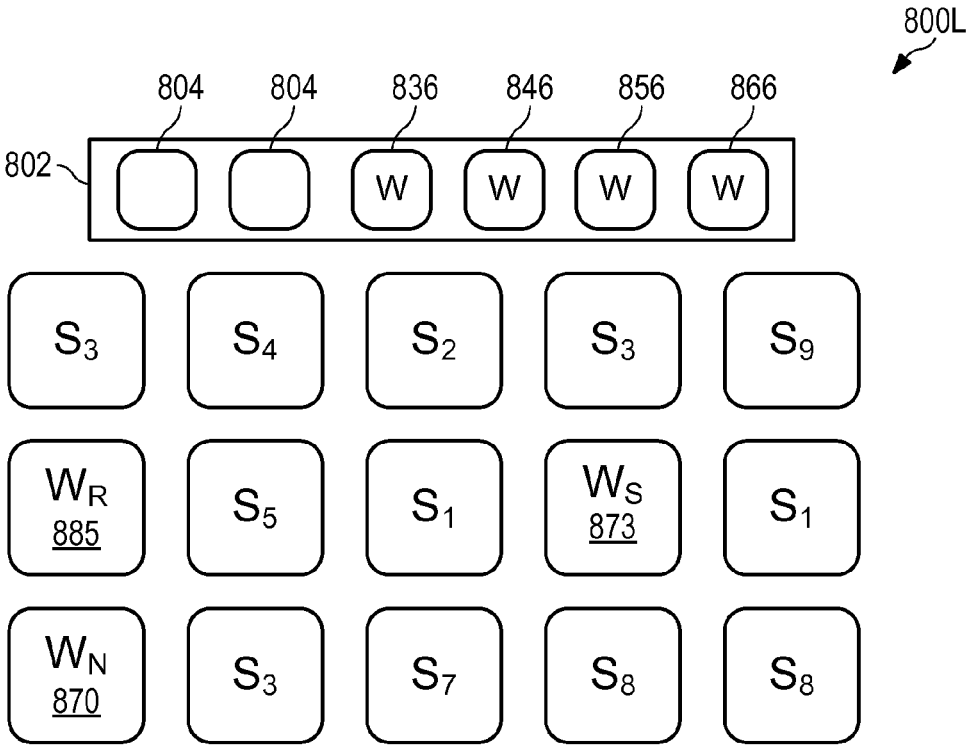
FIG. 8L is another illustration of game play on a gaming device, according to one embodiment.

Since first smart wild 808 moves to an optimal location, which in this example is second replacement location 878, first smart wild 808 is shown positioning itself at this location—a first smart wild position 880 (see FIG. 8J). In FIG. 8K, another illustration of game play on a gaming device 800K is shown, according to one embodiment. In this example, first wild 820 may move to a random location (via a random number generator or other method). In this example, first wild 802 moved from second collection location 826 in collection area 802 to a first wild location 883 on the one or more reels (see FIG. 8L).

First wild 820 may move via a seventh movement path 868, which may include one or more images (e.g., a first movement image 881, a second movement image 882, a third movement image, and/or a Nth movement image).

Figure 8M:
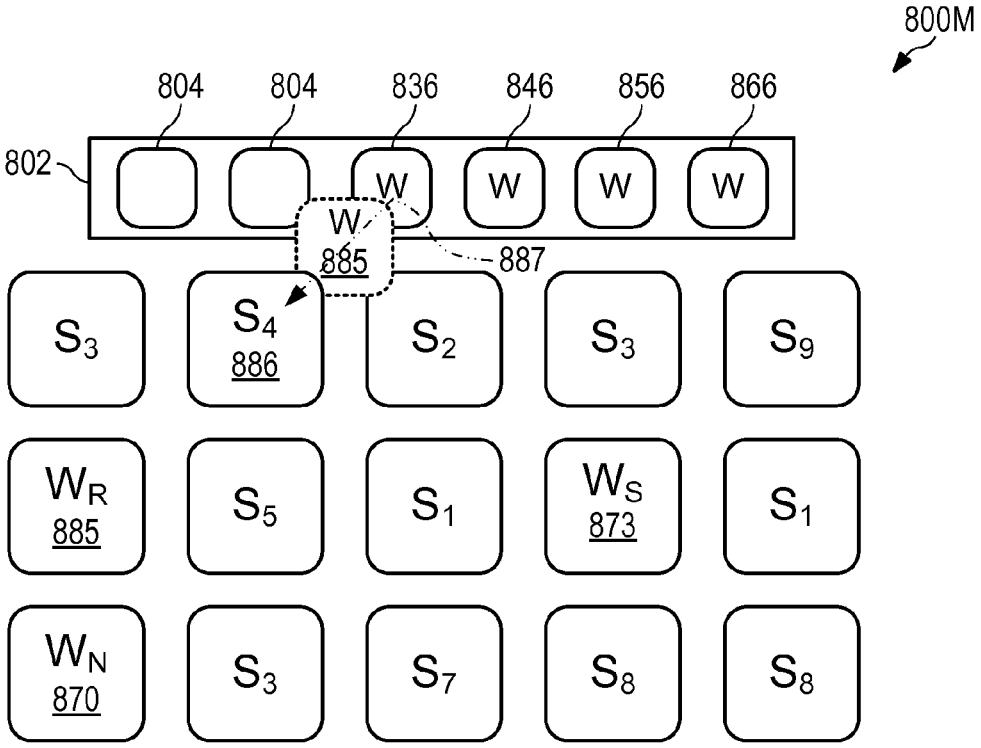
FIG. 8M is another illustration of game play on a gaming device, according to one embodiment.
Figure 8N:
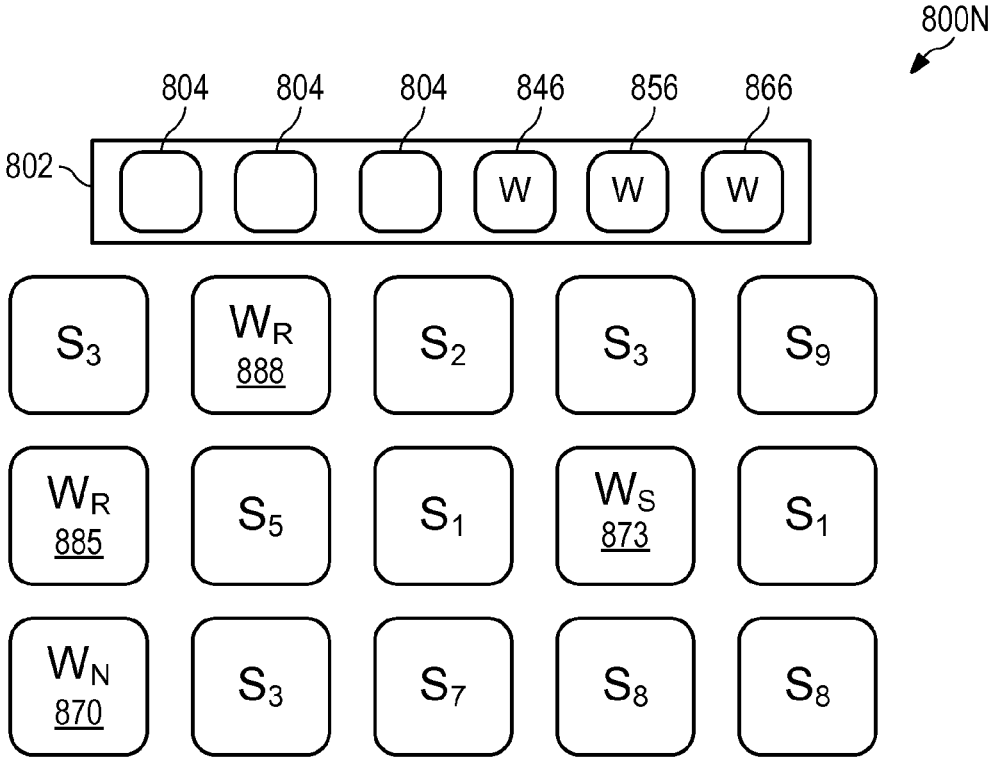
FIG. 8N is another illustration of game play on a gaming device, according to one embodiment.

In FIG. 8M, another illustration of game play on a gaming device 800M is shown, according to one embodiment. In this example, second wild 830 may move to a random location (via a random number generator or other method). In this example, second wild 830 moved from third collection location 836 in collection area 802 to a second wild location 886 on the one or more reels (see FIG. 8N).

Second wild 820 may move via an eighth movement path 887, which may include one or more images (e.g., a first movement image 885, a second movement image, a third movement image, and/or a Nth movement image).

Figure 8P:
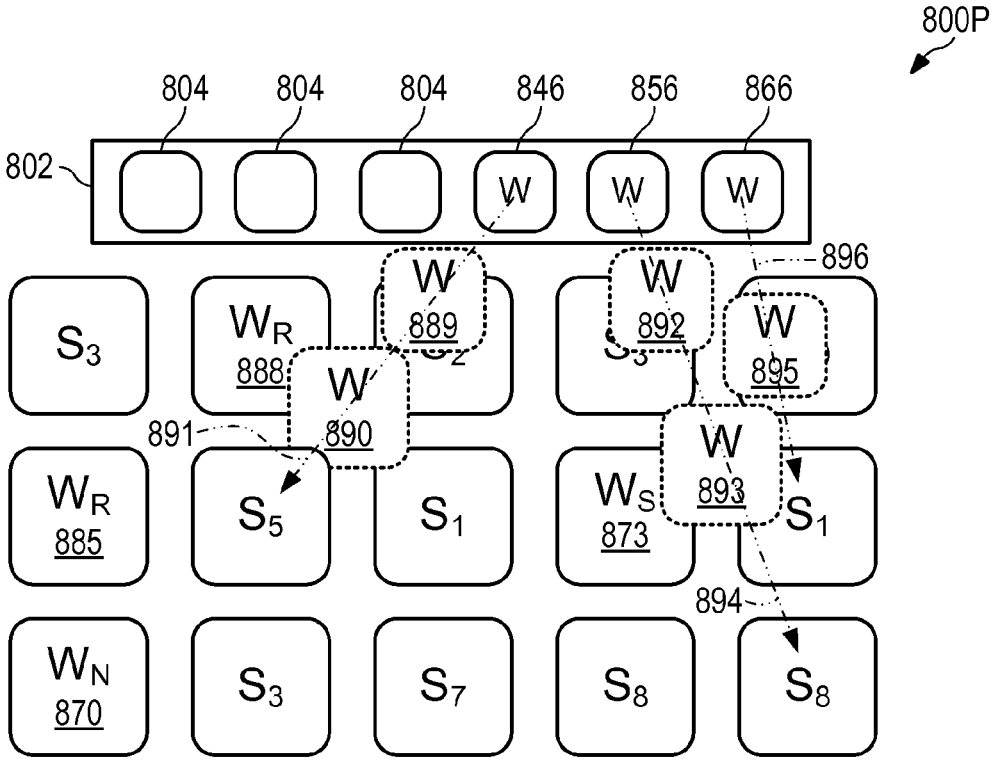
FIG. 8P is another illustration of game play on a gaming device, according to one embodiment.
Figure 8Q:
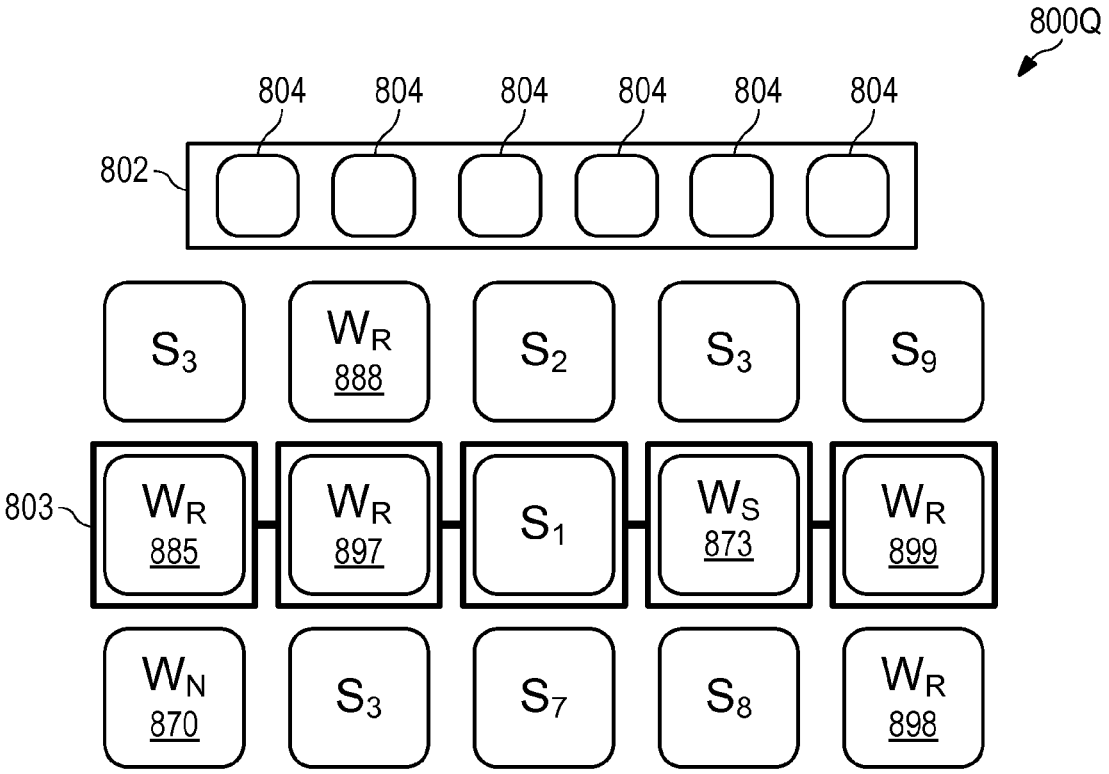
FIG. 8Q is another illustration of game play on a gaming device, according to one embodiment.

In FIG. 8P, another illustration of game play on a gaming device 800P is shown, according to one embodiment. In this example, third wild 840, fourth wild 850, and fifth wild 860 move to one or more random locations (via a random number generator or other similar method). In this example, third wild 840 moved from fourth collection location 846 in collection area 802 to a third wild location 897 on the one or more reels (see FIG. 8Q). Further, fourth wild 850 moved from fifth collection location 856 in collection area 802 to a fourth wild location 898 on the one or more reels (see FIG. 8Q). In addition, fifth wild 860 moved from sixth collection location 866 in collection area 802 to a fifth wild location 899.

Third wild 840 may move via a ninth movement path 891, which may include one or more images (e.g., a first movement image 889, a second movement image 890, a third movement image, and/or a Nth movement image).

Fourth wild 850 may move via a tenth movement path 894, which may include one or more images (e.g., a first movement image 892, a second movement image 893, a third movement image, and/or a Nth movement image).

Fifth wild 860 may move via an eleventh movement path 896, which may include one or more images (e.g., a first movement image 895, a second movement image, a third movement image, and/or a Nth movement image).

Figure 8R:
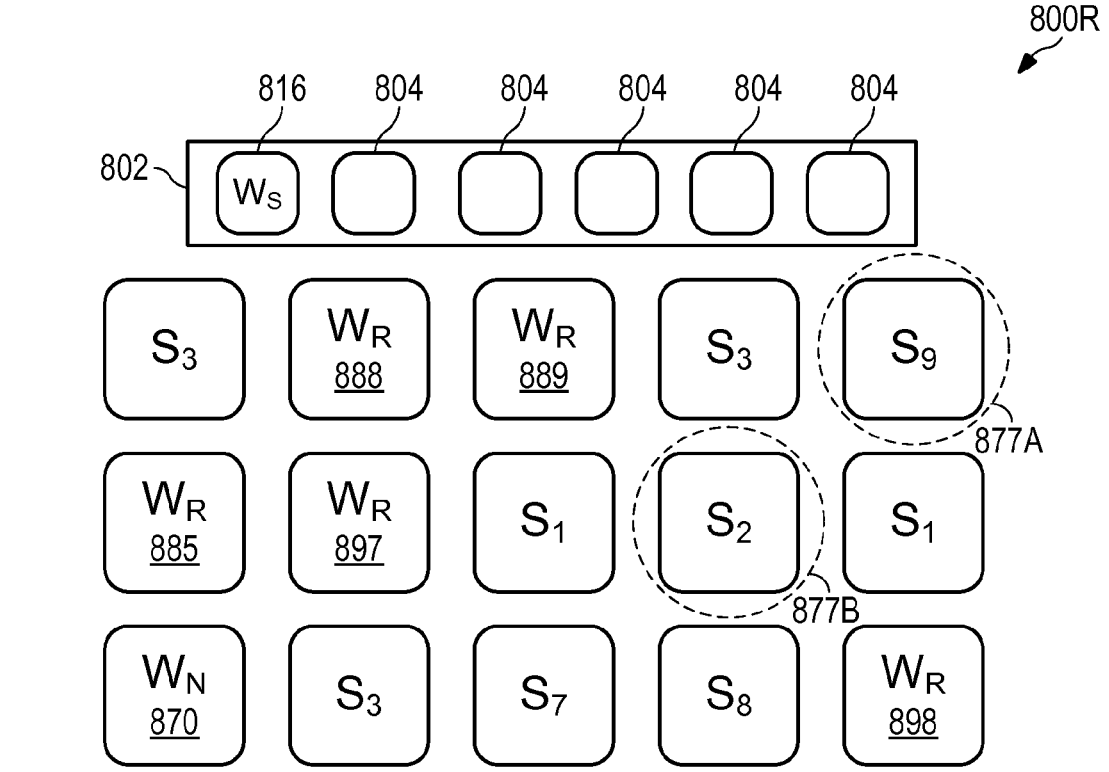
FIG. 8R is another illustration of game play on a gaming device, according to one embodiment.
Figure 8S:
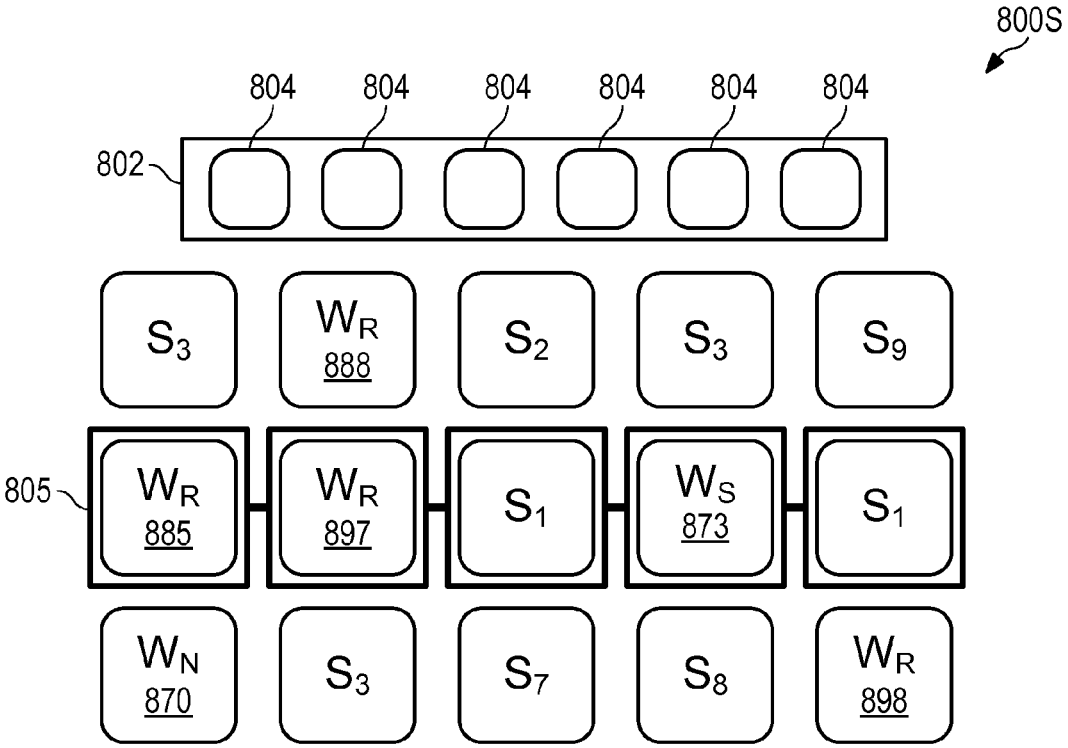
FIG. 8S is another illustration of game play on a gaming device, according to one embodiment.

In FIG. 8R, another illustration of game play on a gaming device 800R is shown, according to one embodiment. In this example, the one or more wilds stored in collection area 802 are placed (e.g., positioned, displayed, etc.) on the one or more reel locations (e.g., one or more symbol areas) before the one or more smart wilds are positioned on the one or more reels. In this example, first smart wild 808 can be placed in a first replacement location 877A or a second replacement location 877B. If first smart wild 808 is placed in first replacement location 877A, then a first winning combination of five S3 symbols is generated. If first smart wild 808 is placed in second replacement location 877B, then a second winning combination of five S1 symbols is generated. In one embodiment, first smart wild 808 will be located in the optimal position for the highest award. If the highest award is five S3 symbols, then first smart wild 808 will be placed in first replacement location 877A. If the highest award is five S1 symbols, then first smart wild 808 will be placed in second replacement location 877B. In this example, a second winning combination 805 is the highest, therefore, first smart wild 808 will be located at second replacement location 877B (see FIG. 8S). In various other examples, if smart wild can be located in a position that generates two or more smaller prizes which have the highest payout, then smart wild will be located there to optimize the award. For example, smart wild may be located in a position to create four S2 symbols with a payout of 100 credits or in a position that creates two winning combinations (e.g., three S3 symbols with a payout of 50 credits and three S1 symbols with a payout of 80 credits). Since the two winning combinations have a total payout of 130 credits which is greater than the 100 credits payout for the one winning combination (e.g., four S2 symbols), smart wild may be located at the position which creates the highest payout (e.g., the two winning combinations that generate 130 credits).

Figure 9A:
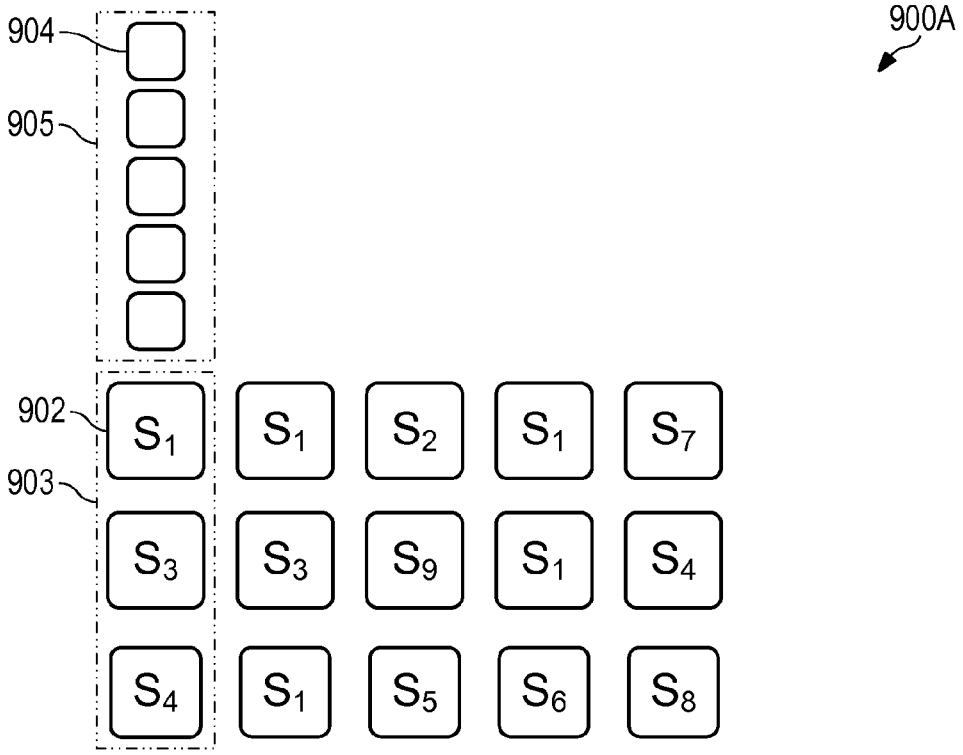
FIG. 9A is another illustration of game play on a gaming device, according to one embodiment.

FIG. 9A shows another illustration of game play on a gaming device, according to one embodiment. A first collection area image 900A includes a first column collection area 905. First column collection area 905 includes one or more storage areas 904. First column collection area 905 may collect one or more smart wilds and/or one or more wilds that appear (e.g., are displayed, are generated, etc.) in a first column 903 on one more first column symbol areas 902. In this example, there is only one collection area and this collection area only relates to the first column.

In should be noted that one or more collection areas may be utilized and that these one or more collections areas may related to one or more areas (e.g., columns, rows, blocks, C shapes, T shapes, etc.) on the one or more reels.

Figure 9B:
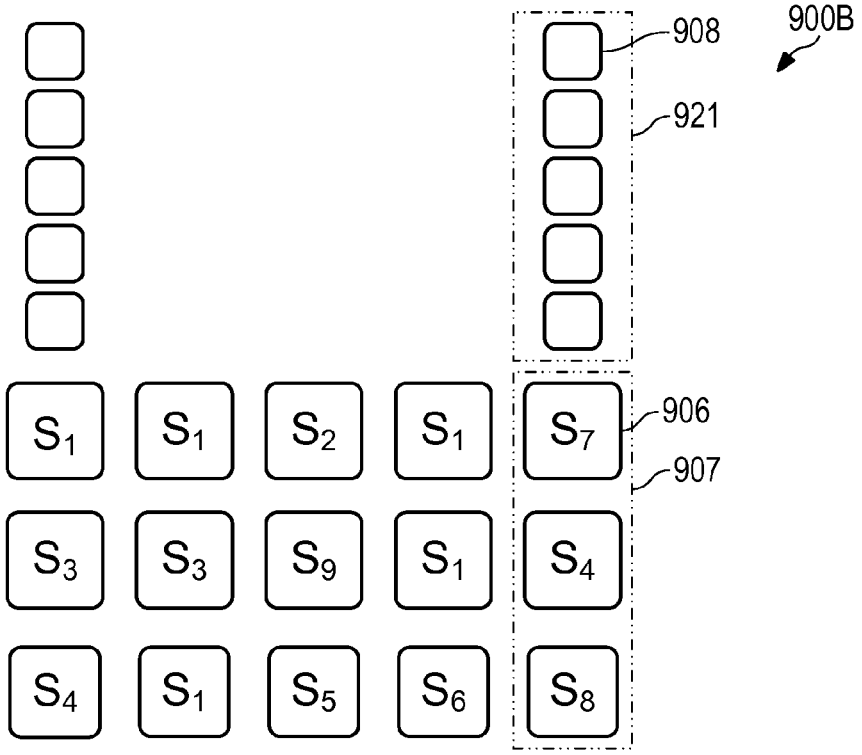
FIG. 9B is another illustration of game play on a gaming device, according to one embodiment.

In another example, a fifth column collection area 921 may include one or more storage areas 908 and be utilized with first column collection area 905 (see FIG. 9B). In this example, fifth column collection area 921 may collect one or more smart wilds, one or more wilds, and/or one or more other symbols that appear (e.g., are displayed, are generated, etc.) in a fifth column 907 on one more fifth column symbol areas 906.

Figure 9C:
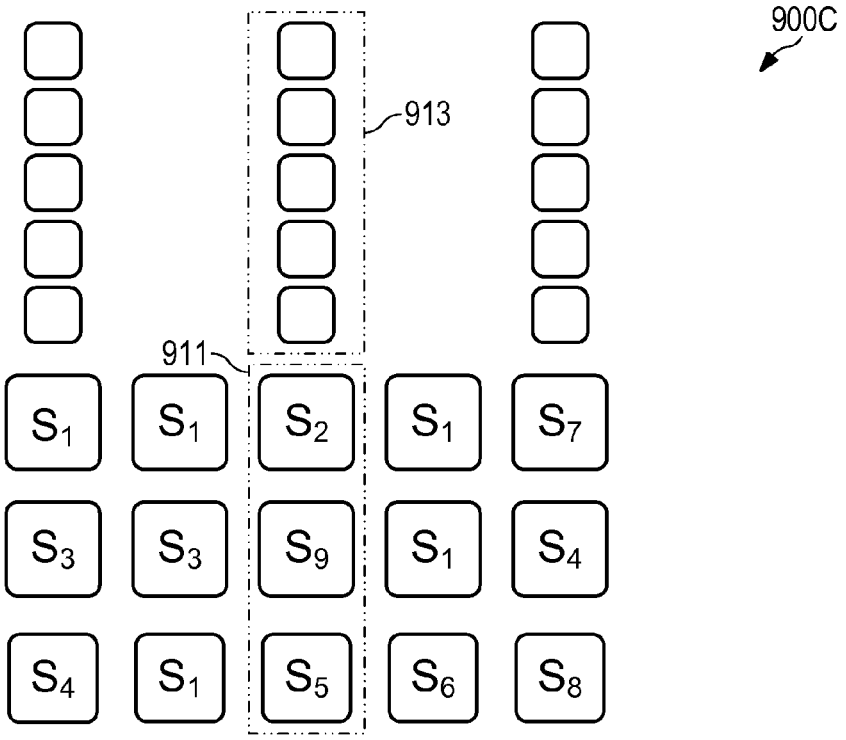
FIG. 9C is another illustration of game play on a gaming device, according to one embodiment.

In another example, a third column collection area 913 may include one or more storage areas and be utilized with first column collection area 905 and fifth column collection area 921 (see FIG. 9C). In this example, third column collection area 913 may collect one or more smart wilds, one or more wilds, and/or one or more other symbols that appear (e.g., are displayed, are generated, etc.) in a third column 911 on one more third column symbol areas.

Figure 9D:
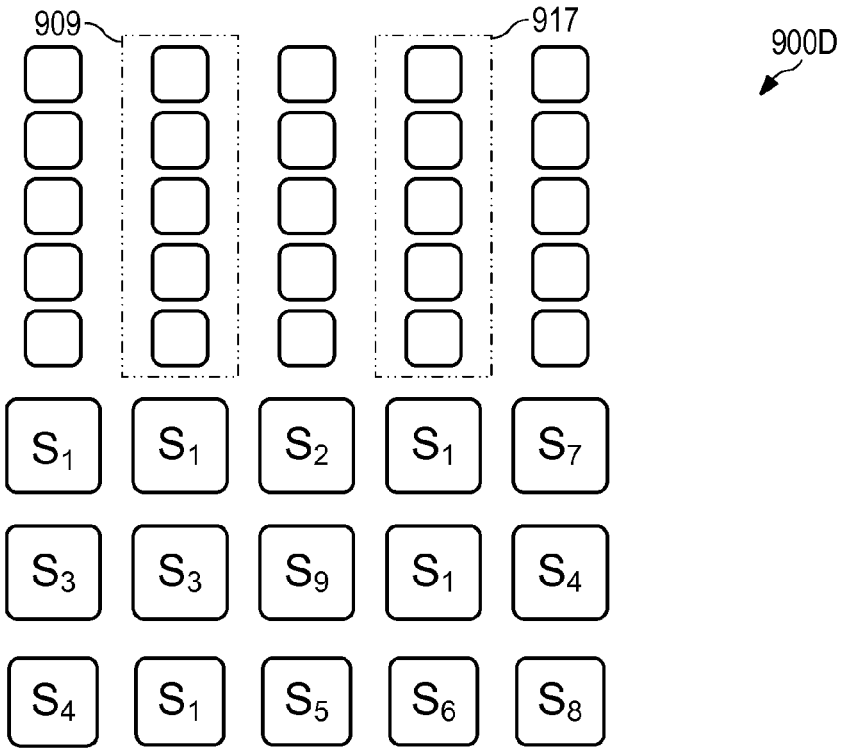
FIG. 9D is another illustration of game play on a gaming device, according to one embodiment.

In another example, a second column collection area 909 and a fourth column collection area 917 may include one or more storage areas and be utilized with first column collection area 905, third column collection area 913, and fifth column collection area 921 (see FIG. 9D). In this example, second column collection area 909 and fourth column collection area 917 may collect one or more smart wilds, one or more wilds, and/or one or more other symbols that appear (e.g., are displayed, are generated, etc.) in a second column and a third column, respectively.

Figure 10A:
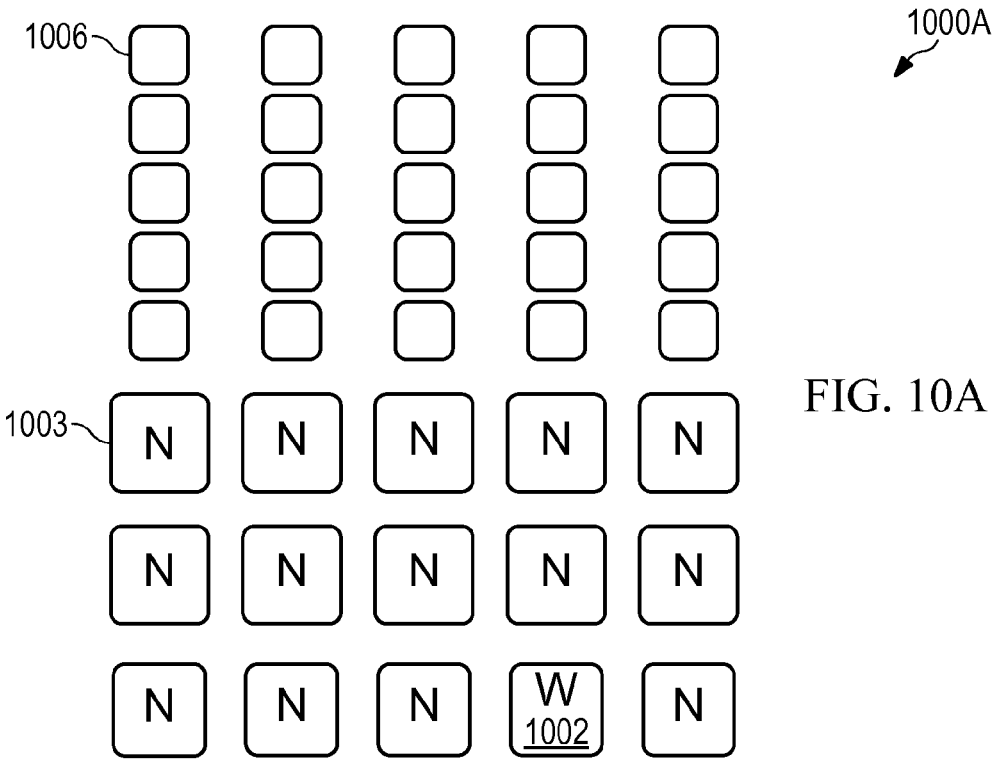
FIG. 10A is another illustration of game play on a gaming device, according to one embodiment.
Figure 10B:
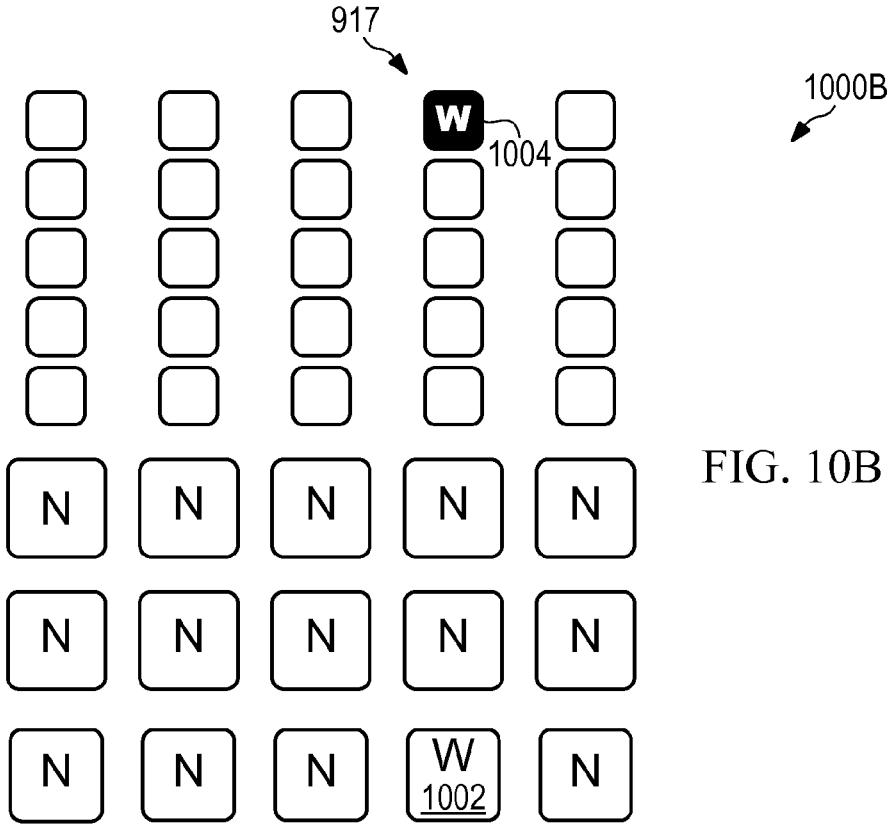
FIG. 10B is another illustration of game play on a gaming device, according to one embodiment.

In FIG. 10A, another illustration of game play on a gaming device is shown, according to one embodiment. In a first falling symbol collection area image 1000A, a plurality of storage units 1006, one or more non-collectable symbols 1003, and a collectable symbol 1002 are shown. In this example, collectable symbol 1002 is a wild symbol. Collectable symbol 1002 may be one or more wild symbols, one or more smart wild symbols, and/or any other symbol. In this example, plurality of storage units 1006 relate to the corresponding columns below them. However, plurality of storage units 1006 may relate to one or more rows, one or more columns, and/or any other gaming area (e.g., a horizontal line, a vertical line, a diagonal line, a cross, a T, an S, a C, an L, a V, any other letter, a circle, a rectangle, any irregular shape, and/or any other shape). In one example, collectable symbol 1002 is transferred to a first collection area in a fourth collection column 917 and is illustrated as a first collected symbol 1004 (see FIG. 10B).

Figure 10C:
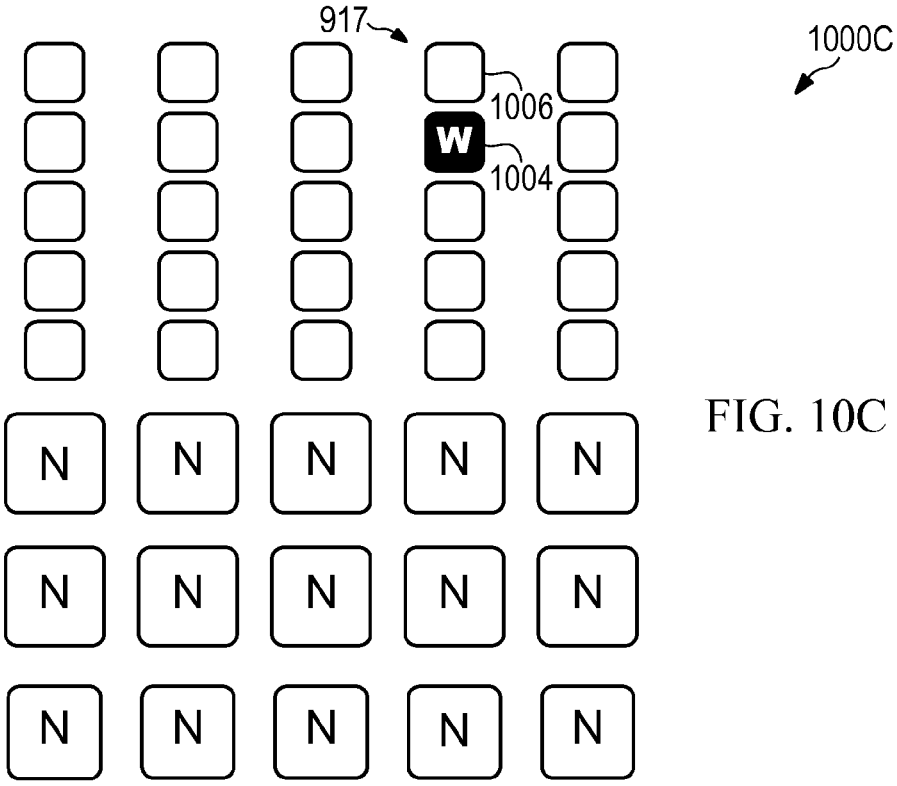
FIG. 10C is another illustration of game play on a gaming device, according to one embodiment.

In one example, during the next spin there are no collectable symbols generated. In this case, first collected symbol 1004 moves to a second collection area in fourth collection column and the first collection area is a cleared area 1006 (see FIG. 10C). In various examples, the movements in collection area may be down, up, left, right, diagonal, random, predetermined, and/or any combination thereof.

Figure 10D:
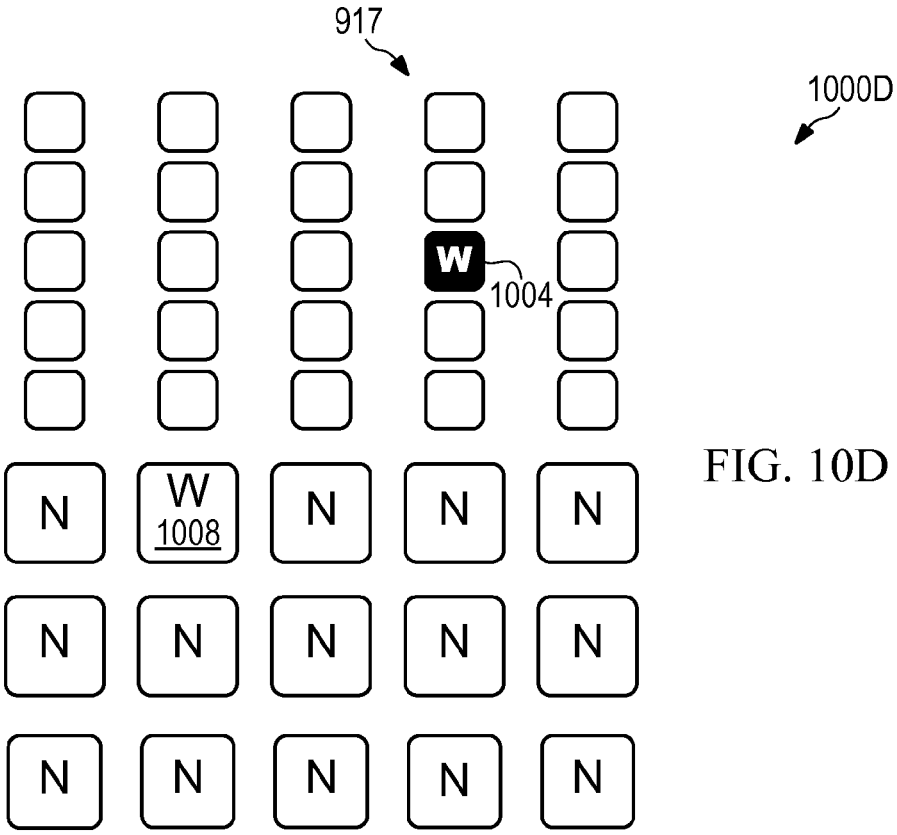
FIG. 10D is another illustration of game play on a gaming device, according to one embodiment.
Figure 10E:
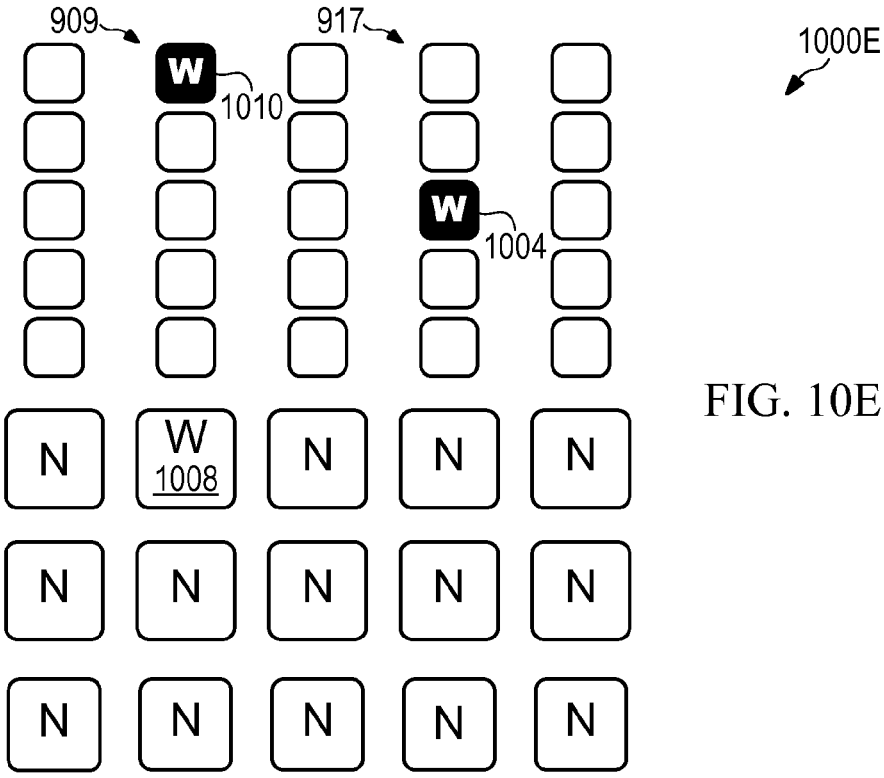
FIG. 10E is another illustration of game play on a gaming device, according to one embodiment.

In another example, during the next spin after the spin which occurred in the previous example a second collectable symbol 1008 is generated in the second column (see FIG. 10D). In FIG. 10D, first collected symbol 1004 moves to a third collection area in fourth collection column and the second collection area is cleared. Further, second collectable symbol 1008 is transferred to a first collection area for a second column 909 which is represented by a second collected symbol 1010 (see FIG. 10E). It should be noted that first collected symbol 1004 is moving down by one spatial unit. However, any number of spatial units (e.g., 1 to N) may be utilized. Further, any directional movement may be utilized (e.g., vertical, horizontal, diagonal, irregular, random, etc.). Further, it should be noted that the collectable symbols may generate one or more payouts before being transferred to one or more collection areas. In other words, the one or more collectable symbols may interact with the other symbols on the one or more reels to generate one or more potential payouts before being transferred.

Figure 10F:
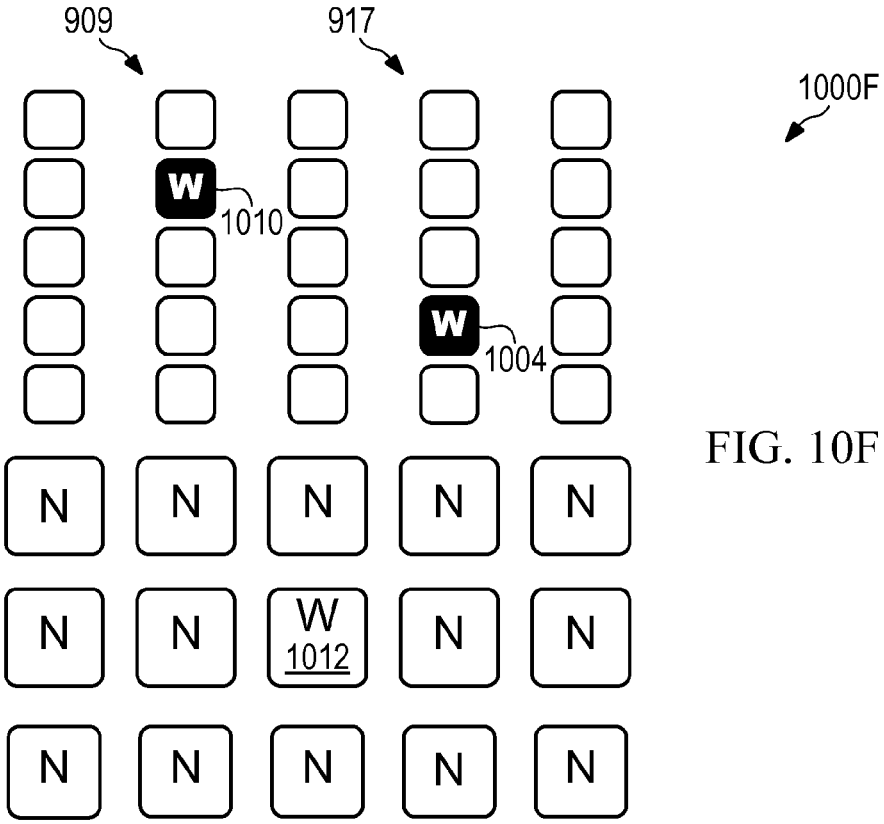
FIG. 10F is another illustration of game play on a gaming device, according to one embodiment.
Figure 10G:
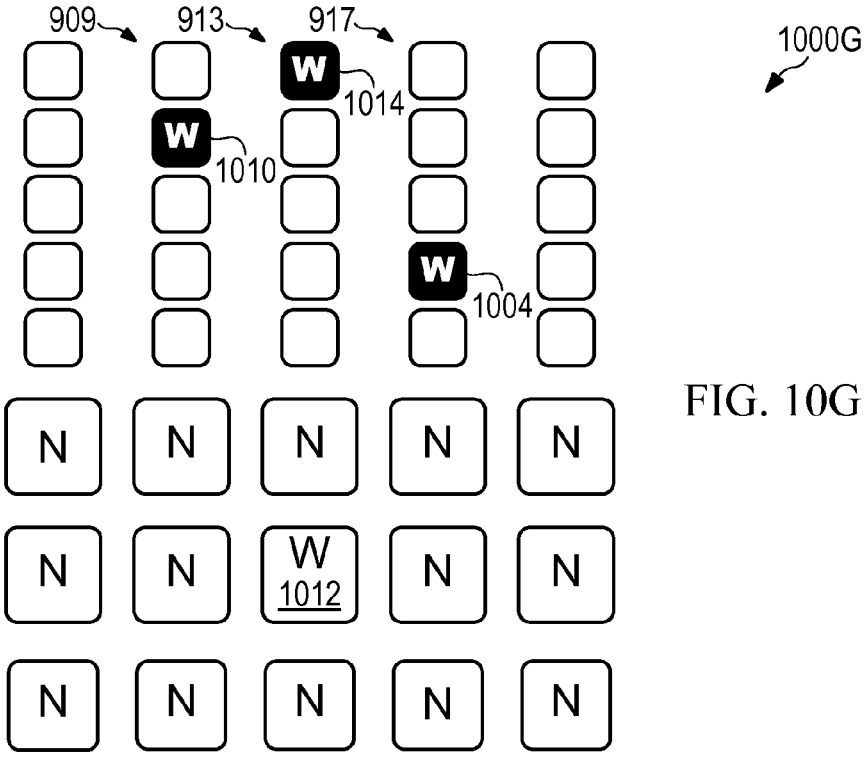
FIG. 10G is another illustration of game play on a gaming device, according to one embodiment.

In another example, another spin occurs which generates a third collectable symbol 1012 in a third column (see FIG. 10F). In this example, first collected symbol 1004 moves to a fourth collection area in fourth collection column and the third collection area is cleared. In addition, second collected symbol 1010 moves to a second collection area in second collection column and the first collection area is cleared. Further, third collectable symbol 1012 is transferred to a first collection area for a third second column 913 which is represented by a third collected symbol 1014 (see FIG. 10G).

Figure 10H:
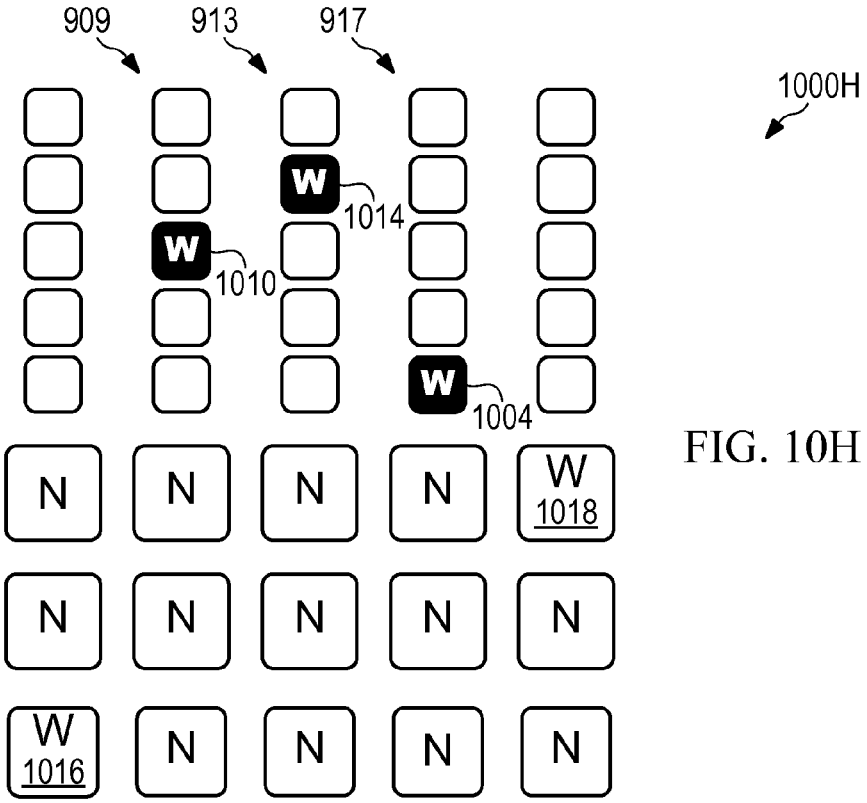
FIG. 10H is another illustration of game play on a gaming device, according to one embodiment.
Figure 10J:
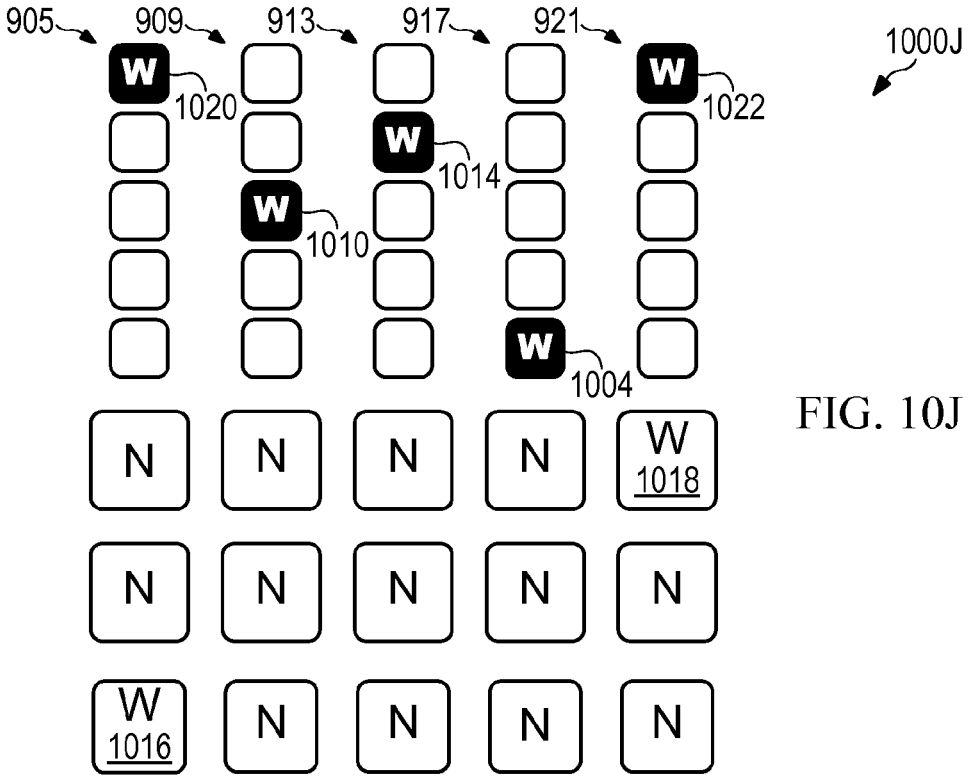
FIG. 10J is another illustration of game play on a gaming device, according to one embodiment.

In another example, another spin occurs which generates a fourth collectable symbol 1016 in a first column and a fifth collectable symbol 1018 in a fifth column (see FIG. 10H). In this example, the movement pattern in the collection area is: first collected symbol 1004 moves to a fifth collection area in fourth collection column and the fourth collection area is cleared; second collected symbol 1010 moves to a third collection area in second collection column and the second collection area is cleared; and third collected symbol 1014 moves to a second collection area in the third collection column and the first collection area is cleared. Further, fourth collectable symbol 1016 is transferred to a first collection area for a first column 905 which is represented by a fourth collected symbol 1020 (see FIG. 10J). In addition, fifth collectable symbol 1018 is transferred to a first collection area for a fifth column 921 which is represented by a fifth collected symbol 1022 (see FIG. 10J).

Figure 10K:
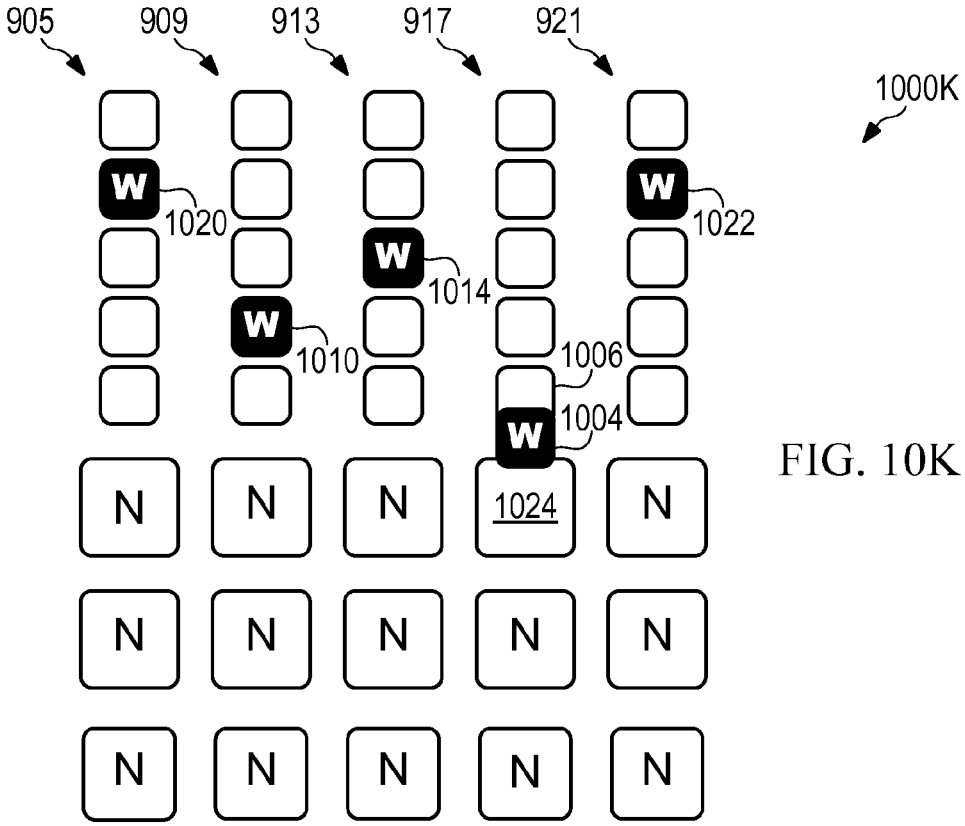
FIG. 10K is another illustration of game play on a gaming device, according to one embodiment.

In FIG. 10K, another illustration of game play on a gaming device 1000J is shown, according to one embodiment. In this example, first collected symbol 1004 is being transferred from the collection area to a first active area 1024. First active area 1024 may be one or more areas where one or more payouts may be determined based on one or more symbol interactions. In this example, first collected symbol 1004 moved from fifth collection area on fourth column to one or more active game fields (e.g., first active area 1024). Further, fifth collection area on fourth column 917 is cleared.

Figure 10L:
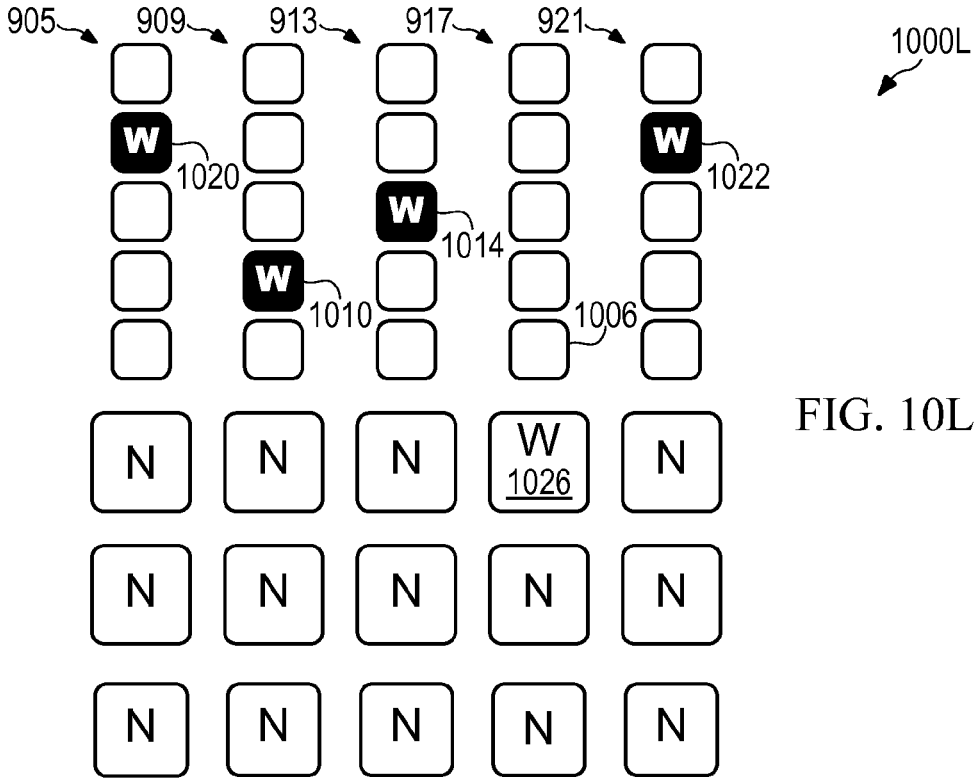
FIG. 10L is another illustration of game play on a gaming device, according to one embodiment.

In one example, first active area 1024 is transformed into a wild symbol 1026 (see FIG. 10L) which may interact with one or more symbols to generate one or more payouts (see FIGS. 10S to 10Z). In FIG. 10L, the movement pattern in the collection area is: second collected symbol 1010 moves to a fourth collection area in second collection column and the third collection area is cleared; third collected symbol 1014 moves to a third collection area in the third collection column and the second collection area is cleared; fourth collected symbol 1020 moves to a second collection area in first collection column and the first collection area is cleared; and fifth collected symbol 1022 moves to a second collection area in fifth collection column and first collection area is cleared.

Figure 10M:
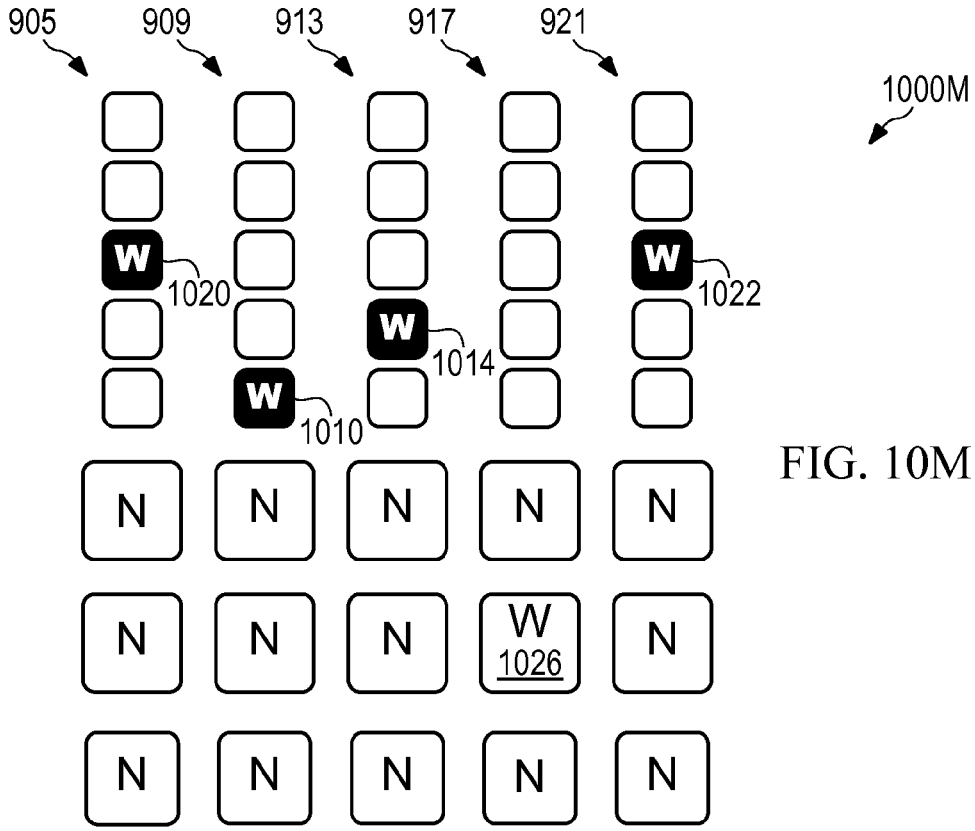
FIG. 10M is another illustration of game play on a gaming device, according to one embodiment.

After another spin, wild symbol 1026 moves down one spatial unit on active column four and may interact with one or more symbols to generate one or more payouts (see FIGS. 10S to 10Z). In FIG. 10M, the movement pattern in the collection area is: second collected symbol 1010 moves to a fifth collection area in second collection column and the fourth collection area is cleared; third collected symbol 1014 moves to a fourth collection area in the third collection column and the third collection area is cleared; fourth collected symbol 1020 moves to a third collection area in first collection column and the second collection area is cleared; and fifth collected symbol 1022 moves to a third collection area in fifth collection column and second collection area is cleared. This process may continue for Nth number of spins.

Figure 10N:
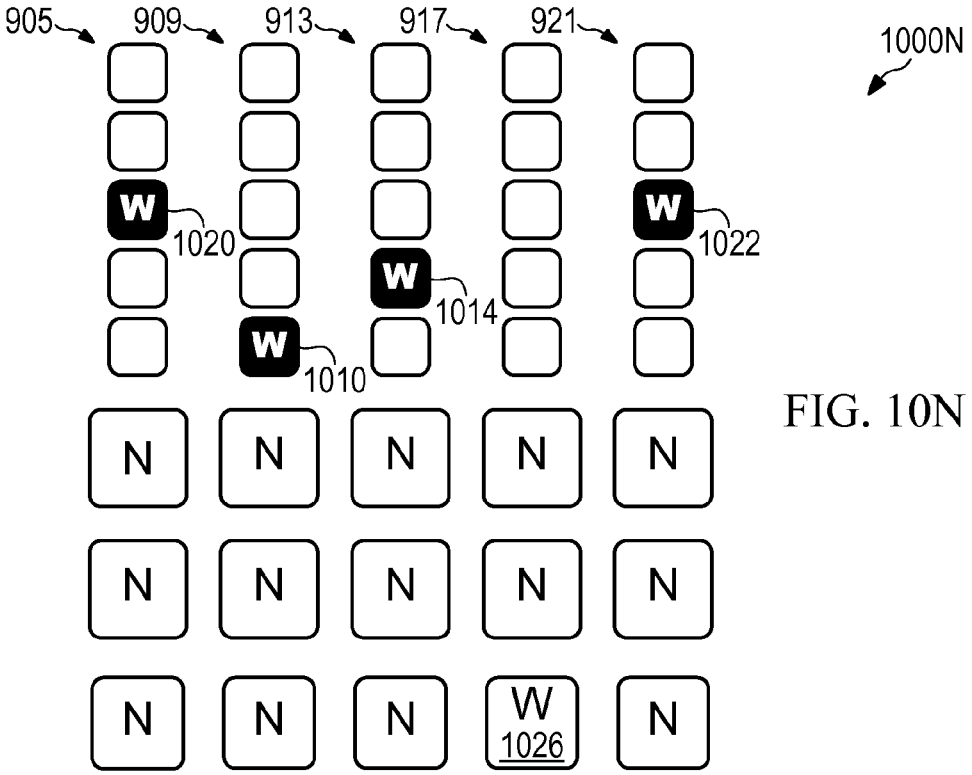
FIG. 10N is another illustration of game play on a gaming device, according to one embodiment.
Figure 10P:
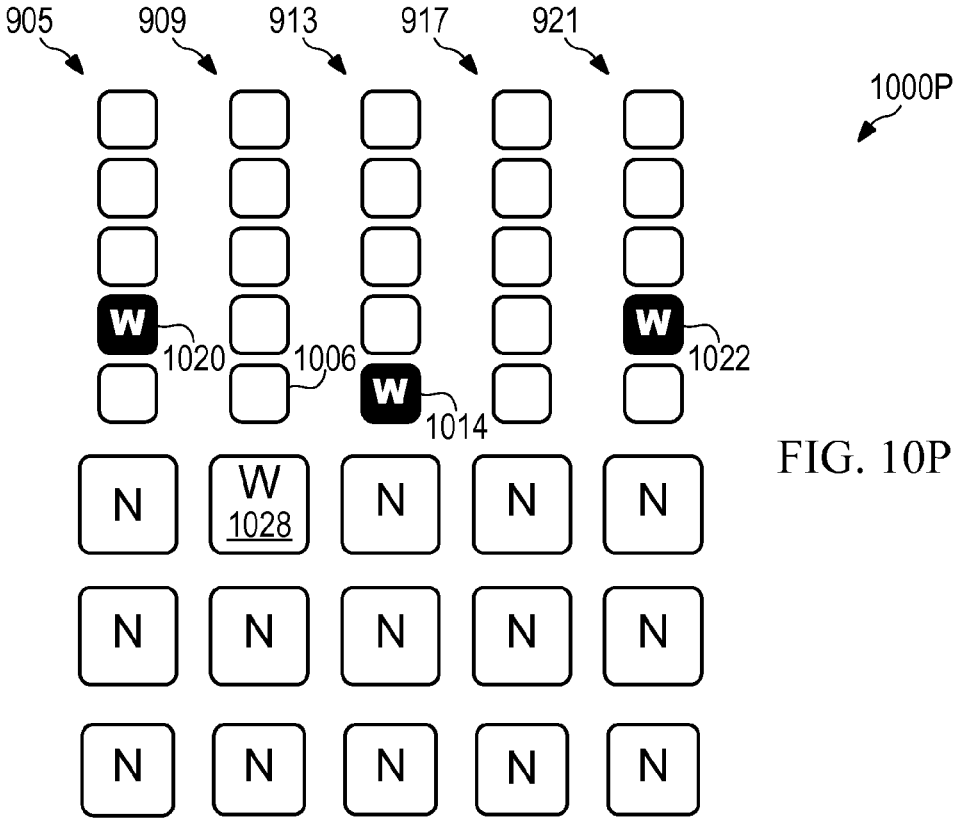
FIG. 10P is another illustration of game play on a gaming device, according to one embodiment.

In another example, wild symbol 1026 is in the last active spot on fourth column (see FIG. 10N). During the next spin, wild symbol 1026 will disappear for the active game area (see FIG. 10P). In FIG. 10P, a second wild symbol 1028 is transferred from the storage area onto the active field. In various examples, one or more symbols may be transferred from the storage area. In other examples, no symbols may be ready to be transferred from the storage area.

In FIG. 10Q, another illustration of game play on a gaming device 1000Q is shown, according to one embodiment. This example is similar to FIG. 10K, however, first collected symbol 1004 moves onto the active area in a diagonal direction into a second active area 1030 which is represented by a third wild symbol 1032 (see FIG. 10R).

Figure 10S:
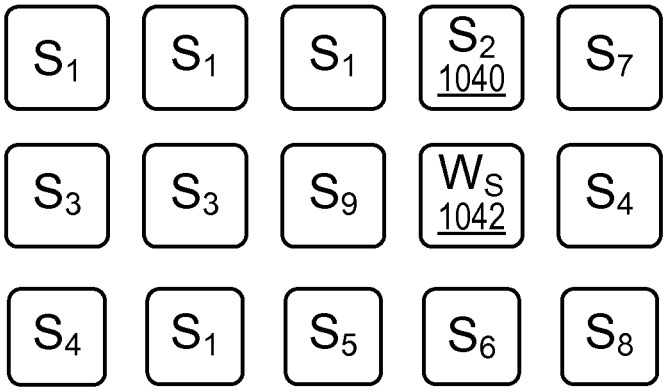
FIG. 10S is another illustration of game play on a gaming device, according to one embodiment.
Figure 10T:
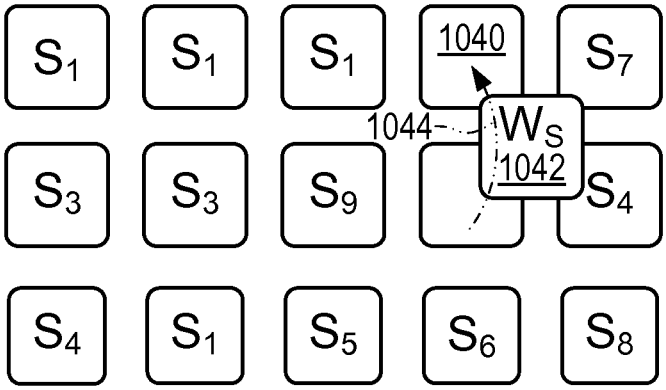
FIG. 10T is another illustration of game play on a gaming device, according to one embodiment.
Figure 10U:
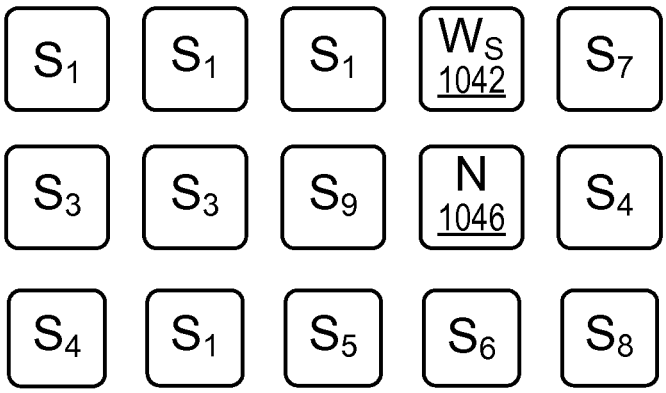
FIG. 10U is another illustration of game play on a gaming device, according to one embodiment.

FIG. 10S shows another illustration of game play on a gaming device, according to one embodiment. In this example, a plurality of symbols are generated and displayed on a plurality of reels. One of the plurality of symbols is a first smart wild 1042, which is located at the second row/fourth column. However, the optimal location for a wild would have been the first row/fourth column. Since first smart wild 1042 can move to an optimal position, first smart wild 1042 moves to a first symbol location 1040 to replace the S2 symbol, which generates a winning combination (e.g., four S1 symbols) (see FIGS. 10T-10U).

Figure 10V:
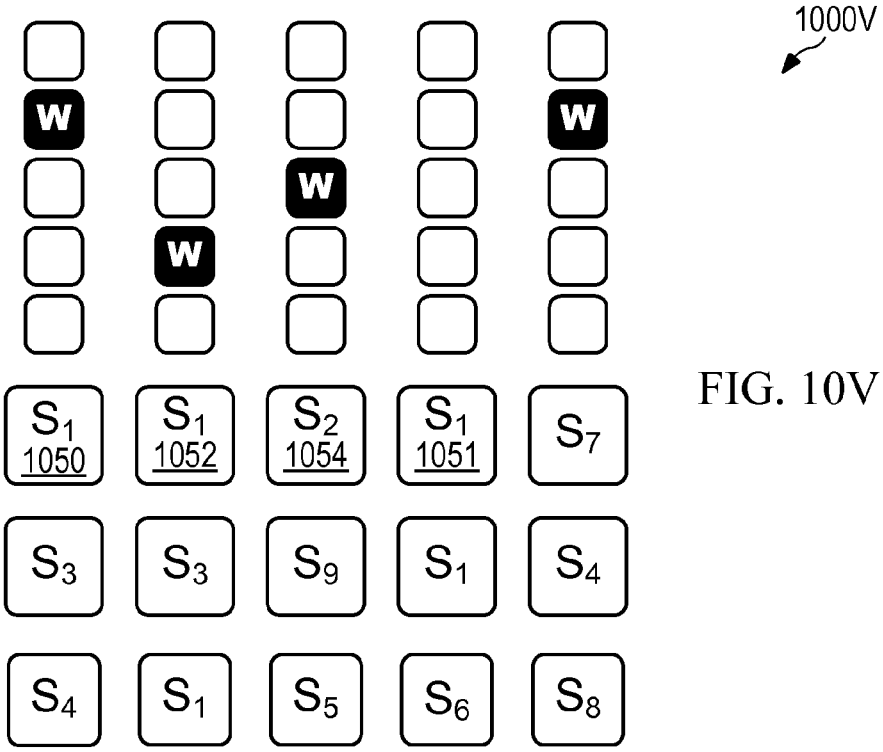
FIG. 10V is another illustration of game play on a gaming device, according to one embodiment.
Figure 10W:
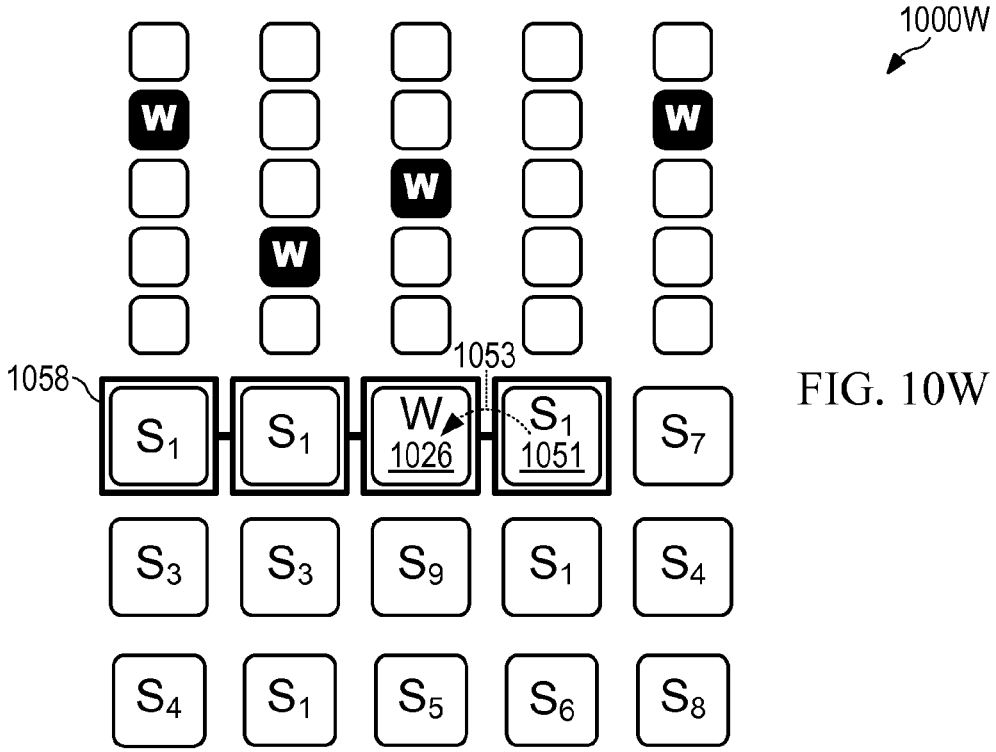
FIG. 10W is another illustration of game play on a gaming device, according to one embodiment.

In FIG. 10V, another illustration of game play on a gaming device 1000V is shown, according to one embodiment. In this example, a first S1 symbol 1050, a second S1 symbol 1052, a first S2 symbol 1054, and a third S1 symbol is generated in the first row. A smart wild 1026 may be transferred from the collection area 802 (e.g., fourth collection column and fifth collection location) to the active reels area at first row/fourth column. In this example, the first row/fourth column area was already an S1 symbol. Therefore, smart wild 1026 may move to first row/third column via a first path 1053 to replace the S2 symbol, which generates a winning combination of 4 S1 symbols 1058 (see FIG. 10W).

Figure 10X:
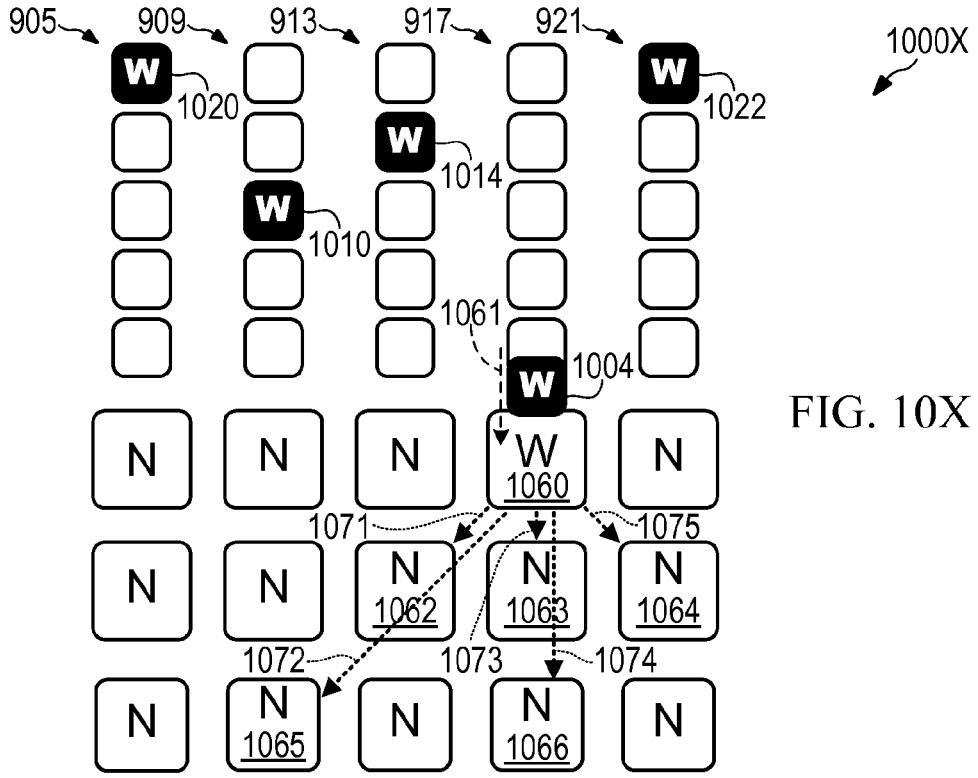
FIG. 10X is another illustration of game play on a gaming device, according to one embodiment.
Figure 10Y:
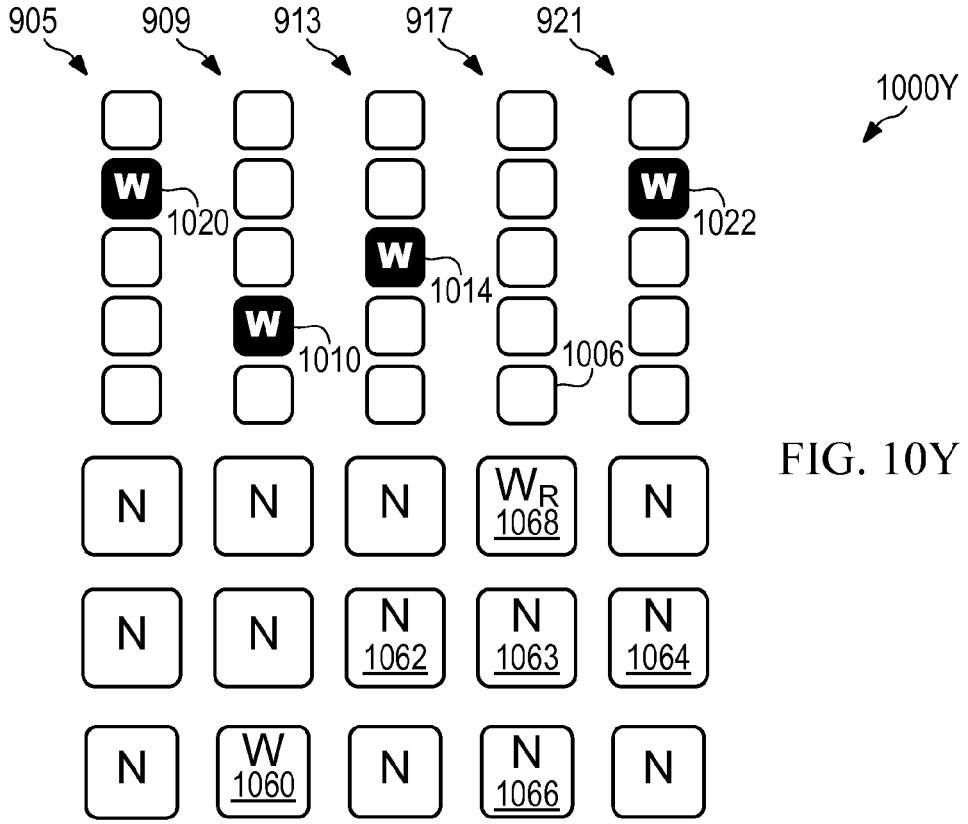
FIG. 10Y is another illustration of game play on a gaming device, according to one embodiment.
Figure 10Z:
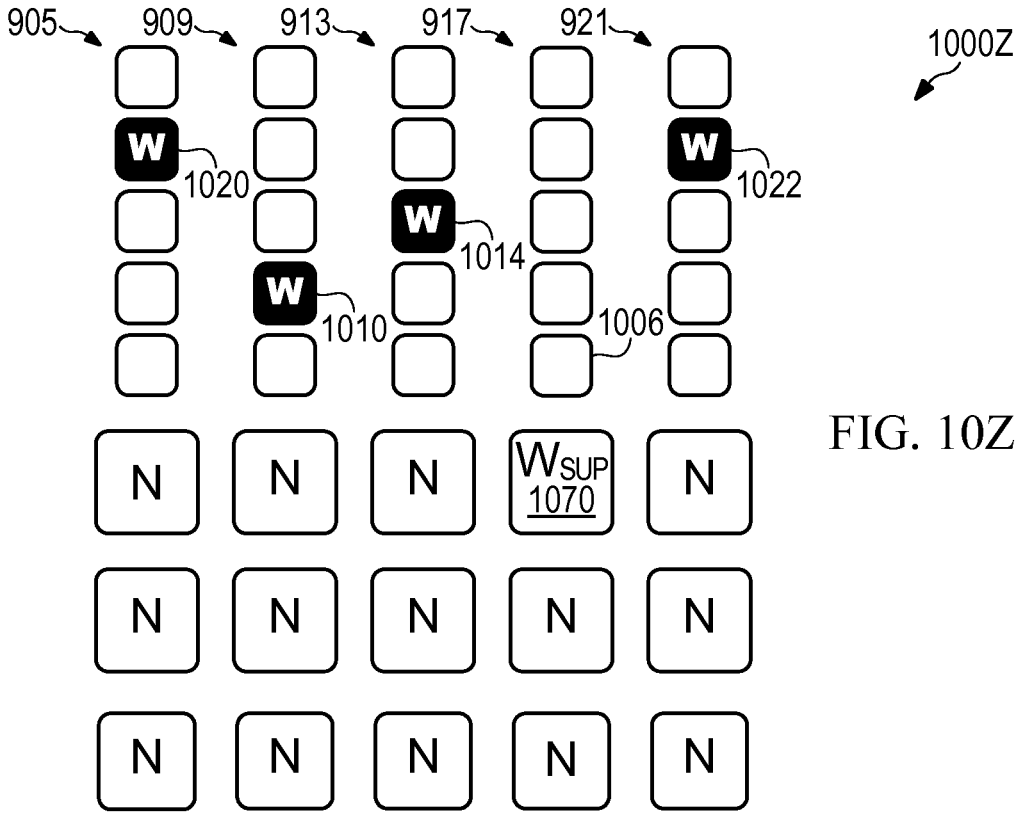
FIG. 10Z is another illustration of game play on a gaming device, according to one embodiment.

In FIG. 10X, another illustration of game play on a gaming device 1000X is shown, according to one embodiment. In this example, first collected symbol 1004 (e.g., wild, smart wild, etc.) is being transferred from collection area 802 to the active area where an interaction symbol 1060 (e.g., wild, smart wild, etc.) has been generated. In one example, the collision of first collected symbol 1004 and interaction symbol 1060 may cause one or more pinball actions. For example, a smart wild (and/or a wild and/or any other symbol) may be generated in a first position 1060, a second position 1062, a third position 1063, a fourth position 1064, a fifth position 1065, a sixth position 1066, and/or any other symbol area position on the one or more symbol areas. For example, a first wild 1068 and a second wild 1060 may be positioned according to FIG. 10Y. In another example, the collision of first collected symbol 1004 and interaction symbol 1060 may generate a super wild 1070. Super wild 1070 may expand into any number of symbol areas in any shape and for any duration (e.g., one spin, two spins, ten spins, etc.) (see FIG. 10Z).

Figure 11A:
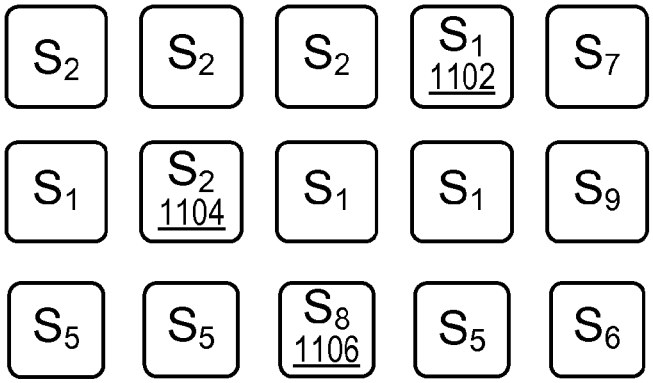
FIG. 11A is another illustration of game play on a gaming device, according to one embodiment.
Figure 11B:
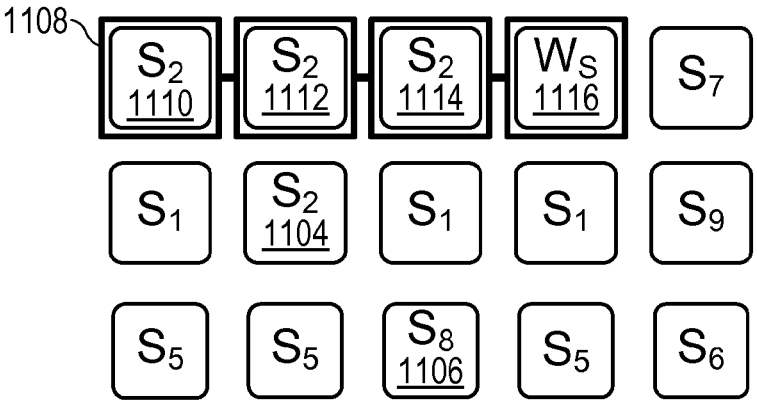
FIG. 11B is another illustration of game play on a gaming device, according to one embodiment.

In FIG. 11A, another illustration of game play on a gaming device is shown, according to one embodiment. In this example, the system and/or method may display all of the possible winning combinations with one or more smart wilds before the system and/or method places the one or more smart wilds to show the player all of the possibilities and finally demonstrating which position(s) is optimal for the one or more smart wilds. In this example, three winning combinations can be generated by placing the smart wild in a first position 1102, a second position 1104, or a third position 1106. In one example, a 4 S2 symbols may be generated by placing a first smart wild 1116 in first position 1102 to generate a first winning combination 1108 (e.g., 4 S2 symbols) (see FIG. 11B).

Figure 11C:
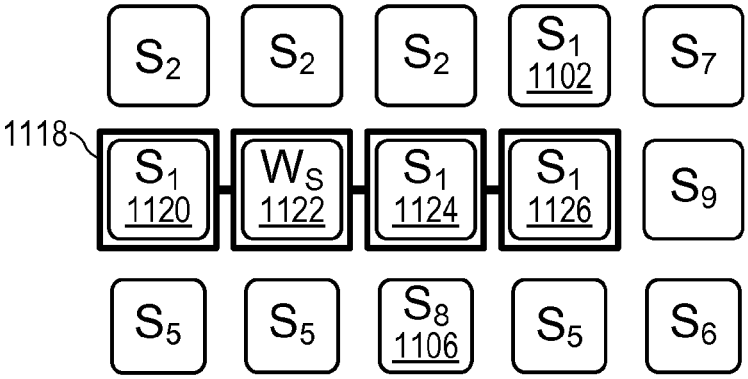
FIG. 11C is another illustration of game play on a gaming device, according to one embodiment.
Figure 11D:
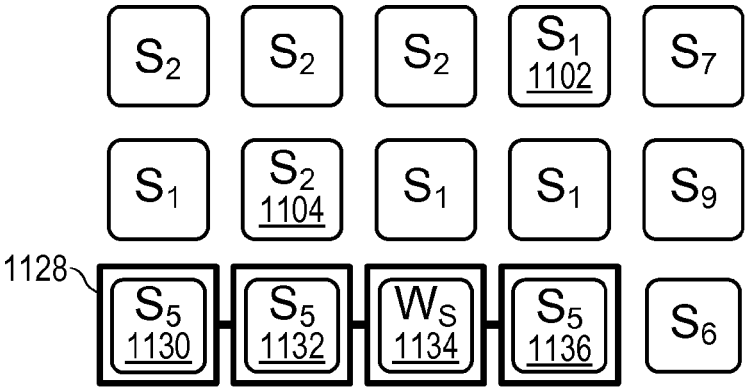
FIG. 11D is another illustration of game play on a gaming device, according to one embodiment.

In another example, a 4 S1 symbols may be generated by placing a second smart wild 1122 in second position 1104 to generate a second winning combination 1118 (e.g., 4 S1 symbols) (see FIG. 11C). In another example a 4 S5 symbols may be generated by placing a third smart wild 1134 in third position 1106 to generate a third winning combination 1128 (e.g., 4 S5 symbols) (see FIG. 11D). In one embodiment, third winning combination 1128 generates the highest award, therefore, the smart wild is placed in third position based on the highest award status. In another example, second winning combination 1118 generates the highest award, therefore, the smart wild is placed in second position based on the highest award status. In another example, first winning combination 1108 generates the highest award, therefore, the smart wild is placed in a first position based on the highest award status.

Figure 12:
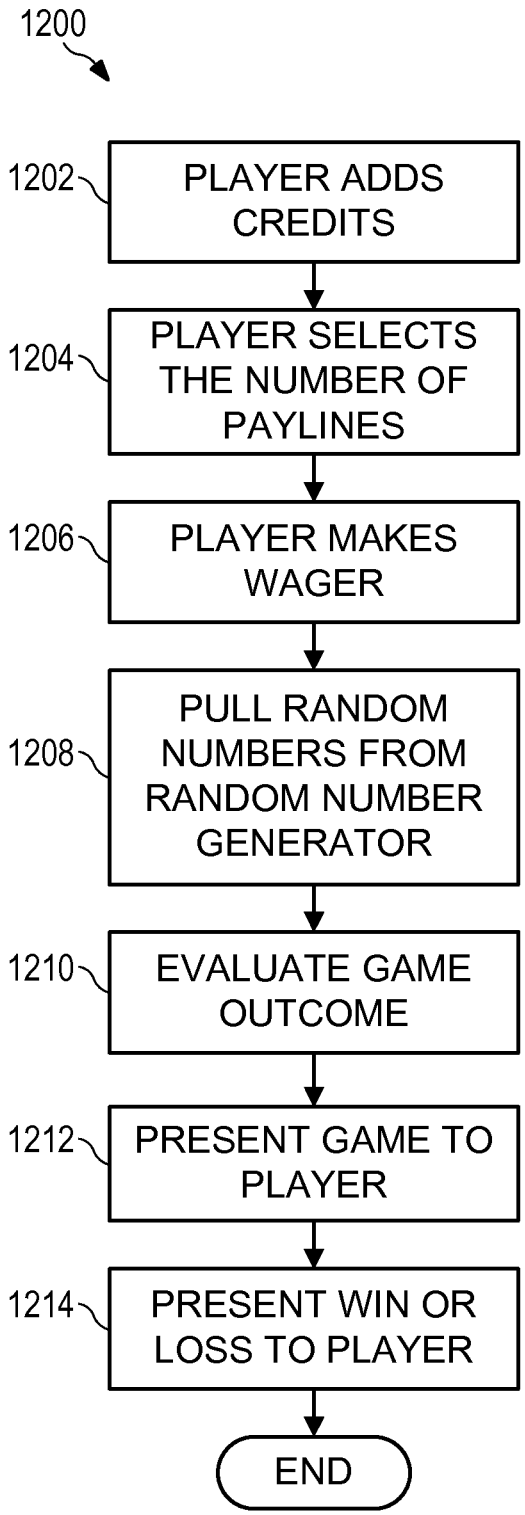
FIG. 12 is a game play flow diagram, according to one embodiment.

FIG. 12 is a process flowchart of one example of a primary game play 700 on an electronic gaming system, according to one embodiment. The method may include the step of a player adding credit to the electronic gaming system (step 1202). It is contemplated that a player can do this by inserting cash, coins, a ticket representative of a cash value, a credit card, a player card, requesting an electronic funds transfer ("EFT"), otherwise requesting access to an account having monetary funds, and/or any combination thereof.

At step 1204, the player selects the number of paylines to play. In one embodiment, the player can select from a plurality of different paylines to play. In a further embodiment, the player can only play a predetermined number of paylines. An example of this embodiment may be the instance where the gaming system only allows a player to play forty paylines, and cannot select to play more or less paylines. In another embodiment, the gaming system does not offer paylines, but rather offers a different way to evaluate the game play. One example of a different way may be sometime referred to as a 243-ways evaluation, where symbols may be evaluated based on the existence of like-symbol clusters on adjacent reels, starting with the left-most reel and continuing right, instead of how many paylines run through the like-symbol clusters.

At step 1206, the player makes a wager on the game. In one embodiment, the wager may be a multiple of the number of paylines selected at step 1204. In another embodiment, the wager may not be a multiple of the number of paylines selected at step 1204. In a further embodiment, the wager may include a side-wager (e.g., ante bet), which may, in one example of such an embodiment, be used to make the player eligible to be awarded the extra functionality discussed above. It should be appreciated that in some embodiments, the order of steps 1204 and 1206 may be not critical, and so for example, a player can select the wager they wish to place, and then select the number of paylines they want it applied to, and that these embodiments are expressly contemplated as being within the scope of the present disclosure.

Continuing to step 1208, the gaming system pulls random numbers from a random number generator ("RNG"). In one embodiment, the system pulls one random number for each reel. In another embodiment, the system pulls one random number which may be utilized to determine the stop positions for each reel. In another embodiment, the random numbers determined by the RNG may be based on the time that the numbers may be pulled. In another embodiment, the random numbers determined by the RNG may be based on the prior numbers pulled.

At steps 1210 and 1212, the gaming system utilizes the random numbers pulled at step 1208 to determine the primary game symbols to display in the play of the primary game, which in turn both determines the presentation of the game to the player and evaluates the game outcome. In one embodiment, the random numbers pulled determine the stopping positions for the reels, which may be then caused to stop at those associated positions, and then the gaming system evaluates the displayed primary game symbols to determine the game outcome. In another embodiment, the gaming system determines the game outcome based on the pulled random numbers, and then causes the game to present an associated outcome to the player.

At step 1214, the win or loss outcome may be identified for the player. In one embodiment, this step can include additional messaging, which provides information related to the win or loss, such as why the player won or lost. In another embodiment, this step can include identification of the amount of any award earned by the player.

Figure 13:
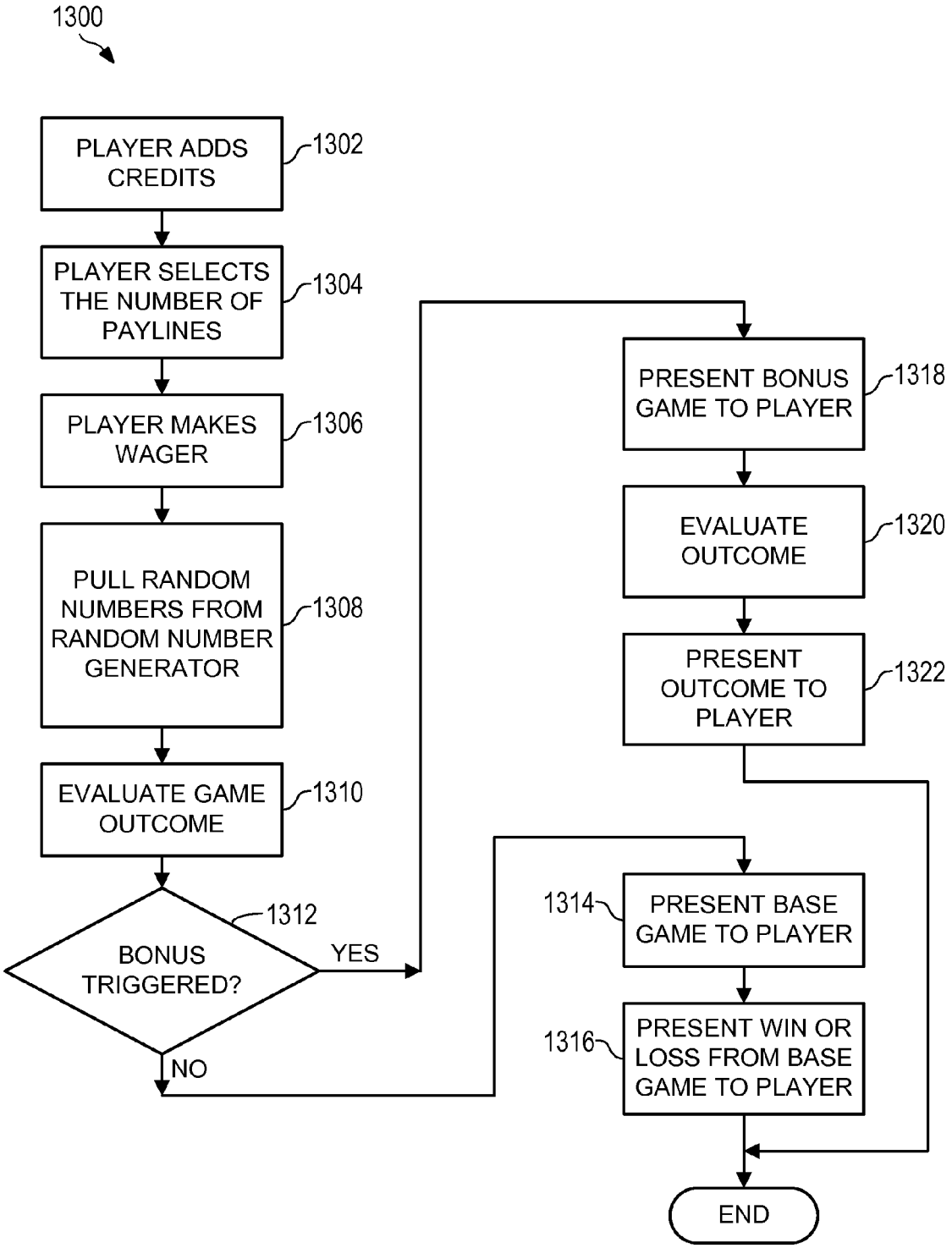
FIG. 13 is a flow diagram for game play, according to one embodiment.

FIG. 13 is a process flowchart of one example of a combined primary and secondary game play 1300 on an electronic gaming system, according to one embodiment. The method may include the step of a player adding credit to the electronic gaming system (step 1302). It is contemplated that a player can do this by inserting cash, coins, a ticket representative of a cash value, a credit card, a player card, requesting an electronic funds transfer ("EFT"), otherwise requesting access to an account having monetary funds, and/or any combination thereof.

At step 1304, the player selects the number of paylines to play. In one embodiment, the player can select from a plurality of different paylines to play. In a further embodiment, the player can only play a predetermined number of paylines. An example of this embodiment may be the instance where the gaming system only allows a player to play forty paylines, and cannot select to play more or less paylines. In another embodiment, the gaming system does not offer paylines, but rather offers a different way to evaluate the game play. One example of a different way may be sometime referred to as a 243-ways evaluation, where symbols may be evaluated based on the existence of like-symbol clusters on adjacent reels, starting with the left-most reel and continuing right, instead of how many paylines run through the like-symbol clusters.

At step 1306, the player makes a wager on the game. In one embodiment, the wager may be a multiple of the number of paylines selected at step 804. In another embodiment, the wager may not be a multiple of the number of paylines selected at step 1304. In a further embodiment, the wager may include a side-wager, which may, in one example of such an embodiment, be used to make the player eligible to be awarded the extra functionality discussed above. It should be appreciated that in some embodiments, the order of steps 1304 and 1306 may be not critical, and so for example, a player can select the wager they wish to place, and then select the number of paylines they want it applied to, and that these embodiments may be expressly contemplated as being within the scope of the present disclosure.

Continuing to step 1308, the gaming system pulls random numbers from a random number generator "RNG". In one embodiment, the system pulls one random number for each reel. In another embodiment, the system pulls one random number which may be utilized to determine the stop positions for each reel. In another embodiment, the random numbers determined by the RNG may be based on the time that the numbers may be pulled. In another embodiment, the random numbers determined by the RNG may be based on the prior numbers pulled.

At step 1310, the gaming system utilizes the random numbers pulled at step 808 to evaluate the game outcome. In one embodiment, the random numbers pulled determine the stopping positions for the reels, which may be then caused to stop at those associated positions, and then the gaming system evaluates the displayed primary game symbols to determine the game outcome. In another embodiment, the gaming system determines the game outcome based on the pulled random numbers, and then causes the game to present an associated outcome to the player.

At step 1312, the gaming system determines if a secondary or bonus game may be triggered. In one embodiment, the bonus game is triggered by the display of a plurality of matching symbols at a plurality of predetermined symbol positions within a play of the primary game. In one example, the bonus game may be triggered if a plurality of matching symbols is displayed on the $2^{nd}$, $3^{rd}$ and $4^{th}$ reel. In another example, the bonus game may be triggered if matching symbols are displayed on the $1^{st}$, $2^{nd}$ and $3^{rd}$ reels. In a further example, the bonus game may be triggered if matching symbols occur at predetermined symbol positions that include consecutive and non-consecutive reels. In another example, a bonus game (e.g., secondary game) may be triggered in any way (e.g., one special symbols in any locations, one special symbol in one or more predetermined locations, two special symbols in any locations, two special symbols in one or more predetermined locations, three special symbols in any locations, three special symbols in one or more predetermined locations, etc.).

If it is determined that a bonus or secondary game was not triggered, the process continues to step 1314, where the base game may be fully presented to the player. As discussed above, the orders of step 1310, 1312, and 1314 can be changed without affecting the novel concepts disclosed herein.

At step 1316, the win or loss outcome of the primary game may be identified for the player. In one embodiment, this step can include additional messaging, which provides information related to the win or loss, such as why the player won or lost. In another embodiment, this step can include identification of the amount of any award earned by the player If it is determined at step 1312 that a bonus or secondary game was triggered, then process 1300 continues to step 1318, where the secondary game may be presented to the player. As discussed above, there are numerous ways to present the secondary or bonus game to the player.

At steps 1320 and 1322, the outcome of the secondary game may be evaluated and presented to the player. In one embodiment, the outcome of the bonus game will always be a winning outcome. In another embodiment, the outcome of the secondary game will cause a significant award to be provided to the player. In one example of such an embodiment, the award may not be provided by the gaming system, as a casino operator may need to verify tax information before allowing such an award to be provided to the player. In one embodiment, instead of the process 1300 ending after step 1322, the process continues to step 1314 so as to finalize the primary game outcome presentation to the player.

Figure 14:
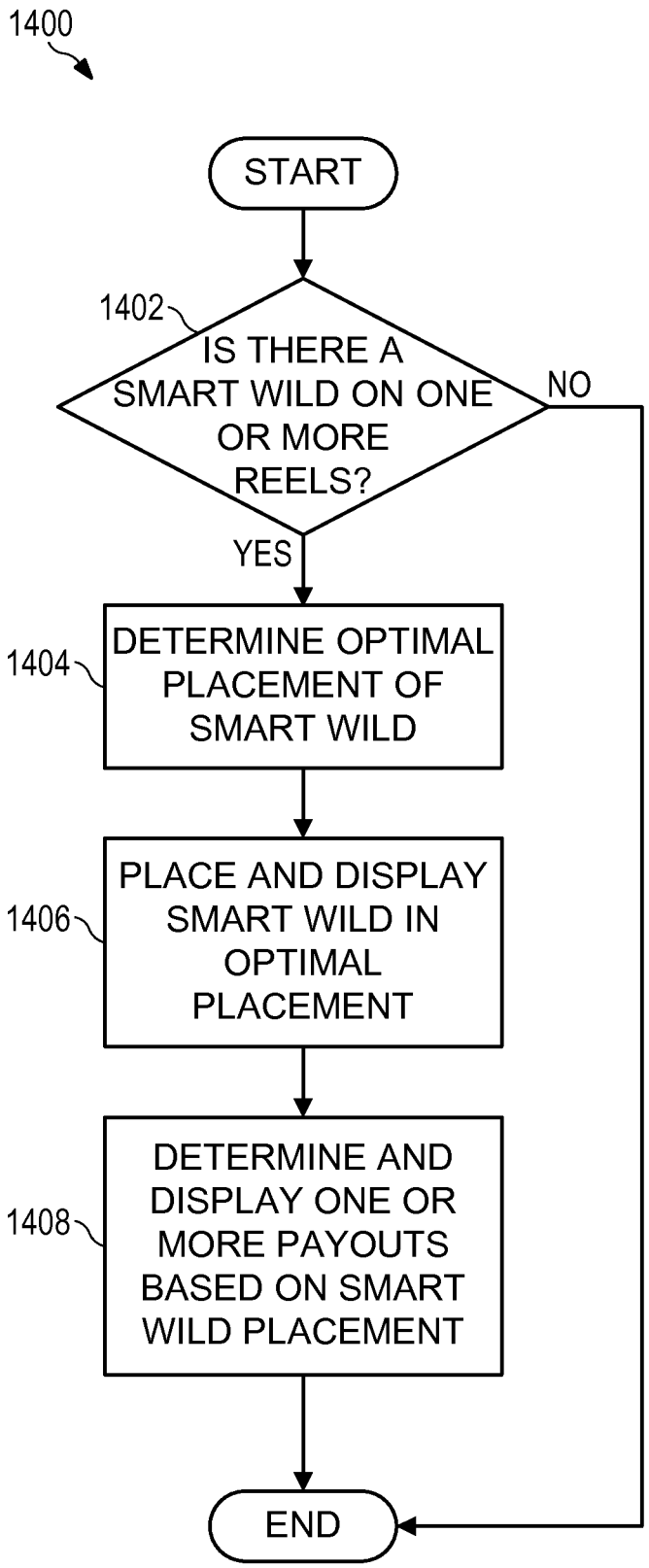
FIG. 14 is a flow diagram for game play, according to one embodiment.

In FIG. 14, a flow diagram for game play 1400 is shown, according to one embodiment. The method may include electronic gaming device 100 and/or electronic gaming system 200 determining whether there are one or more smart wilds on one or more reels (step 1402). If there are no smart wilds present on the one or more reels, then the method may end. If there are one or more smart wilds present on the one or more reels, then the method may determine one or more optimal placements for the one or more smart wilds (step 1404). The method may include placing and displaying the one or more smart wilds in one or more optimal places (step 1406). The method may include determining and displaying one or more payouts based on the one or more smart wild placements (step 1408).

Figure 15:
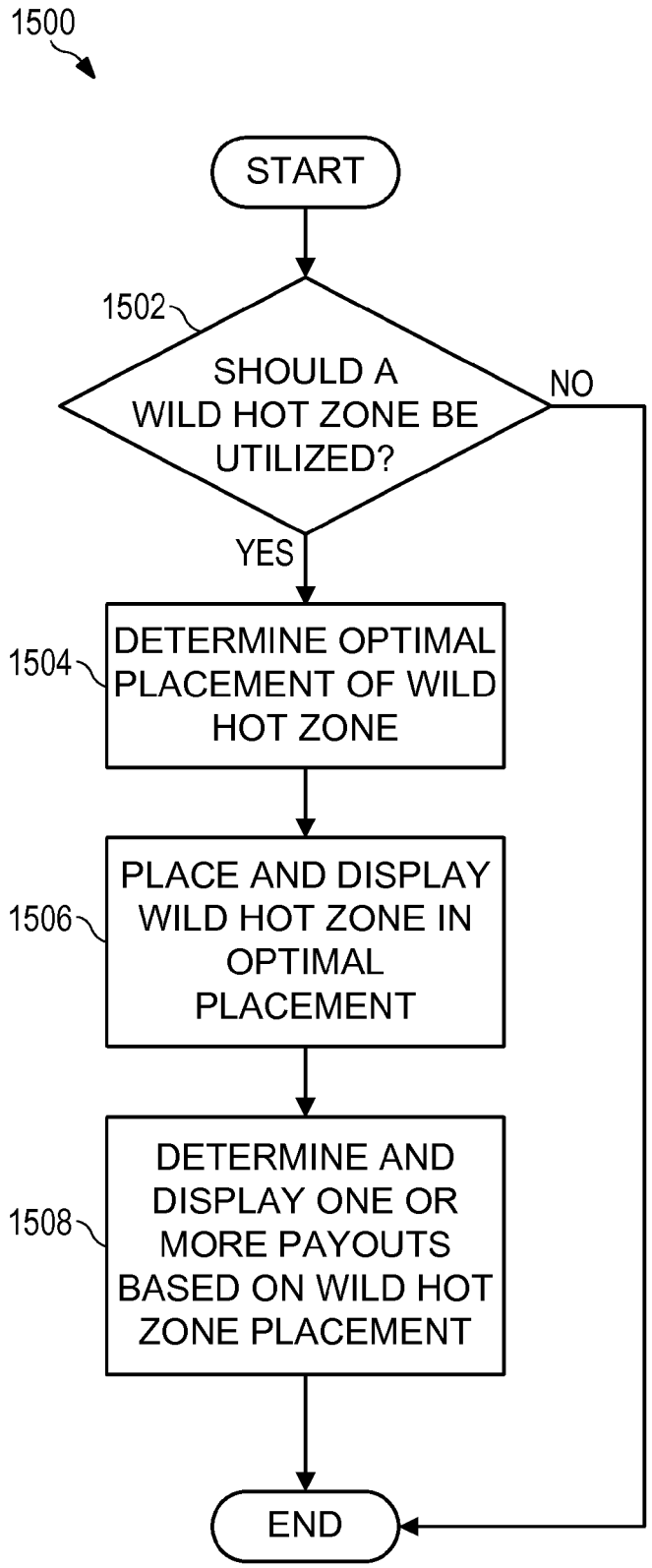
FIG. 15 is a flow diagram for game play, according to one embodiment.

In FIG. 15, a flow diagram for game play 1500 is shown, according to one embodiment. The method may include electronic gaming device 100 and/or electronic gaming system 200 determining whether one or more hot zones should be utilized (step 1502). If no hot zones should be utilized, then the method may end. If one or more hot zones should be utilized, then the method may include determining one or more optimal placements for one or more hot zones (step 1504). The method may include placing and displaying the one or more hot zones in the one or more optimal places (step 1506). The method may include determining and displaying one or more payouts based on the one or more hot zone placements (step 1508).

Figure 16:
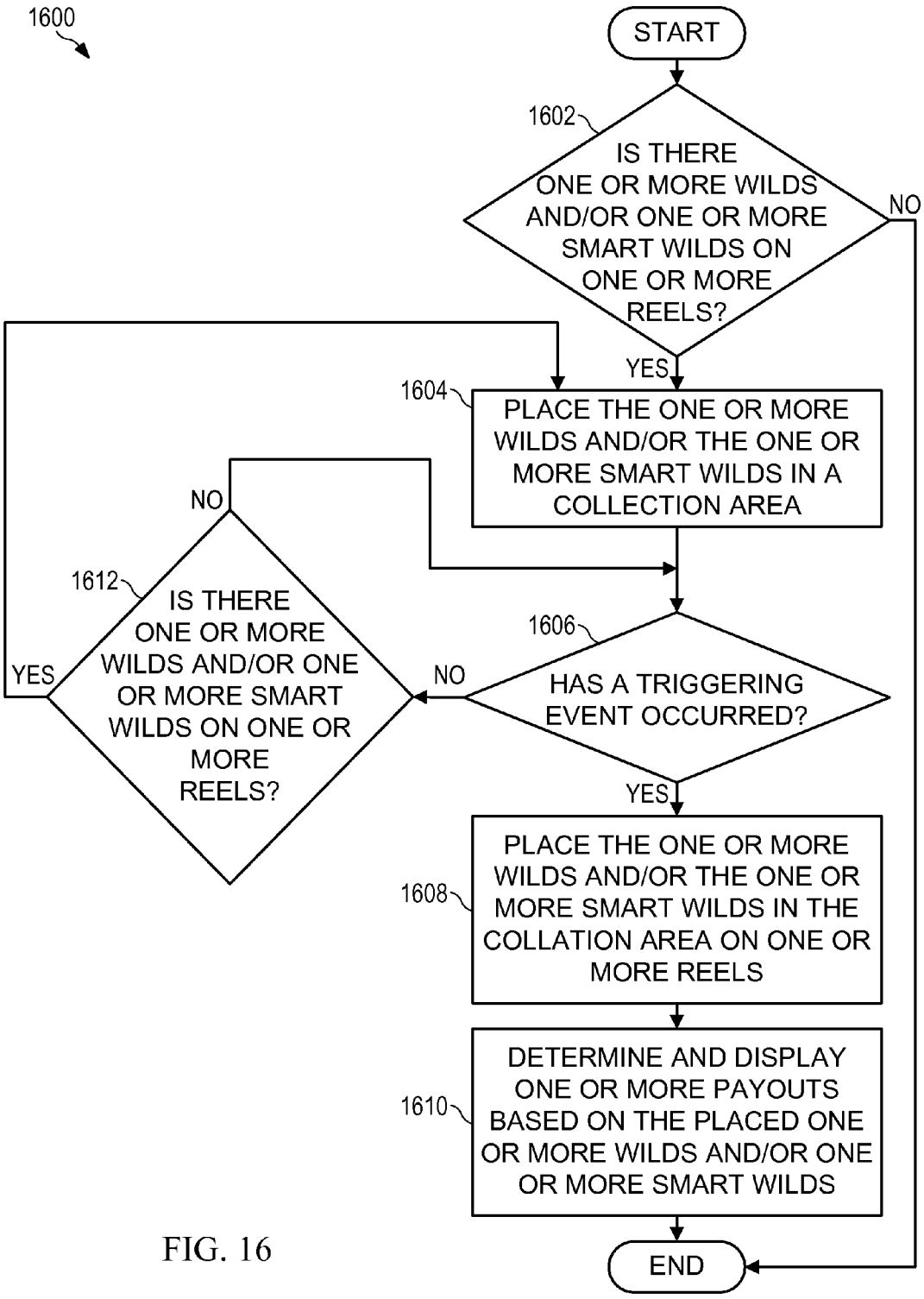
FIG. 16 is a flow diagram for game play, according to one embodiment.

In FIG. 16, a flow diagram for game play 1600 is shown, according to one embodiment. The method may include electronic gaming device 100 and/or electronic gaming system 200 determining whether there are one or more wilds and/or one or more smart wilds on one or more reels (step 1602). If there are no wilds and/or smart wilds on the one or more reels, then the method may end. If there are one or more wilds and/or smart wilds, then the method may include placing the one or more wilds and/or smart wilds in one or more collection areas (step 1604). The method may include electronic gaming device 100 and/or electronic gaming system 200 determining whether one or more triggering events have occurred (step 1606). If no triggering event has occurred, then the method may include electronic gaming device 100 and/or electronic gaming system 200 determining whether there are one or more wilds and/or one or more smart wilds on one or more reels (step 1612). If there are no wilds and/or smart wilds on the one or more reels, the method may return to step 1606. If there are one or more wilds and/or smart wilds, then the method may include placing the one or more wilds and/or smart wilds in one or more collection areas (returning to step 1604). If one or more triggering events have occurred, then the method may include placing the one or more wilds and/or smart wilds in the one or more collection areas on the one or more reels (step 1608). The method may include determining and displaying one or more payouts based on the placed one or more wilds and/or one or more smart wilds (step 1610).

Figure 17:
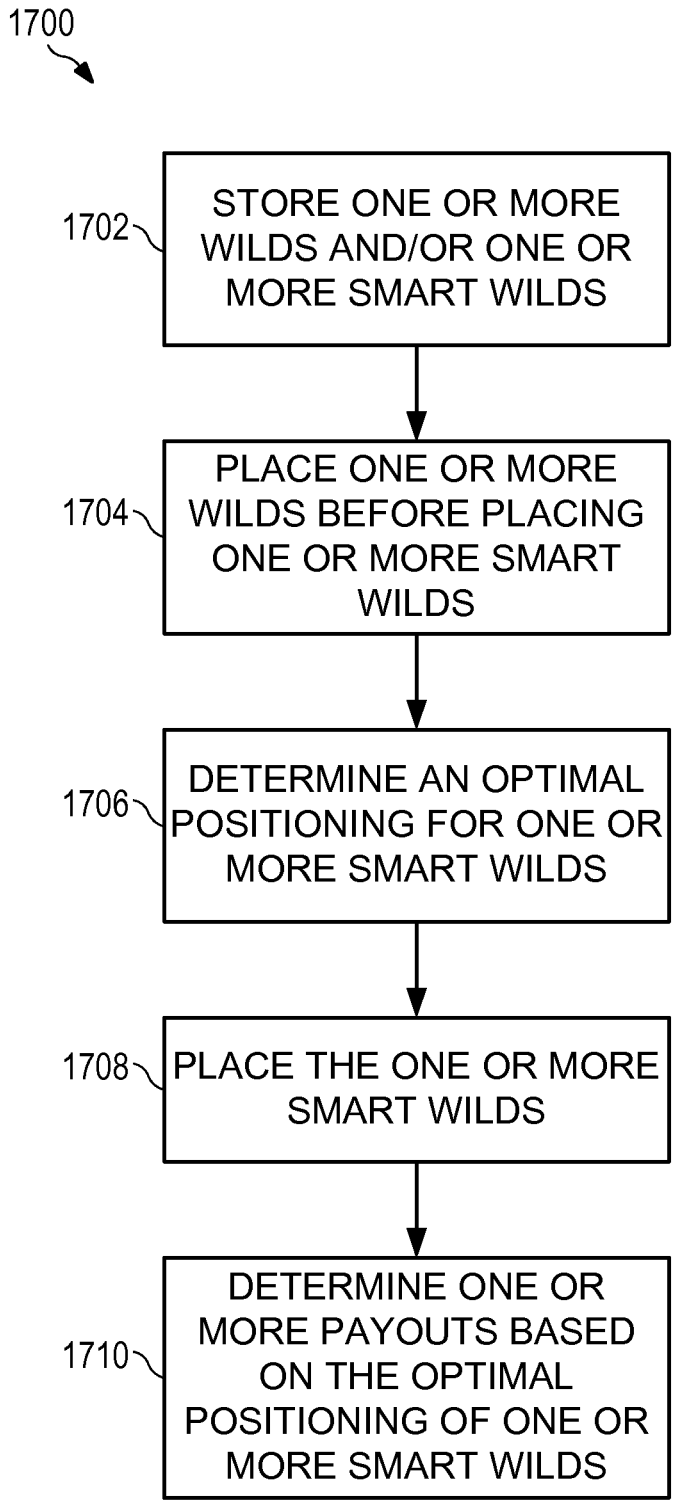
FIG. 17 is a flow diagram for game play, according to one embodiment.

FIG. 17 is a flow diagram 1700 for game play, according to one embodiment. The method may include storing one or more wilds and/or one or more smart wilds (step 1702). The method may include placing one or more wilds on the one or more reel areas before placing one or more smart wilds on the one or more reel areas (step 1704). The method may include determining an optimal positioning for one or more smart wilds (step 1706). The method may include placing the one or more smart wilds in the one or more optimal areas (step 1708). The method may include determining one or more payouts based on the optimal positioning of one or more smart wilds (step 1710).

Figure 18:
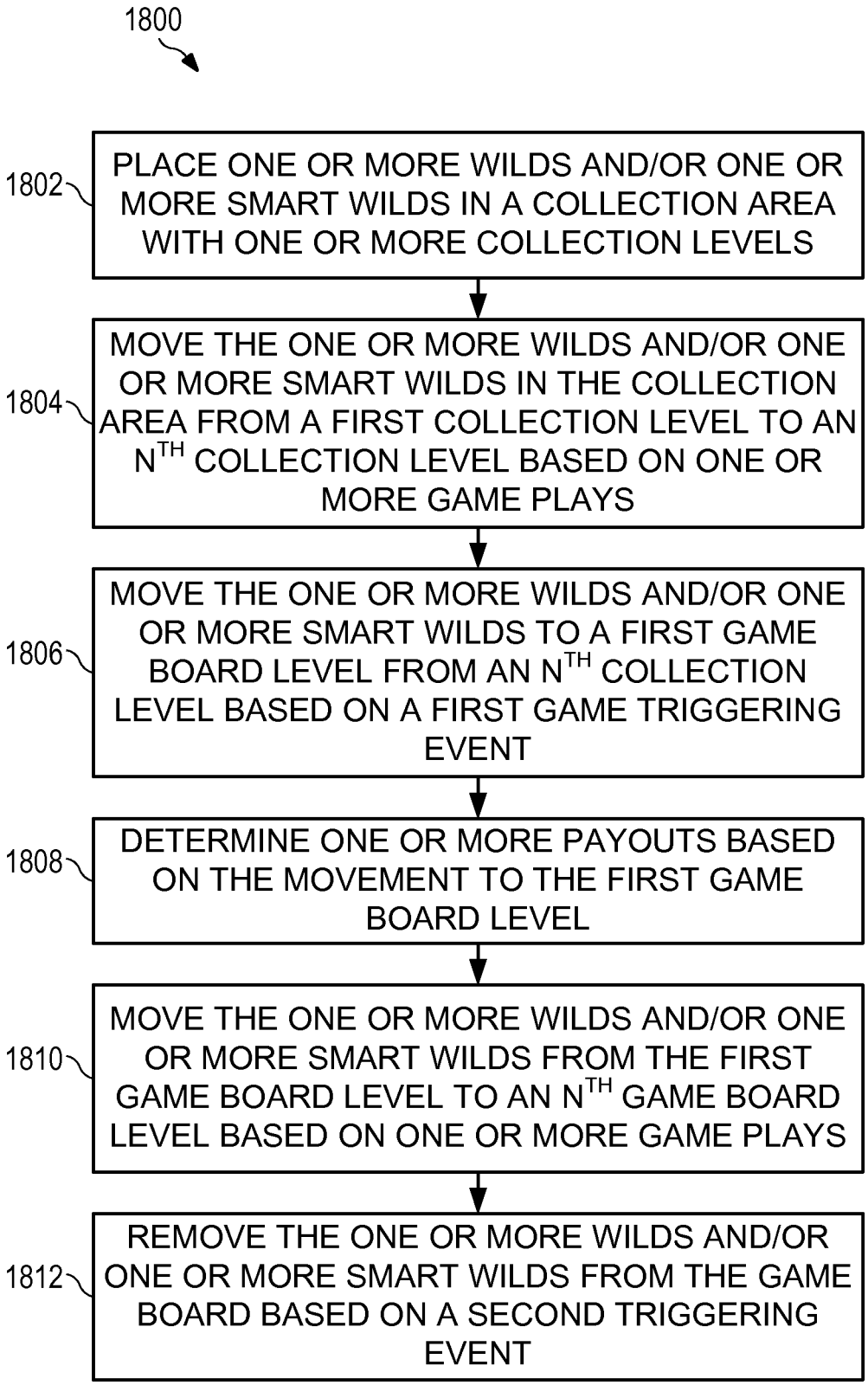
FIG. 18 is a flow diagram for game play, according to one embodiment.

FIG. 18 is a flow diagram 1800 for game play, according to one embodiment. The method may include placing one or more wilds and/or smart wilds in a collection area with one or more collection levels (step 1802). The method may include moving the one or more wilds and/or smart wilds in the collection area down (and/or any other directions) from a first collection level to an Nth collection level based on one or more game plays (step 1804). The method may include moving the one or more wilds and/or smart wilds to a first game board level from an Nth collection level based on a first game triggering event (step 1806). The method may include determining one or more payouts based on the movement to the first game board level (step 1808). The method may include moving (and/or displaying and/or determining payouts) the one or more wilds and/or smart wilds from the first game board level to an Nth game board level based on one or more game plays (step 1810). The method may include removing the one or more wilds and/or smart wilds from the game board based on a second triggering event (step 1812).

Figure 19A:
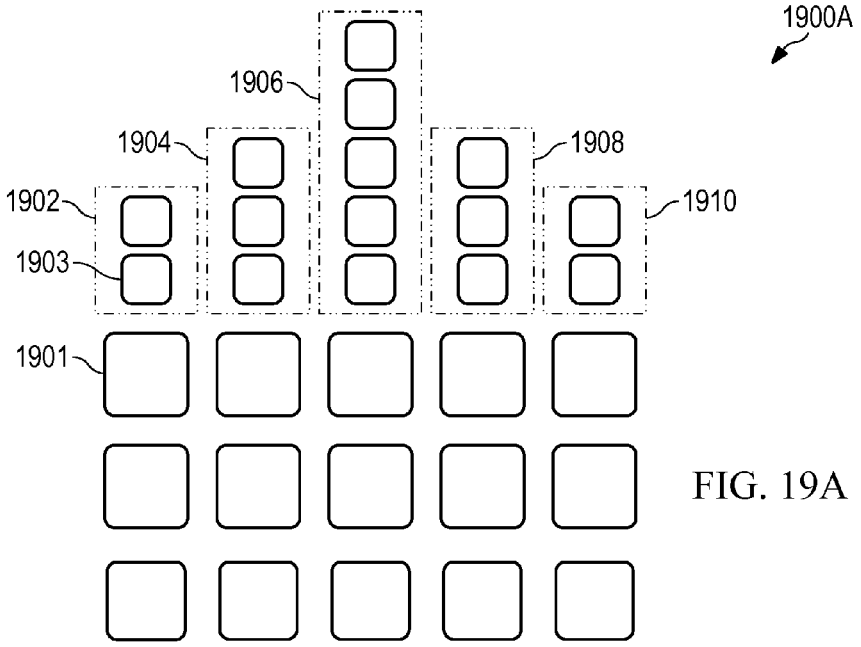
FIG. 19A is another illustration of game play on a gaming device, according to one embodiment.

In FIG. 19A, another illustration of game play on a gaming device 1900A is shown, according to one embodiment. In this example, collection area 802 has varying lengths, such as: a first column collection area 1902 including two collection locations; a second column collection area 1904 including three collection locations; a third column collection area 1906 including five collection locations; a fourth column collection area 1908 including three collection locations; and a fifth column collection area 1910 including two collection locations.

Figure 19B:
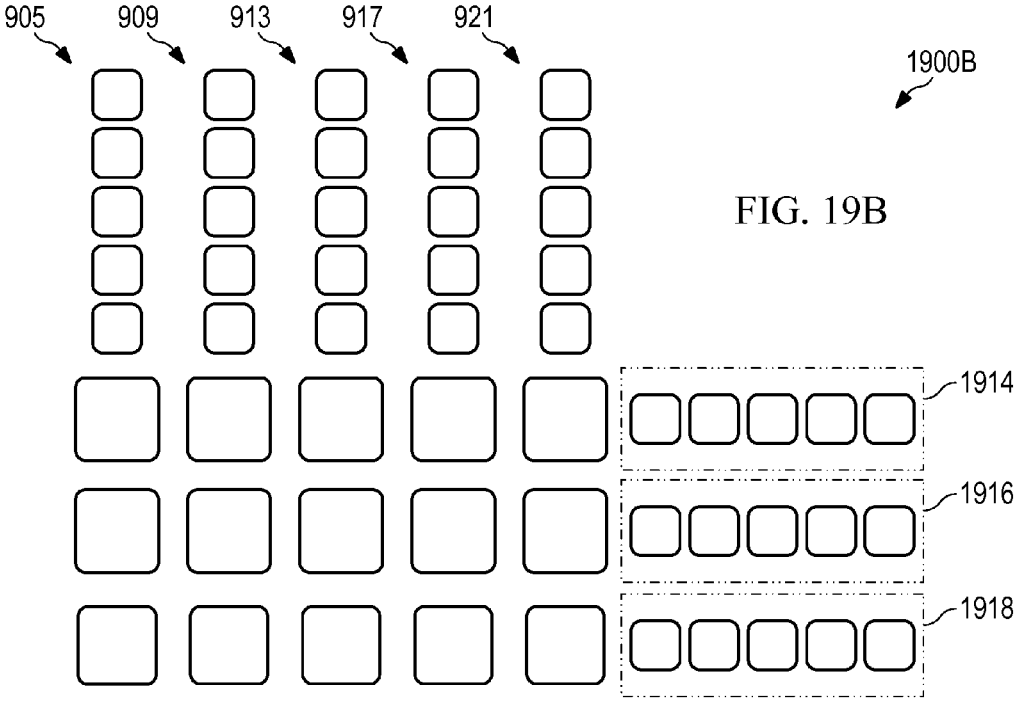
FIG. 19B is another illustration of game play on a gaming device, according to one embodiment.

In another example shown in FIG. 19B, the system and/or method include a first column collection area 905, a second column collection area 909, a third column collection area 913, a fourth column collection area 917, a fifth column collection area 921, a first row collection area 1914, a second row collection area 1916, and/or a third row collection area 1918.

Figure 19C:
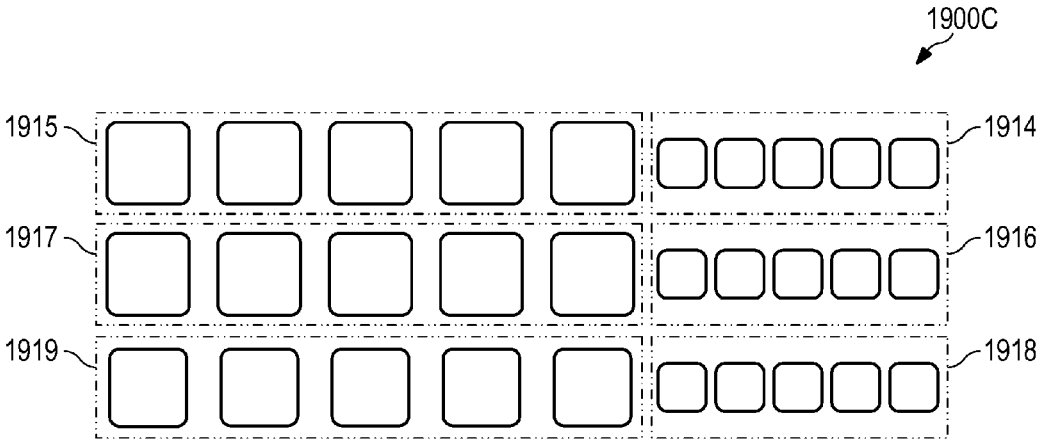
FIG. 19C is another illustration of game play on a gaming device, according to one embodiment.
Figure 19D:
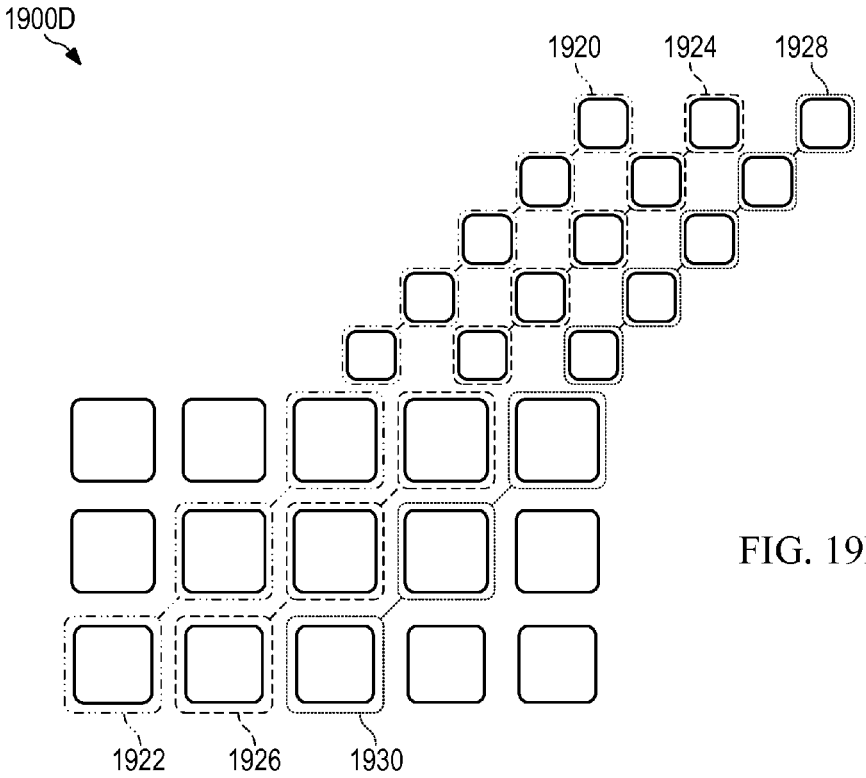
FIG. 19D is another illustration of game play on a gaming device, according to one embodiment.

In another example shown in FIG. 19C, the system and/or method may include first row collection area 1914, a second row collection area 1916, and/or a third row collection area 1918. In another example shown in FIG. 19D, the system and/or method may include a first diagonal collection area 1914, a second diagonal collection area 1916, and a third diagonal collection area 1918. The horizontal, vertical, and/or diagonal collection areas may be utilized in any combination.

Figure 20A:
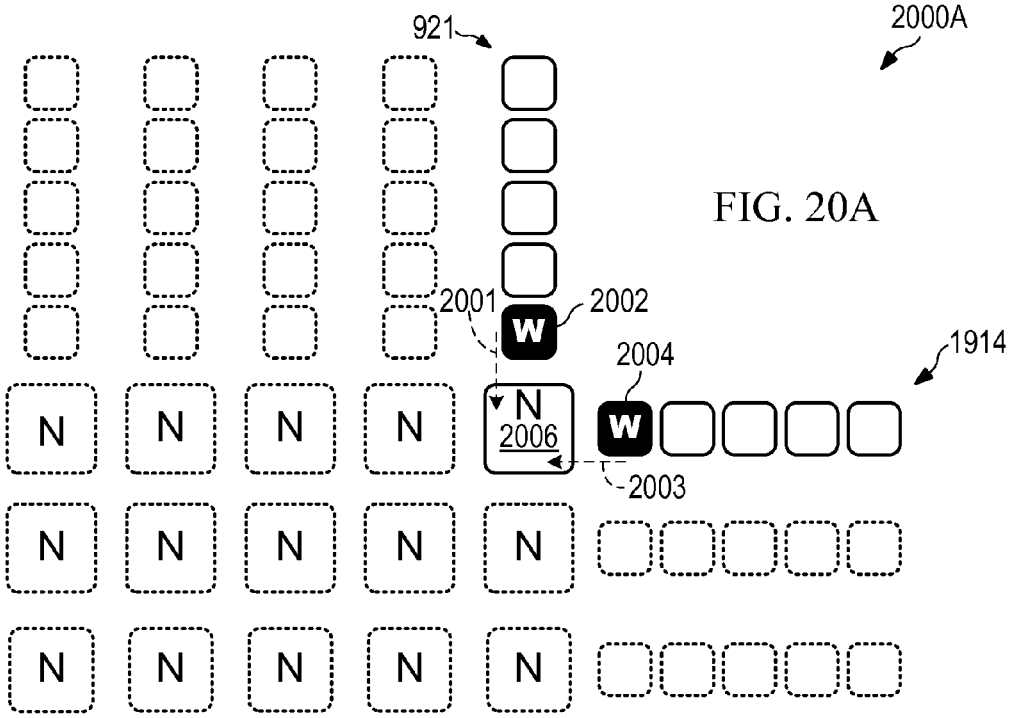
FIG. 20A is another illustration of game play on a gaming device, according to one embodiment.
Figure 20B:
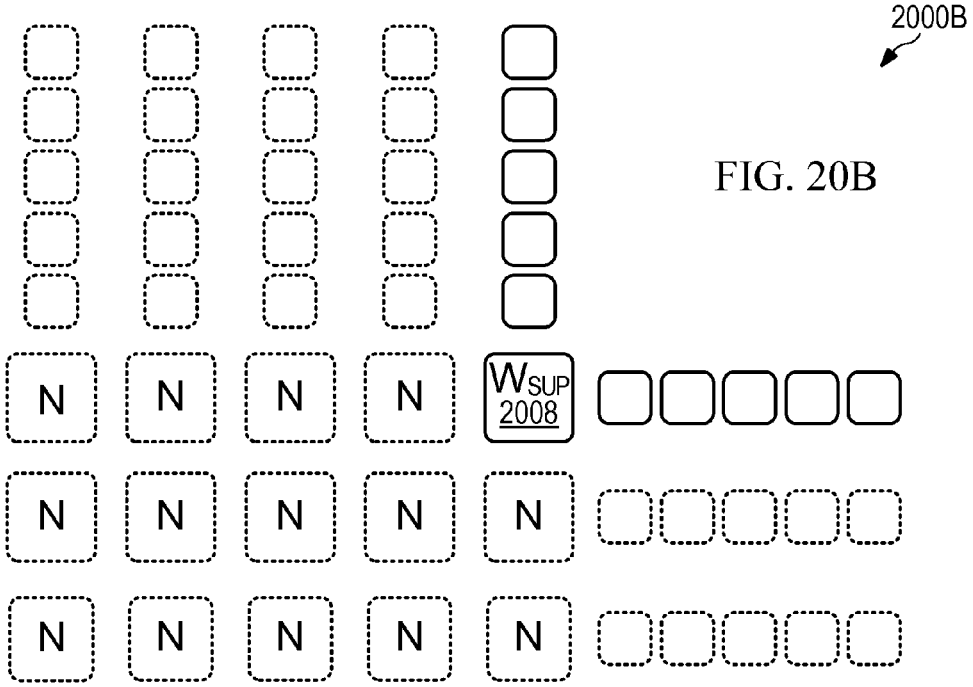
FIG. 20B is another illustration of game play on a gaming device, according to one embodiment.

In another example, a wild in a column collection area 2002 and a wild in a row collection area 2004 collide to generate a special symbol 2008 (e.g., super wild, pinball action wild, any other symbol, etc.) (see FIG. 20A and FIG. 20B).

In one embodiment, the electronic gaming device may include a processor, a memory, and a plurality of reels. The plurality of reels may include one or more areas. The memory may include one or more smart wild feature structures. The processor may generate one or more symbols to be located in the one or more areas. The processor may initiate at least a first smart wild structure based on a triggering event.

In another example, the processor may initiate a base game, a bonus game, and/or a smart wild feature game. In one example, the smart wild feature game outcome is independent of any base game outcome and bonus game outcome. In another example, the processor may utilize a first random number generating function for the base game outcome and the bonus game outcome. In an example, the processor may utilize a second random number generating function for the smart wild feature game outcome. In another example, the processor may suspend the base game and the bonus game based on an initiation of the smart wild feature game. In one example, the processor may restart the base game and the bonus game from one or more suspension points based on a completing of the smart wild feature game. In another example, the base game and the bonus game may be at one or more game levels. In an example, the processor may increase and/or decrease one or more game levels based on a smart wild feature game outcome.

One or more sensors may obtain and/or transmit one or more data points (e.g., positional data, temperature data, etc.) relating to one or more audio devices, one or more display devices, audio interface area, audio support area, audio locking device, one or more electrical attachment devices, one or more attachment areas, electronic gaming device 100, electronic gaming system 200, first audio device, wall of the audio installation area, back of the audio installation area, one or more audio interfaces, one or more electrical attachment points, an input area, one or more input devices, second audio device, front-mounted audio device, audio interface locked area, one or more electrical interconnection points, one or more electrical wires, one or more springs, one or more motors, one or more adjustable devices, and/or one or more sensors to one or more processors.

One or more sensors may obtain and/or transmit one or more data points (e.g., positional data, temperature data, etc.) relating to one or more audio devices, one or more display devices, one or more electrical wires, one or more springs, one or more motors, one or more adjustable devices, and/or one or more sensors to one or more processors.

In one embodiment, the electronic gaming device may include a plurality of reels. The one or more paylines may be formed on at least a portion of the plurality of reels. The electronic gaming device may include a memory.

In one embodiment, the electronic gaming device may include a plurality of reels. The plurality of reels may include one or more areas. The electronic gaming device may include a processor and a memory. The memory may include one or more smart wild feature structures. The processor may generate one or more symbols to be located in the one or more areas. The processor may move a first smart wild to a first replacement location based on the first replacement location having a top award amount.

In another example, the processor may initiate a base game, a bonus game, and a smart wild game. In another example, the processor may store one or more collectable symbols in a collection area. The processor may display a collected symbol in the collection area based on the one or more stored collectable symbols, according to one embodiment. In another example, the processor may move the collected symbol to a second location in the collection area based on a first spin event. In one example, the processor may move the collected symbol to a third location in the collection area based on a second spin event. In an example, the processor may move the collected symbol to an active area and modify the collected symbol into an active symbol based on one or more triggering events. In another example, the one or more triggering events may be based at least on the collection area being full. In one example, the one or more triggering events may be based on a generation of a random number.

In another embodiment, the method of providing game play via an electronic gaming device may include: initiating via one or more processors a base game; initiating via the one or more processors a smart wild game; and/or moving via the one or more processors one or more smart wilds to one or more replacement locations.

In another example, the method may include storing one or more collectable symbols in a collection area. In one example, the method may include displaying a collected symbol in the collection area based on the one or more stored collectable symbols. In another example, the method may include moving the collected symbol to a second location in the collection area based on a first spin event. The method may include moving the collected symbol to a third location in the collection area based on a second spin event, according to one embodiment. In another example, the method may include moving the collected symbol to an active area and modify the collected symbol into an active symbol based on one or more triggering events. The one or more triggering events may be based at least on the collection area being full.

In another embodiment, the electronic gaming system may include a server which includes a server processor and a server memory. The electronic gaming system may include a display device including a plurality of reels, where the plurality of reels includes one or more areas. The server memory may include one or more smart wild feature structures. The server processor may move a first smart wild to a first replacement location based on the first replacement location having a top award amount.

In another example, the server processor may initiate a base game, a bonus game, and a smart wild game. In another example, the server processor may store one or more collectable symbols in a collection area. In one example, the server processor may display a collected symbol in the collection area based on the one or more stored collectable symbols.

Gaming system may be a "state-based" system. A state-based system stores and maintains the system's current state in a non-volatile memory. Therefore, if a power failure or other malfunction occurs, the gaming system will return to the gaming system's state before the power failure or other malfunction occurred when the gaming system is powered up.

State-based gaming systems may have various functions (e.g., wagering, payline selections, reel selections, game play, bonus game play, evaluation of game play, game play result, steps of graphical representations, etc.) of the game. Each function may define a state. Further, the gaming system may store game histories, which may be utilized to reconstruct previous game plays.

A state-based system is different than a Personal Computer ("PC") because a PC is not a state-based machine. A state-based system has different software and hardware design requirements as compared to a PC system.

The gaming system may include random number generators, authentication procedures, authentication keys, and operating system kernels. These devices, modules, software, and/or procedures may allow a gaming authority to track, verify, supervise, and manage the gaming system's codes and data.

A gaming system may include state-based software architecture, state-based supporting hardware, watchdog timers, voltage monitoring systems, trust memory, gaming system designed communication interfaces, and security monitoring.

For regulatory purposes, the gaming system may be designed to prevent the gaming system's owner from misusing (e.g., cheating) via the gaming system. The gaming system may be designed to be static and monolithic.

In one example, the instructions coded in the gaming system are non-changeable (e.g., static) and are approved by a gaming authority and installation of the codes are supervised by the gaming authority. Any change in the system may require approval from the gaming authority. Further, a gaming system may have a procedure/device to validate the code and prevent the code from being utilized if the code is invalid. The hardware and software configurations are designed to comply with the gaming authorities' requirements.

As used herein, the term "mobile device" refers to a device that may from time to time have a position that changes. Such changes in position may comprise of changes to direction, distance, and/or orientation. In particular examples, a mobile device may comprise of a cellular telephone, wireless communication device, user equipment, laptop computer, other personal communication system ("PCS") device, personal digital assistant ("PDA"), personal audio device ("PAD"), portable navigational device, or other portable communication device. A mobile device may also comprise of a processor or computing platform adapted to perform functions controlled by machine-readable instructions.

The methods and/or methodologies described herein may be implemented by various means depending upon applications according to particular examples. For example, such methodologies may be implemented in hardware, firmware, software, or combinations thereof. In a hardware implementation, for example, a processing unit may be implemented within one or more application specific integrated circuits ("ASICs"), digital signal processors ("DSPs"), digital signal processing devices ("DSPDs"), programmable logic devices ("PLDs"), field programmable gate arrays ("FPGAs"), processors, controllers, micro-controllers, microprocessors, electronic devices, other devices units designed to perform the functions described herein, or combinations thereof.

Some portions of the detailed description included herein are presented in terms of algorithms or symbolic representations of operations on binary digital signals stored within a memory of a specific apparatus or a special purpose computing device or platform. In the context of this particular specification, the term specific apparatus or the like includes a general purpose computer once it is programmed to perform particular operations pursuant to instructions from program software. Algorithmic descriptions or symbolic representations are examples of techniques used by those of ordinary skill in the arts to convey the substance of their work to others skilled in the art. An algorithm is considered to be a self-consistent sequence of operations or similar signal processing leading to a desired result. In this context, operations or processing involve physical manipulation of physical quantities. Typically, although not necessarily, such quantities may take the form of electrical or magnetic signals capable of being stored, transferred, combined, compared or otherwise manipulated. It has proven convenient at times, principally for reasons of common usage, to refer to such signals as bits, data, values, elements, symbols, characters, terms, numbers, numerals, or the like. It should be understood, however, that all of these or similar terms are to be associated with appropriate physical quantities and are merely convenient labels. Unless specifically stated otherwise, as apparent from the discussion herein, it is appreciated that throughout this specification discussions utilizing terms such as "processing," "computing," "calculating," "determining" or the like refer to actions or processes of a specific apparatus, such as a special purpose computer or a similar special purpose electronic computing device. In the context of this specification, therefore, a special purpose computer or a similar special purpose electronic computing device is capable of manipulating or transforming signals, typically represented as physical electronic or magnetic quantities within memories, registers, or other information storage devices, transmission devices, or display devices of the special purpose computer or similar special purpose electronic computing device.

Reference throughout this specification to "one example," "an example," "embodiment," and/or "another example" should be considered to mean that the particular features, structures, or characteristics may be combined in one or more examples.

While there has been illustrated and described what are presently considered to be example features, it will be understood by those skilled in the art that various other modifications may be made, and equivalents may be substituted, without departing from the disclosed subject matter. Additionally, many modifications may be made to adapt a particular situation to the teachings of the disclosed subject matter without departing from the central concept described herein. Therefore, it is intended that the disclosed subject matter not be limited to the particular examples disclosed.

The invention claimed is:

1. An electronic gaming device comprising:

at least one processor;

a memory device;

a credit device configured to accept a physical item associated with a monetary value to fund a credit balance at said gaming device;

at least one electronic display; and machine-readable code stored in said memory device and executable by said at least one processor, which when executed, cause said at least one processor in response to a wager placed by said player from said credit balance, to cause said at least one electronic display to display at least one wild symbol collection area, to cause said at least one electronic display to display a plurality of game symbols at associated symbol positions, to cause said at least one electronic display to display a placement of at least one wild symbol from said wild symbol collection area to a randomly selected symbol position of said at least one of said symbol positions in replacement of the game symbol at that position, to determine, after the placement of said at least one wild symbol, an optimal symbol position for at least one smart wild, said optimal symbol position comprising a particular one of said symbols positions which, when said at least one smart wild is located in said particular one of said symbol positions in replacement of a symbol at said particular one of said symbol positions, results in an outcome having a highest award as compared to any outcomes which would occur via location of said smart wild in replacement of a symbol at any of said symbol positions other than said particular one of said symbol positions, and to cause said at least one electronic display to display said at least one smart wild in replacement of a game symbol at said optimal symbol position.

2. The electronic gaming device of claim 1 wherein said at least one processor is configured to cause said at least one smart wild move from a first one of said symbol positions to said optimal symbol position.

3. The electronic gaming device of claim 1 wherein said at least one processor is configured to cause said at least one electronic display to display said game symbols as a result of a game spin, wherein if a wild symbol is displayed as a result of said game spin, said at least one processor is configured to move said wild symbol to said wild symbol collection area.

4. The electronic gaming device of claim 1 wherein said at least one processor is configured to move said at least one wild symbol if a triggering condition is met.

5. The electronic gaming device of claim 4 wherein said triggering condition is met if said wild symbol collection area is full.

6. The electronic gaming device of claim 1 wherein said outcome having a highest award comprises an outcome having the highest credit payout.

7. The electronic gaming device of claim 1 wherein said at least one processor is further configured to increase said credit balance by an amount of credits of said outcome having said highest award.

8. A method of implementing game play at an electronic gaming device comprising the steps of:

accepting a physical item associate with a monetary value from a player via a credit device of said gaming device and generating a credit balance;

accepting placement of a wager from said credit balance by said player of the gaming device;

initiating a game via at least one processor of the gaming device, comprising:

displaying via at least one electronic display of the gaming device at least one wild symbol collection area;

displaying via said at least one electronic display a plurality of game symbols at associated symbol positions in association with a first game play;

displaying via said at least one electronic display a movement of at least one wild symbol from said wild symbol collection area to a randomly selected symbol position of said at least one of said symbol positions in replacement of the game symbol at that position;

determining, after placement of said at least one wild symbol, an optimal symbol position for at least one smart wild, said optimal symbol position comprising a particular one of said symbols positions which, when said at least one smart wild is located in said particular one of said symbol positions in replacement of a symbol at said particular one of said symbol positions, results in an outcome having a highest award as compared to any outcomes which would occur via location of said smart wild in replacement of a symbol at any of said symbol positions other than said particular one of said symbol positions; and displaying via said at least one electronic display said at least one replacement symbol in replacement of a game symbol at said optimal symbol position.

9. The method of claim 8 comprising moving said at least one smart wild move from a first symbol position to said optimal symbol position.

10. The method of claim 8 wherein if a wild symbol is displayed in one of said symbol positions as a result of said first game play, moving said wild symbol to said wild symbol collection area.

11. The method of claim 8 comprising moving said at least one wild symbol if a triggering condition is met.

12. The method of claim 11 wherein said triggering condition is met if said wild symbol collection area is full.

13. The method of claim 8 wherein said outcome having a highest award comprises an outcome having the highest credit payout.

14. The method of claim 8 further comprising the step of increasing said credit balance by an amount of credits of said outcome having said highest award.

* * * * *